US011865429B2

(12) United States Patent
Hall

(10) Patent No.: US 11,865,429 B2
(45) Date of Patent: Jan. 9, 2024

(54) SMART SOCCER GOAL

(71) Applicant: COPA Innovation Laboratories, LLC, Walnut Creek, CA (US)

(72) Inventor: Mark D. Hall, Fairfield, CA (US)

(73) Assignee: COPA Innovation Laboratories, LLC, Walnut Creek, CA (US)

( * ) Notice: Subject to any disclaimer, the term of this patent is extended or adjusted under 35 U.S.C. 154(b) by 0 days.

(21) Appl. No.: 17/952,795

(22) Filed: Sep. 26, 2022

(65) Prior Publication Data

US 2023/0015676 A1 Jan. 19, 2023

Related U.S. Application Data

(63) Continuation of application No. 17/098,105, filed on Nov. 13, 2020, now Pat. No. 11,452,929.

(60) Provisional application No. 62/936,231, filed on Nov. 15, 2019.

(51) Int. Cl.

| | |
|---|---|
| ***A63B 71/06*** | (2006.01) |
| ***A63B 69/00*** | (2006.01) |
| ***A63B 63/00*** | (2006.01) |

(52) U.S. Cl.

CPC ..... *A63B 71/0622* (2013.01); *A63B 63/004* (2013.01); *A63B 69/002* (2013.01); *A63B 2071/0625* (2013.01); *A63B 2071/0694* (2013.01); *A63B 2225/74* (2020.08); *A63B 2243/0025* (2013.01)

(58) Field of Classification Search

CPC .. A63B 71/0622; A63B 63/004; A63B 69/002
See application file for complete search history.

(56) References Cited

U.S. PATENT DOCUMENTS

| | | | | |
|---|---|---|---|---|
| 2003/0181268 | A1* | 9/2003 | Nelson | A63B 63/00 473/480 |
| 2005/0032581 | A1* | 2/2005 | Wagner | A63B 69/0026 473/173 |
| 2009/0111582 | A1* | 4/2009 | Schuler | A63F 13/216 473/415 |
| 2009/0298588 | A1* | 12/2009 | Gopinath | A63B 71/0605 463/36 |
| 2012/0238383 | A1* | 9/2012 | Simonnet | A63B 71/0605 473/446 |
| 2013/0065712 | A1* | 3/2013 | Morris | A63B 69/0075 473/420 |
| 2013/0130843 | A1* | 5/2013 | Burroughs | G01S 13/751 473/415 |
| 2013/0178315 | A1* | 7/2013 | Wright | A63B 63/06 473/470 |
| 2014/0045628 | A1* | 2/2014 | Krohl | A63B 63/00 473/446 |
| 2014/0192204 | A1* | 7/2014 | Glazer | G01S 3/7864 348/169 |

(Continued)

*Primary Examiner* — Eugene L Kim
*Assistant Examiner* — Christopher Glenn
(74) *Attorney, Agent, or Firm* — Foley & Lardner LLP

(57) ABSTRACT

A smart soccer goal for tracking and communicating motion of objects includes a goal frame; a net coupled to the goal frame including a plurality of lights; and one or more sensors coupled to the goal frame. A first sensor of the one or more sensors is directed to detecting movement within and immediately near the smart soccer goal and a second sensor of the one or more sensors is directed to detecting movement outside of the smart soccer goal.

16 Claims, 22 Drawing Sheets

(56) References Cited

U.S. PATENT DOCUMENTS

| | | | | |
|---|---|---|---|---|
| 2015/0265897 | A1* | 9/2015 | Gordon | A63B 63/083 473/447 |
| 2015/0283443 | A1* | 10/2015 | Dunser | A63B 71/0619 473/422 |
| 2016/0016059 | A1* | 1/2016 | Martinez | A63B 63/004 473/478 |
| 2016/0136504 | A1* | 5/2016 | Cuttino | A63B 71/0605 473/415 |
| 2017/0095716 | A1* | 4/2017 | Lewis | A63B 69/40 |
| 2017/0128807 | A1* | 5/2017 | Bohan | A63B 71/0622 |
| 2019/0043218 | A1* | 2/2019 | Hiltner | H04N 23/60 |

* cited by examiner

SMART SOCCER GOAL

CROSS-REFERENCE TO RELATED APPLICATIONS

This application claims the benefit of priority as a continuation to U.S. application Ser. No. 17/098,105, filed Nov. 13, 2020, which claims priority to U.S. Provisional Application No. 62/936,231, filed Nov. 15, 2019, the entirety of each of which is incorporated by reference herein.

BACKGROUND

The following description is provided to assist the understanding of the reader. None of the information provided or references cited is admitted to be prior art.

Soccer is one of the most popular sports in the world. Players that play soccer may train at training facilities to improve their performance. Such training facilities may include grass or hard playing surfaces and some sort of target for players to shoot at. Players playing in the training facility may shoot at the target and individually determine whether the soccer ball hit or was close to hitting the target. The training facilities rarely have any sort of feedback mechanism that is capable of displaying how various players within the facility are performing or keeping track of any training progress the players make. While various coaches and observers may manually keep track of players and perform an "eye test" to differentiate between players and how they are performing, there is currently not a system that can accurately provide objective measurements for player performance nor for player performance of kicks on goal. Any sort of evaluation process performed at the training facilities may be manually performed and may be subject to a large amount of error.

BRIEF DESCRIPTION OF THE DRAWINGS

The details of one or more implementations are set forth in the accompanying drawings and the description below. Other features, aspects, and advantages of the disclosure will become apparent from the description, the drawings, and the claims, in which:

Figure 1:
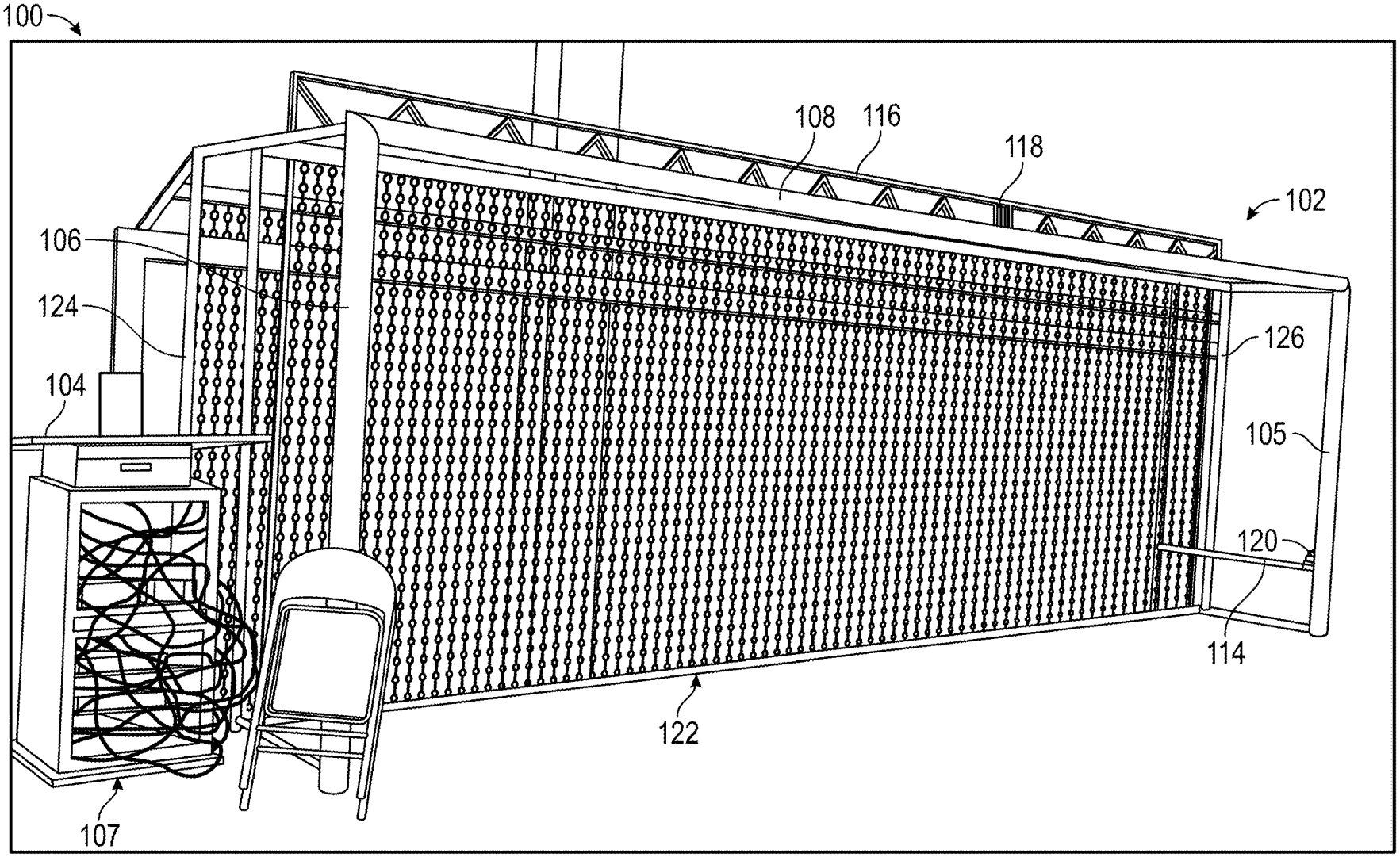
FIG. 1 is a perspective view of a smart soccer goal, in accordance with some embodiments of the present disclosure.

The foregoing and other features of the present disclosure will become apparent from the following description and appended claims, taken in conjunction with the accompanying drawings. Understanding that these drawings depict only several embodiments in accordance with the disclosure and are, therefore, not to be considered limiting of its scope, the disclosure will be described with additional specificity and detail through use of the accompanying drawings.

DETAILED DESCRIPTION

In the following detailed description, reference is made to the accompanying drawings, which form a part hereof. In the drawings, similar symbols typically identify similar components, unless context dictates otherwise. The illustrative embodiments described in the detailed description, drawings, and claims are not meant to be limiting. Other embodiments may be utilized, and other changes may be made, without departing from the spirit or scope of the subject matter presented here. It will be readily understood that the aspects of the present disclosure, as generally described herein and illustrated in the figures, can be arranged, substituted, combined, and designed in a wide variety of different configurations, all of which are explicitly contemplated and made part of this disclosure.

The present disclosure is generally directed to a smart soccer goal environment. The smart soccer goal environment may include a plurality of components or equipment that operate together in a closed-loop environment. The components may include a smart soccer goal that includes an LED net and various sensors that generate objective data about soccer players as they perform various actions and score goals on the smart soccer goal. Based on the objective data, a variety of scores and characteristics of players may be generated that the players can view to see how they are performing and that the system can use to perform various functions.

Exemplary embodiments described herein provide for a closed-loop system that continuously and/or automatically detects movements of soccer players or ball(s) in play as they move and/or perform various actions. Data is collected from sensors that are directed away from the smart soccer goal and sensors that are directed inwards towards the area between and immediately in front of a goal line and the LED net of the smart soccer goal. The closed-loop system may use the detected spatial movement across moments of time to generate data that can be implemented to track players and ball(s) as they move across a field. The closed-loop system may generate and store characteristic data about the players such as how far they move, how fast they are moving, how accurate they are when taking shots, their kick power, etc. The closed-loop system may automatically generate player profiles for the players that include such characteristic data so players can view objective data about their performance. As player data is collected, players can view their performance over time to view areas in which they are improving and areas in which they need to improve.

The system may use the collected data to determine when soccer players take shots and the outcome of such shots. For example, data generated by sensors directed towards a field may be analyzed to determine when a player takes a shot. The system may analyze data from sensors directed towards the inside of the smart soccer goal to see if the ball went into the smart soccer goal. If the system does not detect a ball in the sensor data, the system may determine that the player missed and output a light display on the LED net indicating a miss. However, if the system detects that a ball crossed into the smart soccer goal, the system may determine a speed at which the soccer ball is traveling and a location within the goal that the soccer ball may hit. In some embodiments, the LED net may display light patterns for players to shoot at. The system may detect when the players shoot at the light patterns and whether the players hit the light patterns. The system may display an indication of whether the shot was successful (e.g., hit the target) and a speed at which the shot was taken on the LED net. Further, the system may use data from the shot and observations of the ball and player to determine an accuracy and a kick power of the player that took the shot.

The system may also use the collected data to determine an amount of spin and/or curve players put on shots through three dimensional space. The system may use image and spatial data collected while the ball is between or immediately in front of the goal line and the LED net to identify a marking or spatial surface of the soccer ball. The system may identify any movement or surface of any random marking or variance to determine if the ball is spinning. Also, the system may use depth data from times that the ball is behind the goal line and outside of the smart soccer goal to determine if the ball is curving through three dimensional space. The system may determine a trajectory of the ball over time and determine if the trajectory is changing. If the trajectory is changing, the system may determine that the ball is curving and an amount of curve.

Further, the collected data may be used to operate various components of the closed-loop system. For example, the system may use the collected data to determine characteristics and location of a soccer player at various moments of play. Based on the characteristics, the system may automatically determine locations on a soccer field to launch a soccer ball with a field launcher. The system may automatically observe, determine and predict the locations (e.g., using a combination of sensing and machine learning techniques) so the player can reach them in time to receive the soccer ball and/or so the player may have to work to get there in time to receive it. The system may communicate with further devices such as motor controlled staging lights (as well as spatial audio, drone or remote control devices, augmented reality devices, immersive media, etc.) to shine a spotlight (or other image projection technology such as stage lighting) on various environment locations to show the player where to go to receive the soccer ball or indicate training actions to a player or audience.

The collected data may be used to operate any type of device. For example, the system may use the collected data to operate robotic defenders or a goalie that may move around a soccer field. The system may determine locations of soccer players in real-time and determine speeds and/or locations to move the robotic defenders or a goalie to attempt to stop soccer players playing a game or that are training from scoring a goal or passing to each other. The system may implement various training programs to determine a speed at which the robotic defenders or the goalie may move. The system may cause the robotic defenders and/or the goalie to move in preset patterns or in reaction to the locations of soccer players and a soccer ball. In some embodiments, the system may create an augmented reality environment that displays virtual defenders on the soccer field performing the same operations. Soccer players may wear a virtual reality device and attempt to kick a soccer ball around the virtual defenders and/or goalie. The collected data may be used by any device for any purpose. Further, individual devices may collect and process similar data and send such data to other devices, enabling machine to machine communication and control.

The motor controlled staging lights or spotlight may also be used to simulate a ghost soccer player performing a soccer drill to which another soccer player may compare himself or herself against, along with other immersion media and training techniques. For example, a professional soccer player may perform a soccer drill such as running around various cones or light indicated positions on a soccer field. The system may collect data identifying the professional soccer player, his or her movements, and his or her locations over time on the soccer field. The system may cause the spotlight to simulate the professional soccer player's movements by shining a spotlight on the field in a pattern that substantially mimics the professional soccer player's movements. Another soccer player may perform the same drill while the spotlight shines the light on the field to see how he or she compares against the professional soccer player. Additionally, the LED net may communicate the professional soccer player's movements or performance patterns. Another such implementation could include use of Augmented Reality to overlay screen or glasses type devices to further communicate in unison with the spotlights or LED screen.

The system may also use system collected data to determine and influence training programs which can be implemented and continually improved upon during training of soccer players. The training programs may be daily training programs or training programs that take multiple days to complete. The system may use the collected data to determine characteristics of soccer players. The system may determine which characteristics of soccer players have the lowest score and identify a training program that is directed to improving such characteristics. The system may utilize a combination of sensing and machine learning techniques that may be expanded upon over time to more accurately identify specific skill set training parameters and additional programs to implement to be effective for individual or group specific players and/or player types. The system may, in some cases, ignore training programs that the system determines are not effective.

Finally, the system may use the collected data to correct any deficiencies in form of players that perform various actions. The system may identify a model form from a soccer player such as a professional athlete based on sensor data that the system collects. The system may collect sensor data from another player performing the same action and compare the forms together. The system may identify differences in form and output the differences so the player can determine how to adjust his or her form to be closer to the model form.

Advantageously, the system enables collection and use of sensor data related to player performance as soccer players perform various drills or play in soccer games. The system may collect sensor data related to player performance on a soccer field and soccer ball motions once the ball crosses the goal line to obtain objective measurements that indicate how the players perform. The system may use the objective measurements to automatically generate individualized training programs for players and/or locations to launch a soccer ball with a field launcher in a training session. The system may enable a closed-loop or automated soccer training experience by being able to train individual players using objective data and a variety of soccer equipment and avoid using any subjective data (e.g., personality, style, etc.), or human generated data or preference which may be error prone (trainer passing, trainer positions, biased accuracy or velocity observations, etc.), to determine how to do so.

Referring now to FIG. 1, a perspective view of a smart soccer goal system 100 is shown, in accordance with some embodiments of the present disclosure. Smart soccer goal system 100 is shown to include a smart soccer goal 102 and a kiosk 104. Smart soccer goal 102 is shown to include posts 105 and 106, a front crossbar 108, a back crossbar 113, a support beam 114, a truss 116, back posts 124 and 126, and a LED net 122, in some embodiments. Posts 105 and 106, back posts 124 and 126, front crossbar 112, and back crossbar 113 may be coupled such that they form a frame of smart soccer goal 102. LED net 122 may be coupled to back crossbar 113 and back posts 124 and 126 such that LED net 122 hangs from back crossbar 113 and spreads across a width of smart soccer goal 102. Truss 116 may be coupled to or be a part of back crossbar 113 and be used as a support so back crossbar 113 does not bend. Truss 116 may be made of steel or any other material. For further structural support, support beam 114 may be coupled to post 110 and back post 126 so LED net 122 may not tip over as easily. In some embodiments, posts 105 and 106 may have an inverted U-shape with back posts 124 and 126 coupled to the top of the "U." Advantageously, by coupling back posts 124 and 126 to the top of the "U," an operator may move LED net 122 along the top of the U to adjust a depth of smart soccer goal 102. In some embodiments, smart soccer goal 102 may include wheels (not shown). The wheels may be folded up when smart soccer goal 102 is to remain stationary and folded down to contact the ground when smart soccer goal 102 is to be moved.

Smart soccer goal 102 is also shown to include sensors 118 and 120, in some embodiments. Sensors 118 and 120 are examples of sensors of smart soccer goal 102. Sensor 120 may be an "on-goal" sensor (e.g., a sensor dedicated to collecting data associated with the area within smart soccer goal 102). Sensor 118 may be an "off-goal" sensor (e.g., a sensor dedicated to collecting data associated with the area outside of smart soccer goal 102 such as a soccer field). Smart soccer goal 102 may include any number of sensors and the sensors can be in any location and pointing in any direction. Sensors 120 may include a depth sensor such as a time of flight, stereo based three dimensional imaging, structured light or otherwise active infrared or laser based reflection sensor that can continuously output a field of view spread of infrared or laser lights across the width of smart soccer goal 102 both within smart soccer goal 102 and in front of a goal line of smart soccer goal 102. Sensors 120 may include video frame image cameras. The video frame image cameras may emit thousands or more points of reference in both a 3d imaging space and in a time variance space. If an object passes in front of sensor 120 and at least a portion of the image space of the sensor detects the object, such as time of flight, the infrared lights may reflect off the object and hit sensor 120. Sensor 120 may receive the reflected infrared lights and generate data indicating a length of time it took for the lights to be received starting at the time the reflective sensors generated the infrared lights. In some embodiments, kiosk 104 may use data generated by sensor 120 to determine a depth in a "depth map" image of the field in front of sensor 120. Based on the depth map, kiosk may determine a position and speed of a soccer ball as it approaches and crosses the goal line of smart soccer goal 102. In some embodiments, smart soccer goal 102 may include sensors similar to sensor 120 that are coupled to posts 105 and 106. Such sensors may be pointed inwards towards the inside of the goal to detect and provide data indicating when and/or where a soccer ball passed over the goal line. Similar sensors may also be coupled to cross bar 108 and pointing downwards to collect data within and outside of smart soccer goal 102. Sensor 120 may transmit the data it generates to kiosk 104 for processing.

Sensor 118 may be a depth sensor similar to sensor 120 that outputs a field of optical sensing (infrared light, laser light, stereo 3D, time of flight, structured light, etc.) away from smart soccer goal 102. The depth sensor may image objects on a field based on the optical sensing. Sensor 120 may receive a light or reflection of a light that sensor 120 emitted and determine a length of time it took to receive the reflection or otherwise calculate a position in space. Sensor 120 may generate data indicating the determined length of time. Sensor 120 may transmit the generated data to kiosk 104 for processing.

In some embodiments, posts 105 and 106 and/or crossbar 108 may include depth sensors that point away from smart soccer goal 102 (e.g., off-goal). Such depth sensors may detect movements of various objects such as, but not limited to, soccer players playing a soccer game and/or the soccer ball with which the soccer players are playing. The sensors in posts 105 and 106 and/or cross bar 108 may generate and send data to kiosk 104 for processing to determine characteristics of the data that they generate such as characteristics (e.g., performance metrics) of the movement of a soccer ball or players playing the soccer game.

In some embodiments, smart soccer goal 102 may include force sensors (not shown). The force sensors may be coupled to LED net 122. Examples of force sensors that may be used include, but are not limited to, tension force sensors, compressive force sensors, tension and compression force sensors, etc. The force sensors may be configured to measure an amount of force with which a soccer ball hits LED net 122. Force sensors may measure the amount of force in Newtons. For example, force sensors may be coupled to LED net 122. A soccer ball may cross the goal line of smart soccer goal 102 and contact one or more of the force sensors of LED net 122. The contacted force sensors may measure an amount of force with which they were struck. The force sensors may send the measurement to kiosk 104 for processing in addition to or instead of data generated by sensors 118 and 120.

In some embodiments, a LIDAR sensor may be coupled to cross bar 108 and/or one of posts 105 or 106. Any number of LIDAR sensors may be coupled to cross bar 108 and posts 105 and 106. The LIDAR sensor may be pointed off-goal to provide data to kiosk 104 indicating locations of various objects within the visual range of the LIDAR sensor on a surface (e.g., a soccer field). The LIDAR sensor may be able to generate data indicating movement of an object (e.g., a soccer player) and send the data to kiosk 104. The LIDAR sensor may generate data identifying multiple objects at one time and may be able to generate data identifying objects of any size. For example, the LIDAR sensor may be pointed at a group of soccer players playing a soccer game. The LIDAR sensor may generate data associated with each soccer player and a soccer ball with which the soccer players are playing. A processor of kiosk 104 may receive the data, identify each soccer player and/or the soccer ball as objects and keep track of them as they move. In some embodiments, the processor may receive data from the LIDAR sensor and keep track of a distance that each soccer player travels within a given time period. The processor may keep track of any number of soccer players, and/or a soccer ball within the time period.

In some embodiments, smart soccer goal 102 includes cameras (e.g., RGB cameras or CMYK cameras) (not shown) that can generate on-goal pictures and/or off-goal pictures. The cameras may periodically take pictures of their current visual field and transmit the pictures to the processor of kiosk 104 for processing. For example, smart soccer goal 102 may include RGB cameras that take on-goal pictures. The RGB cameras may take multiple pictures of a soccer ball as it crosses the goal line and send the pictures to the processor. The processor may receive the pictures and analyze the pictures to determine whether the ball was spinning around its center or spinning around an axis as the ball crossed a goal line. To do so, for example, the processor may identify a marking on the soccer ball and track the marking between pictures. If the marking remains in a same position relative to the soccer ball, the processor may determine that the ball is not spinning. If the marking moves, however, the processor may determine that the soccer ball is spinning. In another example, smart soccer goal 102 may include RGB cameras that take off-goal pictures. The cameras may take pictures of soccer players as they are playing a soccer game. For example, the cameras may take multiple pictures of a player as the player is kicking a soccer ball. The cameras may transmit the pictures to the processor which can use object recognition techniques, as described below, to determine that the player is kicking the soccer ball and, in some instances, the foot with which the player is kicking it.

Kiosk 104 may be a unit that can store electronic equipment 107 that operates the equipment of smart soccer goal 102, described in detail below. For example, kiosk 104 may be able to store a processing circuit and various power banks to control and power LED net 122 and sensors (e.g., 118 and 120) of smart soccer goal 102. The processing circuit may be able to receive and process data from the sensors. Based on the received data and/or various other stored data, the processing circuit may generate control signals to control which LEDs of LED net 122 light up. For example, the processing circuit may receive position data from sensor 120 indicating that a soccer ball passed over the goal line. The processing circuit may identify a pattern of lights that corresponds to the soccer ball passing over the goal line (e.g., a pattern of lights that light up to show a phrase such as "GOAL") and send control signals to LED net 122 to light up the LEDs of LED net 122 according to the identified pattern. The processing circuit may also perform other functions such as generating direction, velocity, angle, and/or timing control signals to send to a field launcher to launch soccer balls at a position on a field; generating audio signals to send to audio devices to play sound; generating control signals to send to spotlights to control a direction and a light intensity of the spotlights; etc.

Sensors 118 and 120 may be coupled to electronic equipment 107 so sensors 118 and 120 may generate and transmit data to kiosk 104. For example, sensors 118 and 120 may generate data associated with a position of a soccer ball on a field or within smart soccer goal 102 and transmit the soccer ball position data to kiosk 104 for processing. Sensors 118 and 120 may be coupled to kiosk 104 wirelessly over a network or through a wired connection. In some embodiments, sensors 118 and 120 may transmit the data to a gateway (e.g., a router) (not shown) which can receive the data, format the data into a computer-readable format, and send the data to electronic equipment 107.

Figure 2:
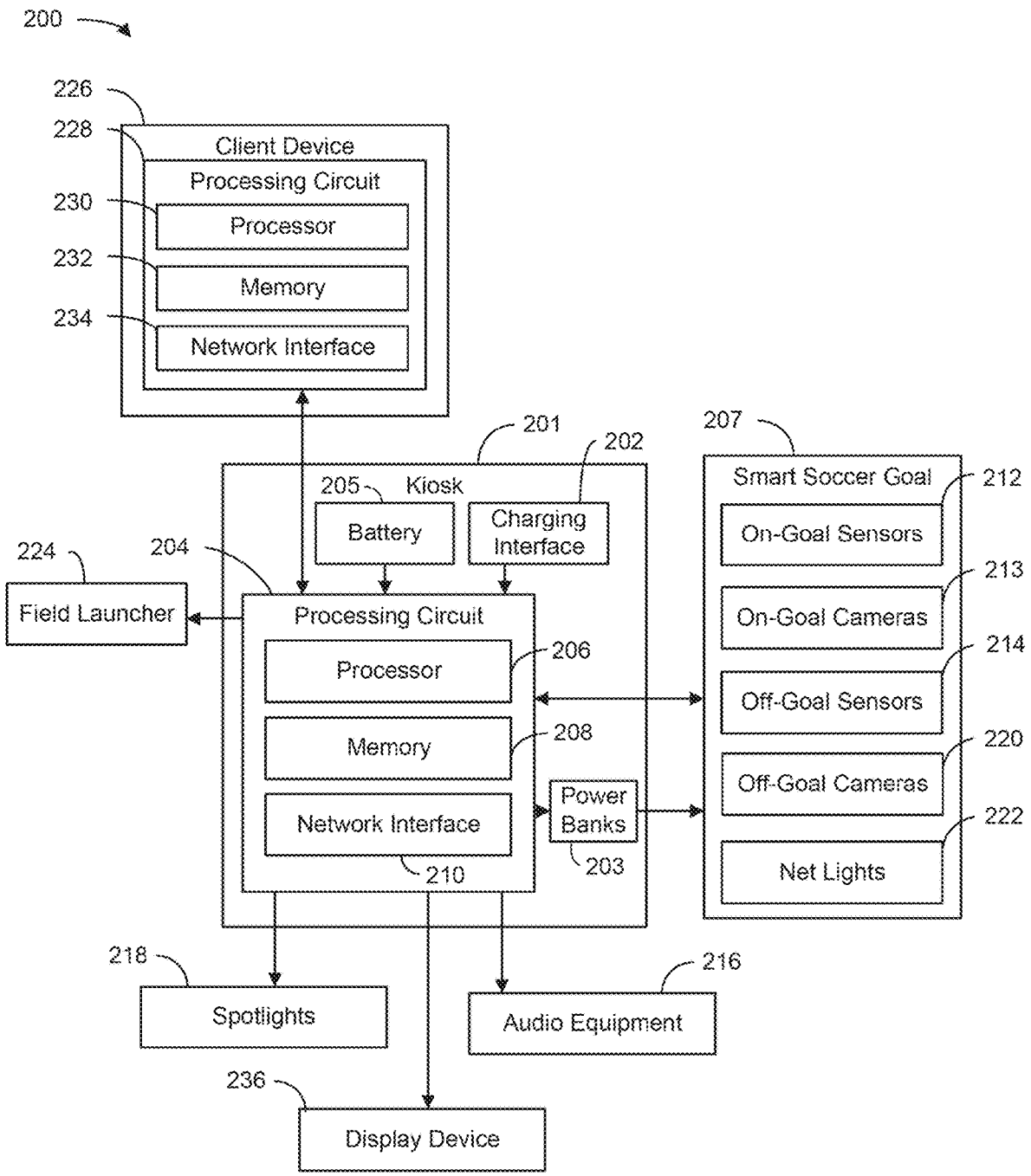
FIG. 2 is a block diagram of a smart soccer goal system, in accordance with some embodiments of the present disclosure.

Referring now to FIG. 2, a block diagram of a smart soccer goal system 200 is shown, in accordance with some embodiments of the present disclosure. Smart soccer goal system 200 may be similar to smart soccer goal system 100, shown and described with reference to FIG. 1, in some embodiments. Smart soccer goal system 200 is shown to include a kiosk 201, a smart soccer goal 207, audio equipment 216, display device 236, spotlights 218, field launcher 224, and a client device 226. Smart soccer goal 207 may be similar to smart soccer goal 102, shown and described with reference to FIG. 1. Smart soccer goal 207 is shown to include on-goal sensors 212, net lights 222, on-goal cameras 213, and off-goal sensors 214, in some embodiments. Kiosk 201 is shown to include a charging interface 202, power banks 203, a processing circuit 204, and a battery 205. Processing circuit 204 of kiosk 201 may receive sensor data from on-goal sensors 212, off-goal cameras 220, on-goal cameras 213, and/or off-goal sensors 214. Processing circuit 204 may use such data to control net lights 222, audio equipment 216, spotlights 218, and field launcher 224. Processing circuit 204 may also use the sensor data to generate a display to be displayed at display device 236 and/or transmit the data to client device 226 to be displayed at a user interface.

Battery 205 may be used to power the components of kiosk 201. Battery 205 may represent any power source that can provide power to the components of kiosk 201.

Examples of power sources include, but are not limited to, wall plug-ins, lithium batteries, rechargeable batteries, etc. For example, battery 205 may be a rechargeable battery. To charge battery 205, an operator may connect kiosk 201 to a wall outlet via charging interface 202. Once battery 205 has finished charging, the operator may disconnect kiosk 201 from the wall outlet and operate kiosk 201 with the power stored in the rechargeable battery. The operator may disconnect kiosk 201 from the wall outlet at any time to operate kiosk 201. In some cases, the operator may operate kiosk 201 while it is connected to the wall outlet. Battery 205 may provide power to processing circuit 204 so processing circuit 204 may operate to control the devices of smart soccer goal system 200.

Power banks 203 may include one or more power banks that can store energy to power various sections of lights of net lights 222 and, in some cases, other components of smart soccer goal 207. Each power bank of the one or more power banks may be dedicated to a section of net lights 222. For example, one power bank may provide power to a bottom section of net lights 222 while another power bank may provide power to a top section of net lights 222. In some embodiments, power banks 203 may act as a rechargeable battery and be charged through charging interface 202. Processing circuit 204 may control power banks 203 so an individual or groups of power banks 203 are not continuously providing power to net lights 222. For example, if no one is using smart soccer goal system 200, processing circuit 204 may send a control signal to power banks 203 indicating for power banks 203 to stop providing power to net lights 222.

As shown in FIG. 2, processing circuit 204 includes a processor 206, memory 208, and a communication device (e.g., a receiver, a transmitter, a transceiver, etc.), shown as network interface 210, in some embodiments. Processing circuit 204 may be implemented as a general-purpose processor, an application specific integrated circuit ("ASIC"), one or more field programmable gate arrays ("FPGAs"), a digital-signal-processor ("DSP"), circuits containing one or more processing components, circuitry for supporting a microprocessor, a group of processing components, or other suitable electronic processing components. Processor 206 may include an ASIC, one or more FPGAs, a DSP, circuits containing one or more processing components, circuitry for supporting a microprocessor, a group of processing components, or other suitable electronic processing components. In some embodiments, processor 206 may execute computer code stored in the memory 208 to facilitate the activities described herein. Memory 208 may be any volatile or non-volatile computer-readable storage medium capable of storing data or computer code relating to the activities. According to an exemplary embodiment, memory 208 may include computer code modules (e.g., executable code, object code, firmware, source code, script code, machine code, etc.) for execution by processor 206.

In some embodiments, processing circuit 204 may selectively engage, selectively disengage, control, and/or otherwise communicate with other components of smart soccer goal system 200. For example, as shown in FIG. 2, network interface 210 may couple processing circuit 204 to on-goal sensors 212, net lights 222, off-goal cameras 220, audio equipment 216, spotlights 218, on-goal cameras 213, off-goal sensors 214, field launcher 224, and display device 236. In other embodiments, processing circuit 204 may be coupled to more or fewer components.

Processing circuit 204 may send signals to client device 226 and/or display device 236 to display a user interface on a display of client device 226 and/or a display of display device 236 via network interface 210. Network interface 210 may utilize various wired communication protocols and/or short-range wireless communication protocols (e.g., Bluetooth, near field communication ("NFC"), HDMI, RFID, ZigBee, Wi-Fi, etc.) to facilitate communication with the various components of smart soccer goal system 200. For example, processing circuit 204 may receive generated data signals from any of on-goal sensors 212, off-goal cameras 220, on-goal cameras 213, and/or off-goal sensors 214 via network interface 210. Network interface 210 may also communicate with net lights 222, audio equipment 216, spotlights 218, and field launcher 224 via network interface 210.

Processing circuit 204 may be configured to use data collected from on-goal sensors 212, off-goal cameras 220, on-goal cameras 213, and off-goal sensors 214 to track soccer players as they play soccer or otherwise move in front of smart soccer goal 207. In some embodiments, such sensors and/or cameras (e.g., a 360 degree camera or a LIDAR sensor) may be coupled to and/or communicate with other components such as a field launcher or robotic defenders. The sensors and/or cameras can be coupled to and/or communicate with any device. The data may be used by processing circuit 204 to perform various functions and enable objective analysis of the soccer players. The objective analysis may enable individualized training programs and feedback to the soccer players or their trainers. The data may also be used to provide real-time feedback to players through net lights 222 that may depict aspects of how each player is performing while the player plays soccer. For example, processing circuit 204 may aggregate data it receives from each of cameras 213 and 220 and sensors 212 and 222 to determine if a soccer player scored a goal on a shot. Processing circuit 204 may cause net lights 222 to light up in a pattern indicating whether the player scored and, in some cases, a speed at which the player hit the ball. In another example, processing circuit 204 may use the data to generate a spotlight pattern that simulates a speed and/or a path that a player took while performing a task or completing a drill. Spotlights 218 may shine a spotlight on the ground in the spotlight pattern at the simulated speed and/or path for players to follow.

In another example, processing circuit 204 may use the sensor data to determine a location on the ground or in 3D space at which to launch or 'pass' a soccer ball. Processing circuit 204 may determine the position based on data about a soccer player on the field. Processing circuit 204 may determine the location at which to launch the soccer ball using machine learning techniques. For example, processing circuit 204 may use characteristic data about a player along with the player's current location as an input into a machine learning model. The machine learning may use the inputs to predict a location to launch a soccer ball. The machine learning model may be trained using live data that is generated based on the performance and various characteristics of the soccer player and/or other soccer players as described below.

Processing circuit 204 may also determine individualized training programs for soccer players based on the objective data that is generated based on the sensors and cameras of smart soccer goal 207. Processing circuit 204 may determine the training programs using machine learning techniques. For example, characteristic data about a player may be used as an input to a machine learning model, which can use the data to predict a training program that will best train the player (e.g., train the player to improve on his or her biggest deficiencies). The machine learning model of processing circuit 204 may be trained using training data generated based on whether players improved under various training programs.

Finally, processing circuit 204 may use images of the sensor data to capture sequences of actions that various soccer players take while playing soccer or otherwise move around in front of smart soccer goal 207 to determine how the soccer players can change their form to be more efficient or otherwise improve their performance. Processing circuit 204 may compare images of the soccer players' forms against an example form and identify differences between the two. Processing circuit 204 may output the differences so the soccer players can identify the differences and adjust their form to be closer to the example form.

On-goal sensors 212 may be sensors coupled to a frame of smart soccer goal 207. As described above, on-goal sensors 212 may include active depth sensors that continuously output infrared light (or any other light) across the smart soccer goal 207. On-goal sensors 212 may be positioned around smart soccer goal 207 and point in any direction towards the area immediately in front of or between the goal line and the net of smart soccer goal 207. On-goal sensors 212 may detect reflections of the infrared or structured light when the infrared light contacts an object. A sensor of on-goal sensors 212 may determine a length of time it took to receive a reflection or diffraction pattern from the sensor output the infrared light. The sensor may send a signal to processing circuit 204 indicating the determined length of time. In some embodiments, on-goal sensors 212 may also detect a light intensity of the reflection. On-goal sensors 212 may generate sensor data indicating the intensity of the light of reflections and send it to processing circuit 204 for processing. On-goal sensors 212 may include any type of sensor. For example, on-goal sensors 212 may include electro-optical sensors such as photoconductive devices, photovoltaics, photodiodes, phototransistors, optical camera sensors, stereo optical sensors, etc. On-goal sensors 212 may also include magnetic position sensors such as Hall-effect sensors.

On-goal cameras 213 may be cameras coupled to the frame of smart soccer goal 207. On-goal cameras 213 may take pictures of the area inside of smart soccer goal 207. On-goal cameras 213 may include digital complementary metal oxide semiconductor (CMOS) RGB cameras, CMYK cameras, and/or any other type of camera. In some embodiments, on-goal cameras 213 may include a video recording. On-goal cameras 213 may be coupled to various positions on the frame of smart soccer goal 207. There can be any number of on-goal cameras 213 connected to the frame. In some embodiments, on-goal cameras 213 continuously take pictures of the area inside of smart soccer goal 207. Each of on-goal cameras 213 may transmit any pictures they take to processing circuit 204. In some embodiments, on-goal cameras 213 may only take pictures of the area inside smart soccer goal 207 when they receive an indication to do so from processing circuit 204. Processing circuit 204 may send the indication to on-goal cameras 213 upon receiving on-goal sensor data from on-goal sensors 212 indicating that a soccer ball has crossed a goal line of smart soccer goal 207. Processing circuit 204 may receive the on-goal data, determine the soccer ball has crossed the goal line, and transmit a signal to on-goal cameras 213 indicating to take pictures of the area.

In some embodiments, processing circuit 204 only transmits signals to cameras of on-goal cameras 213 that take pictures of the area at which the soccer ball is located or that are pointing in the direction of the area that the soccer ball crossed the goal line. For example, processing circuit 204 may receive on-goal sensor data indicating that a soccer ball crossed the goal line on the bottom left corner of smart soccer goal 207. Processing circuit 204 may only send a signal to cameras associated with (e.g., that take pictures of) the bottom left corner to take pictures. Such cameras may receive the signal, take pictures of the area, and transmit the pictures back to processing circuit 204. Consequently, processing circuit 204 may only need to process pictures from the portion of on-goal cameras 213 that take pictures of the soccer ball, improving the processing speed of processing circuit 204.

Off-goal sensors 214 may be sensors that are coupled to the frame of smart soccer goal 207 that generate data associated with the area outside of smart soccer goal 207. Off-goal sensors 214 may include depth sensors similar to the sensors of on-goal sensors 212. Off-goal sensors may generate data identifying object movement (e.g., soccer ball movement and/or soccer player movement) in front of smart soccer goal 207 and transmit the data to processing circuit 204 for processing. Off-goal sensors 214 may include one or more LIDAR sensors. Similar to the depth sensors described above, the LIDAR sensor may output infrared lights and receive a reflection from the output. The LIDAR sensor (or a processor associated with the LIDAR sensor) may determine a length of time it took to receive the reflection from the output along with a strength of the reflection. The LIDAR sensor may generate data and transmit the data to kiosk 201 for processing. While the LIDAR sensors may be pointed in any direction, in some embodiments, the LIDAR sensors may be pointed off-goal to provide data to kiosk 201 indicating locations of various objects within the visual range of the LIDAR sensor on a surface (e.g., a soccer field). The LIDAR sensors may be able to generate data indicating the movement of an object (e.g., a soccer player) and send the data to kiosk 201. The LIDAR sensor may generate data identifying multiple objects at one time and may be able to generate data identifying objects of any size. For example, the LIDAR sensor may be pointed at a group of soccer players playing a soccer game. The LIDAR sensor may generate data associated with each soccer player and a soccer ball with which the soccer players are playing. The data may be used by processing circuit 204 to generate a three-dimensional environment that can be used to track each soccer player and/or the soccer ball over time.

Net lights 222 of smart soccer goal 207 may be lights of a net of smart soccer goal 207. While the lights are described as LEDs herein, it should be noted that net lights 222 may include any type of lights. For example, the lights can incorporate various image generation technologies (e.g., a liquid crystal display (LCD), light-emitting diode (LED) including organic light-emitting diodes (OLED), projection system, cathode ray tube (CRT), etc.). Each light of net lights 222 may be controlled individually or in various subgroups by processing circuit 204. Consequently, net lights 222 may light up in various patterns that may be meaningful to an observer. For example, net lights 222 may light up to display various phrases such as "GOAL" or "TIME." In another example, net lights 222 may light up to display a target pattern at which a soccer player can shoot a soccer ball. Net lights 222 may light up to display any pattern. Each of net lights 222 may light up according to a control signal from processing circuit 204. In some embodiments, net lights 222 may light up in sequential light patterns. For example, a portion of net lights 222 may continuously flash to indicate an event occurred such as a scored goal. In another example, net lights 222 may light up to display a person's name or a soccer player's number sliding across the net of smart soccer goal 207. Net lights 222 may also display a digital image or a video.

Audio equipment 216 may include various audio equipment such as speakers, boom boxes, headsets, sirens, microphones, amplifiers, etc. Audio equipment 216 may be coupled to smart soccer goal 207 or be a part of a facility in which smart soccer goal 207 is operating. Audio equipment 216 may play audio sound in response to a signal from processing circuit 204. In some instances, audio equipment 216 may play sound in response to sensor data that is generated based on a soccer event (e.g., a goal being scored). For example, during a soccer game, a player may score a goal on smart soccer goal 207. Off-goal sensors 214 and/or on-goal sensors 212 may generate data indicating that the goal was scored. Processing circuit 204 may receive the data and send a signal to audio equipment 216 to play a sound associated with a goal being scored (e.g., sound a siren). In some instances, processing circuit 204 may send a signal to net lights 222 to flash based on the goal being scored. Processing circuit 204 may send signals to both audio equipment 216 and net lights 222 to operate at the same time. In another example, processing circuit 204 may send a signal to audio equipment 216 and net lights 222 indicating that the game is over. Processing circuit 204 may send an associated signal to audio equipment 216 and/or net lights 222 to indicate that the game is over and/or to play the associated sound and/or light pattern, respectively.

Spotlights 218 may be lights that are associated with smart soccer goal 207 but are coupled to aspects of a facility (e.g., the roof of a training center). Spotlights 218 may include any number of spotlights. Spotlights 218 may shine lights down onto a field on which smart soccer goal 207 is positioned and/or where soccer players are playing games. Spotlights 218 may be capable of directional movement and thereby shine lights at different locations onto the field based on control signals they receive from processing circuit 204. Spotlights 218 may shine lights having various shapes or sizes (e.g., a soccer ball shape) over a field of the facility. In some embodiments, spotlights 218 may shine a circular light on the ground. The lights may be of any size or shape. In some embodiments, spotlights 218 may shine their lights according to a pattern specified by processing circuit 204. For example, processing circuit 204 may process a training program that calls for spotlights 218 to point lights to positions on the field for players to follow. The players may follow the spotlight and, once the players reach the spotlight, processing circuit 204 may move the spotlight to another location. Processing circuit 204 may determine when the players reach the spotlight by processing off-goal sensor data and determine the positions of the player as they move. In another example, spotlights 218 may shine a spotlight on locations at which field launcher 224 may launch a soccer ball, as described below. Consequently, players may know where to move to receive the soccer balls.

Field launcher 224 may be a device that launches soccer balls onto a soccer field. Field launcher 224 may be in communication with processing circuit 204 so field launcher 224 may launch soccer balls upon receipt of a signal from processing circuit 204. Processing circuit 204 may send a control signal to field launcher 224 to launch a soccer ball at a specific location. The control signal may include a launch direction, a launch speed, and/or a launch angle, in some embodiments. In some embodiments, the control signal may indicate multiple locations to launch soccer balls. Field launcher 224 may receive the control signal and launch a soccer ball accordingly. In some embodiments, field launcher 224 may store multiple soccer balls so field launcher 224 may launch multiple balls before a user has to reload it.

Display device 236 may be a display device, such as a scoreboard, that is coupled to processing circuit 204. Display device 236 may provide a display based on audio and/or visual data that processing circuit 204 provides. Processing circuit 204 may automatically update display device 236 based on sensor data that processing circuit 204 receives from sensors 212 and 214 and/or cameras 213 and 220. For example, processing circuit 204 may determine that a player scored a goal in smart soccer goal 207. Based on off-goal and/or on-goal sensor data that are generated, processing circuit 204 may identify the soccer player that scored the goal, the team of the soccer player, and a new score to the game (e.g., by incrementing and maintaining a counter associated with the team that scored). Accordingly, processing circuit 204 may update the display of display device 236 to indicate which team scored the goal. In some embodiments, processing circuit 204 may cause the goal scorer's name to appear on the display and a light pattern to appear on net lights 222. For example, the goal scorer's name may flash across the lights of net lights 222 upon scoring the goal. Finally, processing circuit 204 may send a signal to audio equipment 216 to indicate for audio equipment 216 to play a goal scoring sound. In some embodiments, processing circuit 204 may send a signal to an audio equipment to play the goal scorer's name via speakers.

Client device 226 may be a user device that can communicate with processing circuit 204. Client device 226 may include any type or form of media device or computing device, including a desktop computer, laptop computer, portable computer, tablet computer, wearable computer, embedded computer, smart television, set top box, console, Internet of Things (IoT) device or smart appliance, or any other type and form of computing device. Client devices and intermediary modulator may receive media streams via any appropriate network, including local area networks (LANs), wide area networks (WANs) such as the Internet, satellite networks, cable networks, broadband networks, fiber optic networks, microwave networks, cellular networks, wireless networks, or any combination of these or other such networks. In many implementations, the networks may include a plurality of subnetworks which may be of the same or different types, and may include a plurality of additional devices (not illustrated), including gateways, modems, firewalls, routers, switches, etc.

Client device 226 may include a processing circuit 228. Processing circuit 228 may include a processor 230, memory 232, and a network interface 234. Processing circuit 228, processor 230, memory 232, and network interface 234 may be similar to processing circuit 204, processor 206, memory 208, and network interface 210, respectively. In some embodiments, client device 226 may display the data that processing circuit 204 collects and aggregates. For example, processing circuit 204 may generate a player profile for a player based on on-goal and off-goal data that processing circuit 204 collected. Processing circuit 204 may generate values for characteristics of the profile using the data. For example, processing circuit 204 may generate an average accuracy, kick power, top speed, distance traveled, and overall score for a player and associate the data with a player profile. The player profile may include a picture of the player. Processing circuit 204 may transmit the player profile including the associated data to client device 226 to be displayed in a user interface. Client device 226 may display the player profile to the player, a trainer, or anyone that has access to client device 226.

Figure 3:
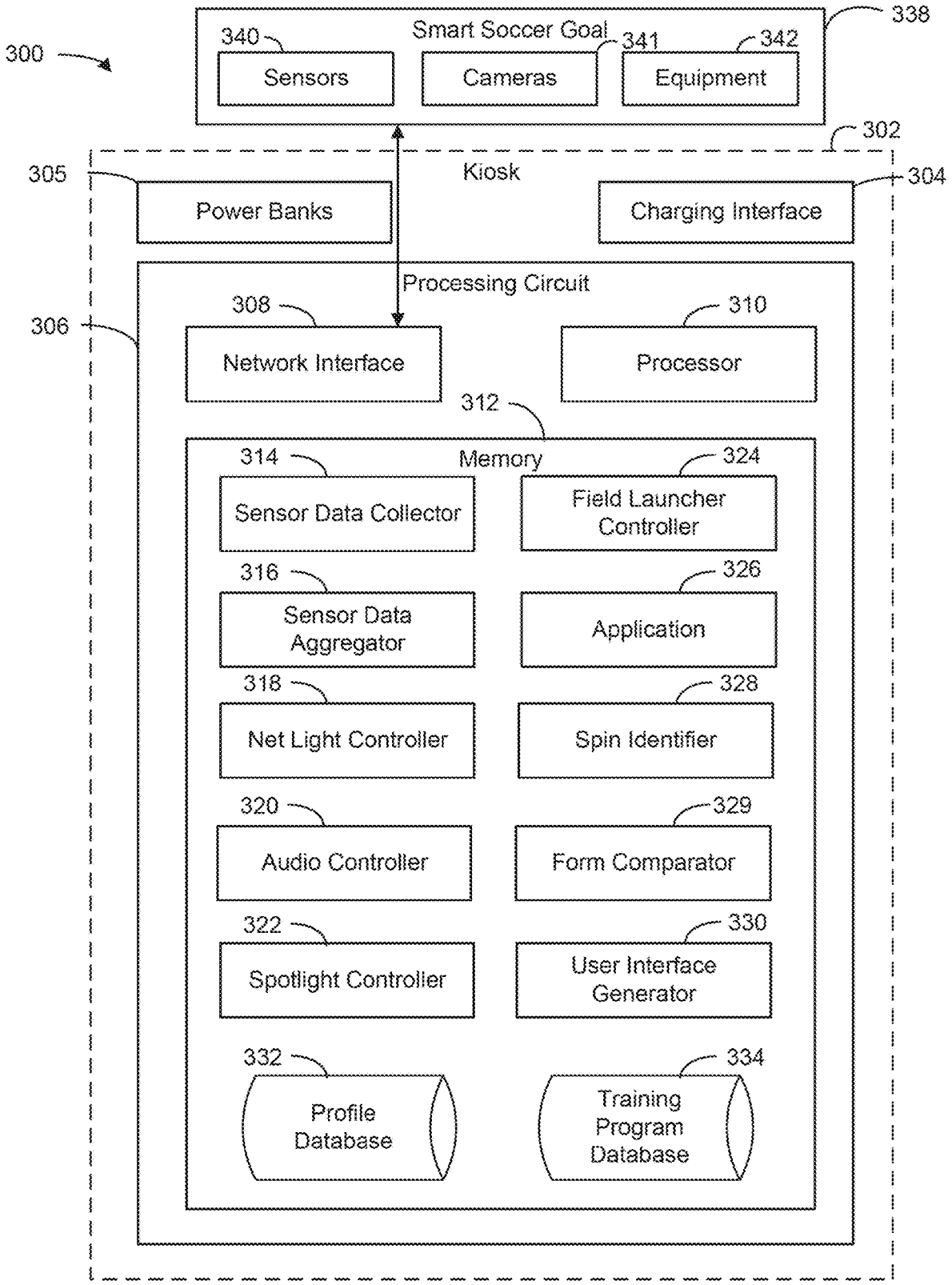
FIG. 3 is a block diagram of a smart soccer environment, in accordance with some embodiments of the present disclosure.

Referring now to FIG. 3, a detailed block diagram of a smart soccer environment 300 is shown, in accordance with some embodiments of the present disclosure. Smart soccer environment 300 is shown to include kiosk 302 and smart soccer goal 338. Smart soccer goal 338 may be similar to smart soccer goal 207, shown and described with reference to FIG. 2. Smart soccer goal is shown to include sensors 340, cameras 341, and equipment 342. Sensors 340 may include on-goal sensors and off-goal sensors, each described above. Cameras 341 may include on-goal cameras and off-goal cameras, each described above. Equipment 342 may include net lights (e.g., lights of an LED net) as described with reference to FIG. 2.

Kiosk 302 may be similar to kiosk 201, shown and described with reference to FIG. 2. Kiosk 302 is shown to include a charging interface 304, power banks 305, and processing circuit 306. Each of charging interface 304, power banks 305, and processing circuit 306 may be similar to charging interface 202, power banks 203, and processing circuit 204, respectively, shown and described with reference to FIG. 2. Processing circuit 306 is shown to include network interface 308, processor 310, and memory 312. Each of network interface 308, processor 310, and memory 312 may be similar to network interface 210, memory 208, and processor 206, respectively, shown and described with reference to FIG. 2. In some embodiments, processor 310 may include or may communicate with a co-processor, such as a tensor processing unit (TPU), that is solely dedicated to using machine learning techniques to determine individualized training programs for soccer players and/or locations for a field launcher (e.g., field launcher 224) to launch a soccer ball.

Each of the processes and services conducted by processing circuit 306 can also be conducted by a remote server and/or other similar components. Kiosk 302 may include remote servers (cloud), local servers (on-premises), or any combination thereof, that may perform the processes conducted by processing circuit 204.

Memory 312 may store any number of modules or programmed instructions executed by one or more servers or processors that can operate together to trigger light displays on a net of smart soccer goal 338, generate and update player profiles, dynamically generate and update training programs for individual soccer players, control an audio system, control a field launcher that serves soccer balls to soccer player, control spotlights, and/or generate a user interface for players and observers to view. Memory 312 is shown to include a sensor data collector 314, a sensor data aggregator 316, a net light controller 318, an audio controller 320, a spotlight controller 322, a field launcher controller 324, an application 326, a spin identifier 328, a form comparator 329, a user interface generator 330, a profile database 332, and a training program database 334, in some embodiments. Memory 312 may include any number of components. Components 314-336 may perform their functions based on data that processing circuit 306 collects from sensors 340 of smart soccer goal 338. More or less components may perform the functions described herein.

Memory 312 is shown to include sensor data collector 314. Sensor data collector 314 may be programmed instructions executed by one or more servers or processors. Sensor data collector 314 can collect sensor data from the on-goal and/or off-goal sensors of sensors 340 and/or image data (e.g., pictures and/or videos) from the on-goal and/or off-goal cameras of cameras 341. Sensor data collector 314 may collect the sensor data and/or image data in real-time or asynchronously as the sensor data and/or image data is generated and/or transmitted by sensors 340 and/or cameras 341, respectively. In some embodiments, sensor data collector 314 may collect the sensor data and/or image data from a local gateway (not shown) that receives sensor data and/or image data from sensors 340 and/or cameras 341, format the sensor data and/or image data into a computer-readable format, and transmit the data to kiosk 302 for processing.

Sensor data may include any type of data that sensors 340 generate. Sensor data may also include depth data generated by depth sensors of sensors 340, force data generated by force sensors of sensors 340, and LIDAR data generated by one or more LIDAR sensors of sensors 340. Sensor data may include any type of data generated by any type of sensor. In some embodiments, sensor data may include on-goal sensor data that is generated by sensors that generate data related to object movement in an area between a goal line and a net of smart soccer goal 338. Sensor data may also include off-goal sensor data that is generated by sensors that collect data related to object movement outside of smart soccer goal 338.

Similarly, image data may include any type of data that cameras 341 generate. For example, image data may include pictures or videos that are generated by cameras (e.g., depth sensors, RGB cameras, CMYK cameras, video recorders, etc.). Image data may include any type of data generated by any type of camera. In some embodiments, image data may include on-goal image data that is generated by cameras that take pictures or videos of the area between the goal line and the net of smart soccer goal 338. Image data may also include off-goal image data that is generated by cameras that take pictures or videos of an area outside of smart soccer goal 338.

Sensor data collector 314 may automatically collect sensor data and/or image data as sensors 340 and/or cameras 341 send the sensor data and/or image data to sensor data collector 314. In some embodiments, sensor data collector 314 may poll the sensors and/or cameras of sensors 340 and/or cameras 341 at periodic intervals to request data that the sensors and/or cameras generate. Sensor data collector 314 may poll any of sensors 340 and/or cameras 341 at any interval, such as but not limited to, every half second, every second, every minute, every five minutes, etc. Upon collecting the sensor data and/or image data, sensor data collector 314 may tag the data with one or more tags to indicate a type of data (e.g., pictures, LIDAR sensor data, depth sensor data, force sensor data, etc.), a device identifier identifying a device that generated the data, and/or a timestamp indicating the time that the data was collected or generated. In some embodiments, sensor data collector 314 may collect time series data including various pictures or values (e.g., depth values such as distance values and/or light intensity values) generated by sensors 340 and/or cameras 341 over time. Each picture or value may be associated with a timestamp.

In an example implementation, a group of soccer players may play soccer in front of smart soccer goal 338 and shoot at smart soccer goal 338. While they are playing soccer, cameras 341 may take pictures of the players and a ball with which they are playing and sensors 340 may generate data indicating locations of the players around the field at various times. Cameras 341 may also take pictures of the ball as it travels including when the ball travels across the goal line of smart soccer goal 338. Additionally, depth sensors of sensors 340 may generate position data of the soccer ball once it passes over the goal line indicating various positions of the ball over time as the ball travels to hit the net of smart soccer goal 338. Sensors 340 may transmit such data to kiosk 302, which can collect the data via sensor data collector 314. Once collected, sensor data collector 314 may store the data in profile database 332 and/or sensor data aggregator 316 may aggregate the data to determine characteristics about the players associated with the sensor data.

Memory 312 is shown to include sensor data aggregator 316. Sensor data aggregator 316 may be programmed instructions executed by one or more servers or processors. Sensor data aggregator 316 may generate objective characteristics or metrics about soccer players using off-goal and on-goal data that is generated by sensors 340. Examples of characteristics include, but are not limited to, top speed, total distance traveled, accuracy, kick power, agility, player level, etc. Sensor data aggregator 316 may determine values for each characteristic for various soccer players and associate the values with a player profile of the player. Sensor data aggregator 316 may store the determined values and player profiles in player profile database 332 as described below.

To determine a player's top, average or moment speed, sensor data aggregator 316 may obtain LIDAR sensor data associated with the player and track the player over various frames generated from the LIDAR sensor data. Sensor data aggregator 316 may generate a time-based three-dimensional environment that includes outlines of various soccer players playing soccer and a soccer ball as they move. The three-dimensional environment may be a map showing the outlines of various objects within the three-dimensional environment. The three-dimensional environment may also include segmentation or shadings associated with a type of object and that may be based on an distance or amount of reflectivity of the object. Consequently, the three-dimensional environment may depict the environment (e.g., a soccer field) from which the LIDAR sensor data was collected. Depending on the resolution of the LIDAR sensor, the LIDAR sensor data may show varying degrees of detail of the outlines of each individual player and the ball as they move.

Sensor data aggregator 316 may be configured to identify distances between various locations of the three-dimensional environment. Sensor data aggregator 316 may do so by identifying each location within a coordinate system having an x, y, and z axis of the three-dimensional environment and determining a distance between the locations in the coordinate system. Accordingly, as soccer players or soccer balls move within the three-dimensional environment, sensor data aggregator 316 can compare the locations of the soccer players or soccer balls with previous locations within the coordinate system to determine an amount that the players have moved from the previous locations. Sensor data aggregator 316 may determine the amount using various metrics such as inches, feet, meters, etc. Sensor data aggregator 316 may continuously compare the locations of the players with previous locations in a particular session to identify a total amount that a player moved in the session. In some embodiments, each location of the player or soccer ball may be presented in a frame that sensor data aggregator 316 generates based on LIDAR sensor data. Sensor data aggregator 316 may compare the frames to identify movements of the player. Each frame may be associated with a timestamp so sensor data aggregator 316 may determine amounts of movement over time for individual players.

Sensor data aggregator 316 may use the movement data as determined above to determine objective characteristics for players such as a total distance traveled and a top speed. For example, a LIDAR sensor may generate a three-dimensional environment associated with soccer players playing a soccer game. Sensor data aggregator 316 may identify positions of each soccer player over time within the three-dimensional environment. Sensor data aggregator 316 may track a distance that each player travels within the soccer game by continuously comparing the players' positions between frames of the same player. Once the players stop playing, sensor data aggregator 316 may determine a total distance traveled for each player and associate the total distances traveled with their respective player profiles. For example, for each player, data aggregator 316 may associate the total distance traveled with their player profile by aggregating the total distance traveled with other distances traveled in other sessions, averaging the total distance between sessions, adding the total distance traveled to a list of distances traveled in other sessions, etc.

To determine the top speed of players or any other object (e.g., soccer ball, a mobile defender device, etc.), sensor data aggregator 316 may keep track of the distances each player travels between frames and the differences in time between each frame. Sensor data aggregator 316 may determine a distance traveled between frames and a time that it took to travel the distance to determine a speed of the player. Sensor data aggregator 316 may determine when the players traveled the largest amount of distance within a set time period as determined by an administrator to determine a top speed for individual players. Sensor data aggregator 316 may associate determined top speeds with the player profiles of the players. For example, sensor data aggregator 316 may determine distance traveled data including locations of a player over time from LIDAR sensor data. Sensor data aggregator 316 may be configured to identify frames that include the soccer player and that are one second apart and the distance that the soccer player traveled between each set of frames. Sensor data aggregator 316 may identify the set of frames in which the soccer player traveled the largest amount of distance as being associated with the soccer player's top speed. Sensor data aggregator 316 may determine the soccer player's top speed based on the distance traveled in the identified set of frames. Sensor data aggregator 316 may associate the top speed with the soccer player's profile. For example, sensor data aggregator 316 may associate the top speed with the player profile by adding the top speed to a list of top speeds of the player that were determined based on previous sessions, averaging the top speed with other top speeds of the player, or through any other method. Sensor data aggregator 316 may store the top speed and the player profile in profile database 332. Sensor data aggregator 316 may perform similar functions to determine a speed of a soccer ball outside of smart soccer goal 338.

Sensor data aggregator 316 may also use on-goal sensor data to determine characteristics about a soccer player. Sensor data aggregator 316 may generate a three-dimensional environment including a three-dimensional coordinate system based on the locations of the depth sensors, depth data that the depth sensors capture, and the direction that the depth sensors point. In the three-dimensional environment, sensor data aggregator 316 may keep track of a soccer ball over time. Sensor data aggregator 316 may track the soccer ball over time based on the soccer ball's movement in the three-dimensional coordinate system. How sensor data aggregator 316 may generate the three-dimensional environment and track movement of the soccer ball over time within the goal using on-goal depth sensor data is described with further reference to U.S. Pat. No. 9,161,019, filed Sep. 10, 2013. U.S. Pat. No. 9,161,019 claims priority to U.S. Provisional Application No. 61/688,223, filed Sep. 10, 2012, the entirety of each of which is incorporated by reference herein.

Sensor data aggregator 316 may use the three-dimensional environment and movements of soccer balls within the three-dimensional environment to determine information about soccer balls as they travel within the goal between the goal line and the net. For example, sensor data aggregator 316 may determine how fast a soccer ball is traveling as it crosses the goal line of smart soccer goal 338. Sensor data aggregator 316 may do so by comparing locations of the soccer ball within the three-dimensional coordinate system at different times. Sensor data aggregator 316 may identify a location of a soccer ball over the goal line at one time and a second location of the soccer ball at another time. Sensor data aggregator 316 may compare the locations and times to determine a speed with which the ball was traveling. Sensor data aggregator 316 may associate the speed with a shot by a soccer player and associate the speed with a player profile of the soccer player. Sensor data aggregator 316 may associate the speed with a kick power of the player (e.g., sensor data aggregator 316 may determine that higher speeds are equivalent to higher kick powers in some cases).

Additionally, sensor data aggregator 316 may use the three-dimensional environment to determine values for an accuracy characteristic of a soccer player. Sensor data aggregator 316 may do so by determining a location of smart soccer goal 338 that a shot will hit based on a location and trajectory of the soccer ball within the three-dimensional environment. Sensor data aggregator 316 may determine a target location at which the soccer player was aiming and use the location and trajectory data to determine if the shot hit the target location. For example, net light controller 318 may cause a target to light up in the top right corner of smart soccer goal 338. Sensor data aggregator 316 may determine that a soccer ball crossed the goal line and hit the top right corner of smart soccer goal 338 based on location and trajectory data generated based on a three-dimensional environment. Consequently, sensor data aggregator 316 may update a player profile of the player to indicate that the player hit the target. Sensor data aggregator 316 may update the player profile by incrementing a counter for a number of shots on target, increasing an accuracy value of the player profile. Sensor data aggregator 316 may store the data indicating the hit target and the player profile in profile database 332.

In some embodiments, sensor data aggregator 316 may determine a distance and as such calculate the accuracy by which a soccer player missed or hit a target of a target light pattern. For example, a player may take a shot at smart soccer goal 338 and miss a target. Sensor data aggregator 316 may determine the location of the ball within the goal relative to the target. Sensor data aggregator 316 may determine the distance and path in three dimensional space between the location of the ball and the target. Net light controller 318 may cause the distance to be displayed in the net of smart soccer goal 338. Further, sensor data aggregator 316 may associate the shot and the distance with a player profile of the player that took a shot and store them in profile database 332.

Sensor data aggregator 316 may use off-goal data to identify various actions that players take. For example, sensor data aggregator 316 may obtain image data (e.g., pictures taken by various cameras such as RGB cameras) indicating that a player took a shot on goal. Sensor data aggregator 316 may determine that the player took the shot on goal using object recognition techniques on the image data. For example, sensor data aggregator 316 may obtain images of a player performing and identify features of the images from object recognition libraries such as a Tensorflow object detection API, Open Pose, mask R-CNN, RetinaNet, Faster R-CNN, RPN, Fast R-CNN, and R-FCN, etc., and optical character recognition libraries such as Microsoft cognitive services, Google cloud vision, AWS recognition, etc. Sensor data aggregator 316 can compare the features to a database (e.g., profile database 332) that has images tagged with actions. Sensor data aggregator 316 may determine a probability (e.g., 80%) of an action based on the comparison. If the probability exceeds a threshold (e.g., 75%) set by an administrator, sensor data aggregator 316 may determine that the image is associated with the action. Sensor data aggregator 316 can identify any number of actions from the image data.

Sensor data aggregator 316 may use both on-goal and off-goal data to determine whether a soccer player hit a target on a shot when taking the shot. For example, net light controller 318 may cause a target light pattern to appear on the net of smart soccer goal 338. Sensor data aggregator 316 may determine that a player hit a shot using object recognition techniques on off-goal sensor data as described above. Sensor data aggregator 316 may determine whether the soccer ball hit the goal by determining if the on-goal sensors detected the ball within the goal within a pre-determined time frame of the shot being taken (e.g., three seconds). If sensor data aggregator 316 determines the shot did not go into the goal within the timeframe, sensor data aggregator 316 may determine that the shot was a miss (e.g., it hit the post, missed the goal, or, in some cases, was saved by another player such as a goalkeeper). However, if sensor data aggregator 316 determines the ball went into the goal, sensor data aggregator 316 may determine whether the ball hit the target of the target light pattern. To do so, sensor data aggregator 316 may determine a location and/or a trajectory of the soccer ball and determine if the ball hit the target based on the location and/or trajectory. Sensor data aggregator 316 may also determine a speed of the shot. Net light generator 318 may cause a light pattern corresponding to whether the shot went in the goal/hit the target to light up on the net of smart soccer goal 338. The light pattern may also indicate a speed of the shot. Sensor data aggregator 316 may identify the speed and the accuracy of the shot and associate such information with a profile of the player (in some cases identified using object recognition techniques) that took the shot. Sensor data aggregator 316 may store the player profile and the information in profile database 332.

Memory 312 is shown to include profile database 332. Profile database 332 can be a dynamic database including a data structure such as a look-up table that stores sensor data such as data generated from the on-goal sensors, off-goal sensors, on-goal cameras, and off-goal cameras of sensors 340 and player profiles including characteristics of players generated based on the sensor data. In some instances, profile database 332 can include textual representations of visual objects (e.g., objects recognized in pictures). Profile database 332 can be a graph database, MySQL, Oracle, Microsoft SQL, PostgreSql, DB2, document store, search engine, key-value store, etc. Profile database 332 may hold any amount of data and can be made up of any number of components, in some embodiments. Profile database 332 may be a cloud database, a database stored locally at kiosk 302, or a combination of the two (e.g., profile database 332 may maintain data in a server in the cloud and a server local to smart soccer goal 338). Profile database 332 can store sensor data that is used to generate objective characteristics about soccer players that play soccer with smart soccer goal 338. For example profile database 332 may store off-field and on-field sensor data that can be used to determine a number of shots that a player takes, a number of misses, a number of misses, accuracy of shots on goal, spin and path or curve of ball, a total distance the player travels, a top speed, locations that the player travels over time, a speed of the soccer ball as it travels around the field and/or within the goal, etc. Profile database 332 can hold any amount of sensor data. Sensor data can be added or removed from profile database 332 at any time.

In some embodiments, instead of or in addition to storing/maintaining sensor data, profile database 332 may store or maintain player profiles of players that are associated with the sensor data. For example, processing circuit 306 may collect sensor data associated with a single player that is playing a target practice game with smart soccer goal 338. The sensor data may include a number of shots the player takes, a number of shots that went into the goal, a number of shots that missed the goal, a number of shots that hit a target within smart soccer goal 338. The sensor data may also include information about the ball such as how fast the ball traveled within the soccer goal when the player hit the ball into the goal. Additionally, the sensor data may include sensor data about the player's movements as the player played the target practice game such as locations of the player over time. Sensor data aggregator 316 may generate characteristic values such as accuracy, kick power, top speed, average speed, etc., about the player and associate the characteristic values with a player profile associated with the player. The characteristic values may be stored in profile database 332 with the player profile along with other data about the player such as a profile picture and sequences of images of the player performing various actions such as shooting a soccer ball. Each sequence may be tagged with a tag indicating the action. Each time the sensors 340 generate data about the player, sensor data aggregator 316 may update the player's profile according to the generated data. Any type of data may be associated with the player profile and/or stored in profile database 332.

Memory 312 is shown to include net light controller 318. Net light controller 318 may be programmed instructions executed by one or more servers or processors. Net light controller 318 may be configured to generate light patterns to display on net lights of equipment 342. Net light controller 318 may generate light patterns according to a game, application, or training program that processing circuit 306 is running. For example, net light controller 318 may generate light patterns based on a target practice application in which net light controller 318 displays targets at various locations on the net of smart soccer goal 338 for a player to shoot at. Net light controller 318 may display different target light patterns in response to sensor data aggregator 316 determining that the player took a shot. After a player shoots, net light controller 318 may cause words to appear in a light pattern indicating whether the shot hit a target and/or a speed of the shot. In some embodiments, the light patterns are stored in a database (not shown). Net light controller 318 may identify an event (e.g., a shot attempt) and compare the event to the database to determine the light pattern that corresponds to the event. Net light controller 318 may cause a matching light pattern to be displayed on the net of smart soccer goal 338. Net light controller 318 cause any light pattern to be displayed.

Memory 312 is shown to include audio controller 320. Audio controller 320 may be programmed instructions executed by one or more servers or processors. Audio controller 320 may be configured to generate an audio signal to transmit to audio equipment to play various sounds. Audio controller 320 may generate the audio signal based on events of a game or training sessions that occur. For example, if a player scores a goal, audio controller 320 may send a signal corresponding to a goal being scored to a microphone to play music associated with the goal being scored. In another example, a game may end and audio controller 320 may send a signal to a horn to play a loud sound indicating that the game is over. In some embodiments, audio controller 320 may generate audio data and transmit the audio data to a speaker or a microphone to be played. Audio controller 320 may generate any signal and may cause sound to be played based on any event.

Memory 312 is shown to include spotlight controller 322. Spotlight controller 322 may be programmed instructions executed by one or more servers or processors. Spotlight controller 322 may be configured to generate spotlight patterns and send control signals to spotlights that cause spotlights to shine in the patterns. Spotlight patterns may include locations to which the spotlight may move, times at which the spotlight patterns may stay at one location, and speeds at which the spotlight may move to the locations. Spotlight patterns may be predetermined by an administrator. Spotlight patterns may be associated with a training program. For example, in one training program, a spotlight pattern may include a spotlight pattern that calls for a player to follow a spotlight as it moves around a field. The player may sprint around the field to try to catch (e.g., reach the same location location) the spotlight. In some embodiments, while the player is running trying to catch the spotlight, sensor data aggregator 316 may aggregate off-goal sensor data and determine when a player catches the spotlight. In response to determining that the player caught the spotlight, spotlight controller 322 may move the spotlight (e.g., to a next predetermined location). Such a training program may help soccer players with their speed and endurance.

In another example, spotlight controller 322 may generate a spotlight pattern that simulates another person's movements while performing a soccer drill. For example, a famous soccer player may perform a running drill or a soccer drill. Sensor data aggregator 316 may collect off-goal sensor data and track the movements and timing of the player completing the drill. Spotlight controller 322 may generate a spotlight pattern where a staging light or spotlight shines light simulating the location and speed of the famous soccer player. In some embodiments, a light imaging projector may be used to shine the light. Consequently, when another player desires to compare themselves to the famous soccer player, spotlight controller 322 may shine the light in a pattern that simulates movements of the famous soccer player while the other soccer player performs the same actions.

Memory 312 is shown to include field launcher controller 324. Field launcher controller 324 may be programmed instructions executed by one or more servers or processors. Field launcher controller 324 may be configured to send control signals to a field launcher (e.g., field launcher 224) to launch one or more soccer balls at locations around a field. Field launcher controller 324 may launch the soccer balls at various speeds and angles and may launch the soccer ball in any direction. Field launcher controller 324 may determine a direction, speed, and, in some cases, angle and/or time to launch soccer balls and send a control signal to the field launcher indicating such information. Field launcher controller 324 may determine the direction speed, angle, and time to launch the soccer balls based on an application or game that is being played by a soccer player on the field. For example, a soccer player may participate in a training program where the player needs to run to various locations on a soccer field, receive a ball from the field launcher, and shoot the ball at smart soccer goal 338. Field launcher controller 324 may send control signals to the field launcher according to the application to launch soccer balls at specific locations on the field. In some instances, spotlight controller 322 may shine a spotlight at the locations on the field to which field launcher controller 324 will shoot the ball so a soccer player may know where to run to receive the ball. In some cases, sensor data aggregator 316 may use off-goal and on-goal data to determine if the player receives and/or shoots the soccer ball that the field launcher launched. Upon determining that the player shot the ball, field launcher controller 324 may send another control signal to the field launcher indicating a new location to launch the soccer ball. In some embodiments, field launcher controller 324 may send control signals indicating multiple locations and times to launch soccer balls, regardless of if the player has shot a previously launched ball yet.

Memory 312 is shown to include application 326. Application 326 may be programmed instructions executed by one or more servers or processors. Application 326 may include one or more machine learning models that determine locations for a field launcher to launch a soccer ball and/or training programs to implement to best improve the skills of a soccer player. Each of the one or more machine learning models may be implemented as any of a neural network, random forest, a support vector machine, or any other machine learning model. As implemented, one machine learning model may be trained to predict locations for the field launcher to launch a soccer ball so a soccer player can reach it and, in some cases, improve their speed or endurance. The machine learning model may predict the locations based on characteristic data (e.g., top speed, distance traveled, kick power, accuracy, etc.) of the player to which the field launcher is launching the ball. The machine learning model may receive any inputs. The machine learning model may be trained based on training data tagged with indications of whether soccer players successfully received or scored a goal with the ball that the field launcher launched. Application 326 may tag the data so the machine learning model may operate in a closed-loop environment without a need for outside intervention for training. Once the machine learning model of application 326 determines the location to launch the soccer ball, field launcher controller 324 may transmit a signal to the field launcher to launch the soccer ball according to the determined location. Application 326 may continuously generate training data for locations to launch the soccer ball so the machine learning model become more accurate at determining locations.

In some embodiments, the machine learning model may receive live indications of how soccer players are performing. For example, the machine learning model may obtain an indication that a player's top speed is decreasing because the player is getting tired. The machine learning model may obtain the indication by obtaining off-goal data indicating that the player is moving more slowly than usual. Such data or the determination may be used as an input into the machine learning model in addition to or instead of stored characteristics associated with the player to determine locations to launch the soccer ball. Advantageously, by using a machine learning model to determine the location to launch a soccer ball, the machine learning model may adapt in real-time to the changing conditions of the player. For example, the machine learning model may identify data indicating that a player is getting tired and predict a location that is slightly closer to the player that the player may reach but may still be a challenge. Further, the machine learning model may be trained based on success data so the machine learning model may automatically learn where to launch soccer balls that may be received by soccer players and become more accurate over time. Consequently, users may not need to manually select locations to launch soccer balls. More information about the machine learning model and how it is trained is described herein with reference to FIGS. 14 and 15.

In some embodiments, application 326 may include a second machine learning model that may be configured to generate training programs to best train soccer players. The second machine learning model may predict the training programs based on characteristic data (e.g., top speed, distance traveled, kick power, accuracy, etc.) of a player for which the second machine learning model is generating the program. The machine learning model may be trained based on training data tagged with indications of whether the training program was successful. Application 326 may generate the training data by comparing characteristics of a player before and after the player performed under a training program and determine if the player improved, in some cases above a threshold. If application 326 determines that the player improved, application 326 may tag a data set including characteristics with the training program that caused the player to improve and supply the tagged data to the second machine learning model for training. In some instances, if the player did not improve, application 326 may not tag the data set or use it for training. Consequently, the second machine learning model may operate in a closed-loop environment without a need for outside intervention for training. Once the second machine learning model of application 326 predicts a training program, user interface generator 330 may transmit the predicted training program to a client device to be viewed by a soccer player or a trainer for training.

In some embodiments, application 326 may obtain live indications of how soccer players are performing under a predicted training program. For example, application 326 may obtain off-goal and on-goal data indicating that a player is getting worse over the course of performing a predicted training program. For instance, application 326 may determine that the top speed and accuracy of the player is going down while implementing a training program that is supposed to cause such characteristics to go up. Application 326 can automatically determine that the player is not improving and supply an indication to the second machine learning model indicating that the second player is getting worse along with updated characteristics of the player. The second machine learning model may receive the indication and the updated characteristics and use tuned weights and/or parameters to predict a new training program for the player. The second machine learning model may use any inputs. Advantageously, by using a machine learning model to determine training programs to train a soccer player, the machine learning model may adapt in real-time to the changing conditions of the player and automatically adjust if a training program is not working as intended. For example, application 326 may identify data indicating that a player is not improving or is improving slower than expected. Application 326 may supply this identification and/or characteristics of the player to the second machine learning model to predict a new training program for the player.

Further, the machine learning model may be trained based on success data so the machine learning model may automatically learn which training programs to implement and become more accurate over time. Consequently, users may not need to manually select training programs for soccer players and the training programs may be more accurate than if the training programs were manually selected. Further, because the training programs are selected based on objective performance data of players instead of subjective data, the second machine learning model may more accurately predict which training programs to apply without any subjective bias. More information about the second machine learning model and how it is trained is described herein with reference to FIGS. 18 and 19.

Memory 312 is shown to include training program database 334. Training program database 3324 can be a dynamic database including a data structure such as a look-up table that stores training programs that may be implemented by kiosk 302 or soccer players to improve the performance of the soccer players. Training program database 334 can be a graph database, MySQL, Oracle, Microsoft SQL, PostgreSql, DB2, document store, search engine, key-value store, etc. Training program database 334 may hold any amount of data and can be made up of any number of components, in some embodiments. Training program database 334 may be a cloud database, a database stored locally at kiosk 302, or a combination of the two (e.g., Training program database 334 may maintain data in a server in the cloud in a server local to smart soccer goal 338). Training program database 334 may store any type of training program. The training programs may be daily programs or training programs that are meant to be performed over long periods of time such as weeks or months. Training program database 334 may store training programs that only include instructions for a player to perform on their own time such as a workout routine requiring various workout maneuvers or time periods of performing some action such as juggling a soccer ball. Such training programs may include text and/or pictures showing how to perform the maneuvers or actions. Training program database 334 can also store active training programs that involve smart soccer goal 338 and various components associated with smart soccer goal 338 (e.g., net lights, field launcher, spotlights, etc.). The active training programs may cause the components to perform some action such as launch a soccer ball at various locations on a soccer field for a player to retrieve and shoot or shine spotlights in a specific pattern for a player to follow. Each training program may be associated with improving one or more aspects of a player's characteristics (e.g., skills). Training program database 334 may store any amount and any type of training program. Such training programs may be retrieved and display at a user interface via user interface generator 330 to a soccer player or a soccer trainer to implement to train a soccer player.

Memory 312 is shown to include spin identifier 328. Spin identifier 328 may be programmed instructions executed by one or more servers or processors. Spin identifier 328 may be configured to identify whether a soccer ball is spinning or curving as the soccer ball travels within smart soccer goal 338. Spin identifier 328 may analyze on-goal data from sensors 340 to determine whether the soccer ball is spinning or curving. For example, spin identifier 328 may obtain image data of a soccer ball as it travels between the goal line and the net of smart soccer goal 338. Spin identifier 328 may identify a marking on the soccer ball in the image data. The marking can be any shape, size, or color and could be variably determined and identified by the image process programming. Spin identifier 328 may identify whether the marking moves relative to the soccer ball as the soccer ball travels into the net. If spin identifier 328 determines that the marking moves, spin identifier 328 may determine that the soccer ball is spinning. However, if spin identifier 328 determines that the marking does not move, spin identifier 328 may determine that the soccer ball was not spinning. In some embodiments, spin identifier 328 may determine an amount of movement for the soccer ball to determine an amount of spin that was put on the ball. Spin identifier 328 may associate the fact that the ball was spinning and, in some cases, the amount of spin with a player profile of the player that hit the ball into smart soccer goal 338 and store the spinning information and the player profile in profile database 332.

In some embodiments, spin identifier 328 may determine whether the soccer ball was curving in three dimensional space. Spin identifier 328 may do so based on a change in trajectory of the soccer ball as the balls travels over the goal line and the net. For example, using on-goal data, spin identifier 328 may determine a trajectory of a soccer ball as it travels into the net of smart soccer goal 338. The trajectory may be a tangent of the ball's movement path and indicate a location that the ball is heading towards unless it curves in some manner. Spin identifier 328 may determine the trajectory of the soccer ball at multiple instances in time. Spin identifier 328 may compare the trajectory between instances in time and, in some instances, identify any changes in trajectory as the ball travels. The change in trajectory may be an amount of curve that the ball has. Spin identifier 328 may identify the amount of curve of various shots on smart soccer goal 338 and associate them with the player profiles of players that took the shots. Spin identifier 328 may store the curve and the player profiles in profile database 332.

Memory 312 is shown to include form comparator 329. Form comparator 329 may be programmed instructions executed by one or more servers or processors. Form comparator 329 may obtain image information from off-goal sensors of sensors 340 of players or people as they perform various actions. The image information may include depth sensor data collected from sensors 340 and/or other depth sensors not coupled to smart soccer goal 338 and/or pictures collected from cameras of sensors 340 and/or other cameras. As described above, form comparator 329 may identify sequential pictures that depict sequences of various actions performed by soccer players and the actions associated with the sequential pictures using object recognition techniques. In some instances, the sequence of pictures may already be tagged and stored in player profile database 332. In such instances, form comparator 329 may retrieve the sequences and identify actions associated with the sequences according to the tags. In some embodiments, form comparator 329 may receive an input from an administrator indicating actions with which a sequence is associated.

Once form comparator 329 identifies a sequence and an action associated with the sequence, form comparator 329 may identify a model sequence that illustrates a "correct" form to perform the action. For example, a model sequence may be performed by a professional athlete or a coach over the course of a game or while modeling. One or more cameras or depth sensors may generate image data such as depth data or pictures of the model sequence. The model sequences may be stored in profile database 332 or any database. Form comparator 329 may identify an action of a player from a sequence of image data, retrieve a model sequence that shows the correct form for the action, and compare the action of the player with the correct form for the action. Form comparator 329 may compare the forms together and identify differences between the player's form and the model form. In some embodiments, form comparator 329 may generate a side-by-side video comparison of the two forms so a player can see adjustments to make to perfect his or her form. In some embodiments, form comparator 329 may identify differences in movements, such as differences in locations of body parts, when performing the action and indicate the differences to the player. For example, form comparator 329 may determine a difference in how far a player bends his or her knee when passing a soccer ball from a player or coach that performed a model sequence. Form comparator 329 may display the difference to the player or a trainer for training so the player can try to emulate the model form. Form comparator 329 may compare forms and determine differences for any actions.

Memory 312 is shown to include user interface generator 330. User interface generator 330 may be programmed instructions executed by one or more servers or processors. User interface generator 330 may be configured to generate user interfaces to display various information about soccer players' profiles such as their characteristics. User interface generator 330 may transmit such user interfaces to a client device (e.g., client device 226, shown and described with reference to FIG. 2) for a soccer player or a trainer to view. In some embodiments, user interface generator 330 may generate a user interface based on whether the user interface will be viewed by a trainer or a soccer player. For example, a user interface for a trainer may include information about which training programs to implement so a player may most improve along with characteristics of the player. A user interface for a player may show a player card for the player indicating characteristics of the player and how the player is performing. User interface generator 330 may determine which user interface to generate based on the account that requests the user profile. Accounts may be labeled as trainer or soccer player. User interface generator 330 may identify the label of an account requesting a user interface and generate a corresponding user interface to transmit to a requesting device. User interface generator 330 may include any type of information on user interfaces for both trainers and soccer players.

Figure 4:
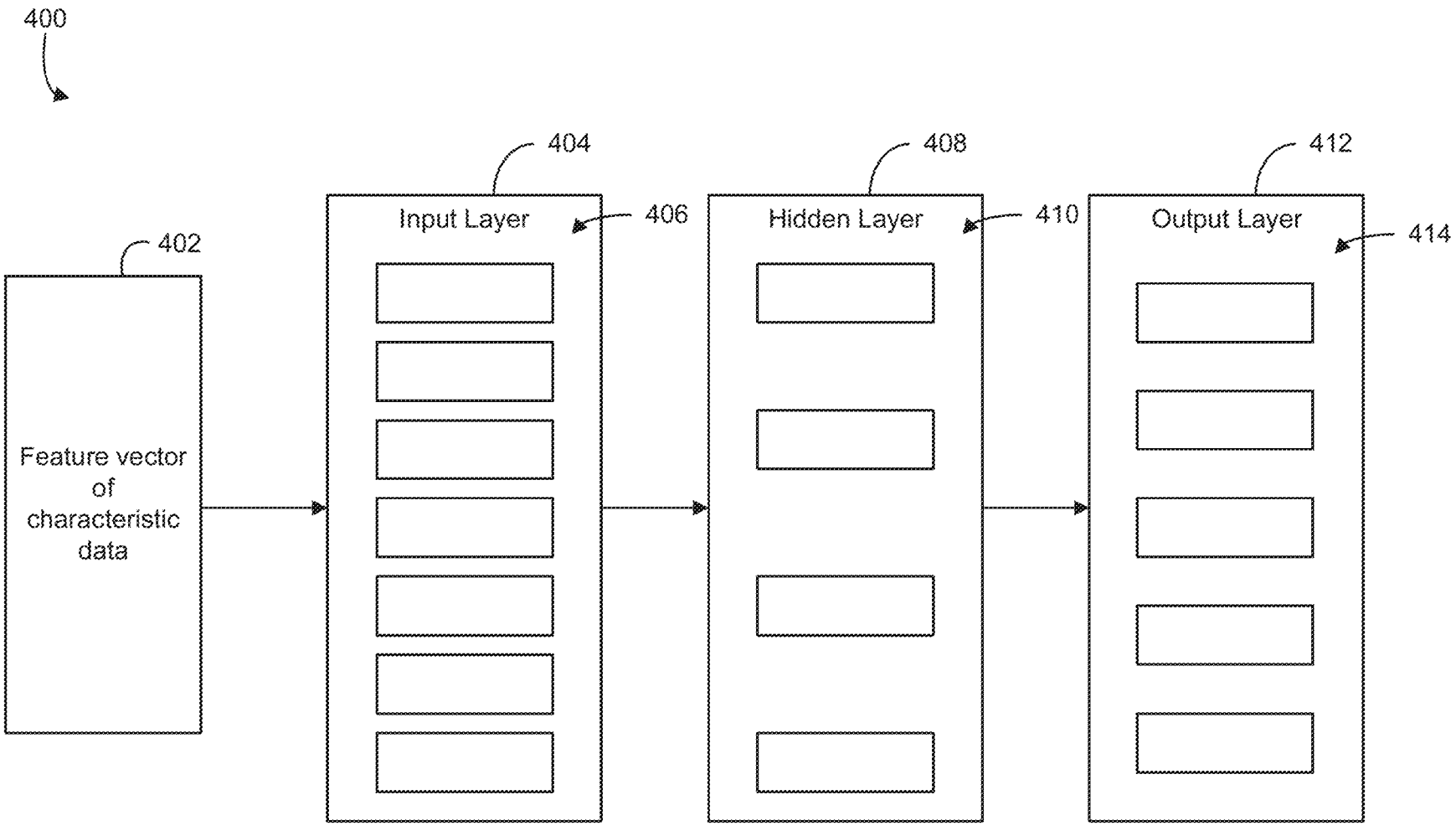
FIG. 4 is drawing of a neural network for automatically generating training programs, in accordance with some embodiments of the present disclosure.

Referring now to FIG. 4, a drawing of a neural network 400 for automatically generating training programs for a smart soccer goal system is shown, in accordance with some embodiments of the present disclosure. Neural network 400 may be an example implementation of a machine learning model of application 326, shown and described with reference to FIG. 3. Neural network 400 is shown to include a feature vector 402, an input layer 404, a hidden layer 408, and an output layer 412. Feature vector 402 may include on-goal and off-goal sensor data and/or characteristic data that was generated based off of the performance and movements of a soccer player playing a soccer game or training with a smart soccer goal (e.g., smart soccer goal 102, shown and described with reference to FIG. 1). Feature vector 402 may include the values of characteristics that the data processing system determines based off of the on-goal and off-goal sensor data that the data processing system collects. For example, feature vector 402 may include values for accuracy, kick power, sprint speed, distance traveled, etc. Nodes 410 of hidden layer 408 may perform various functions on the inputs of feature vector 402 and provide an output to output layer 412. Output layer 412 may include one or more output nodes 414 indicating training programs to implement to best improve the skills of the soccer player. Neural network 400 can include any number of components (e.g., any number of hidden layers, inputs nodes, output nodes, etc.).

The outputs of input layer 404 and the nodes of hidden layer 408 may be signals or combinations of signals of neural network 400. Each of the signals or combinations of signals may be associated with a weight. For example, an input signal associated with kick power may have a weight of 0.2 while an input signal associated with kick accuracy may have a weight of 0.7. The weights may indicate an importance of a particular input compared to other inputs. For example, inputs related to top speed may have a higher weight than inputs related to distance traveled. The signals of each input may have any weight. The weights may be tuned via training as described below.

Input layer 404 is shown to include input nodes 406. Input nodes 406 may be associated with the values of feature vector 402. Each input node can send a weighted signal to each node of hidden layer 408. The values of feature vector 402 can be values that were converted from their determined values into numerical values, binary code, matrices, vectors, etc. The values can be normalized into values between −1 and 1 using any technique so operations can be performed on the values by nodes 410 of hidden layer 408. The values can be normalized into any value range. After the values are normalized to values between −1 and 1, neural network 400 can transmit the values to nodes of hidden layer 408 as weighted signals.

Hidden layer 408 may be one or more layers of nodes that receive input signals or combinations of input signals from input layer 404. Nodes 410 of hidden layer 408 may perform one or more operations on the input signals or combinations of signals and provide signals or combinations of signals to output layer 412. While one hidden layer is shown, there may be any number of hidden layers. Nodes 410 of hidden layer 408 may provide output signals to nodes of other hidden layers (if there are multiple hidden layers) or to output layer 412. In some embodiments, the number of nodes or layers of hidden layer 408 may be correlated with the number of input nodes and/or the number of output nodes of neural network 400. Neural network 400 can perform activation operations, such as multiplication, a linear operation, sigmoid, hyperbolic tangent, or any other activation function, at each layer of hidden layer 408 on the values of the weighted signals that are associated with input nodes 406. Weighted signals or combinations of signals from hidden layer 408 can be sent to output layer 412.

Output layer 412 may be a layer of neural network 400 that is dedicated to providing probabilities for the proper training program to implement to best improve the performance of the soccer player associated with the data of feature vector 402. Each output node 414 may be associated with a different training program and a probability for the respective training program.

The weights associated with signals or combinations of signals that travel between input layer 404 and hidden layer 408 and then between hidden layer 408 and output layer 412 can be automatically determined based on training data provided by a user. The training data can include a set of numerical characteristics of a player indicating how the player performed in a drill/game or across multiple drills/games. The training data may also include labels for the numerical characteristics indicating training programs that could best help the player improve. For example, the training data may be an input-output pair. The input may be the characteristics of the player as the player performs and the output may be training programs that will best help the player improve. Neural network 400 can initially have randomized weights associated with each of its signals or combinations of signals, but after a sufficient amount of training data has been input into neural network 400, weights can be determined to a degree of certainty that an administrator may identify as sufficient to use neural network 400.

In some embodiments, a neural network similar to neural network 400 may be generated or trained to determine locations to launch soccer balls for a player that is training. Described in greater detail below with reference to FIGS. 15 and 16, the neural network may receive a feature vector including characteristics of a soccer player indicating the capabilities of the soccer player. The neural network may use tuned weights and/or parameters to determine locations to launch a soccer ball so a player may be able to run to the location, receive the ball, and shoot it at a target. The neural network may do so based at least on a top speed and an endurance level of the player to which the field launcher is launching the soccer ball. The neural network may be trained based on data indicating whether the soccer player was able to get to a launched ball and/or score a goal with it. A training data set may be generated with the characteristics that caused the field launcher to launch a soccer ball tagged with a corresponding location at which soccer players successfully received and/or scored a goal with it. Consequently, the neural network may be continuously trained with live data and become more accurate at identifying locations to launch a soccer ball over time.

Figure 5:
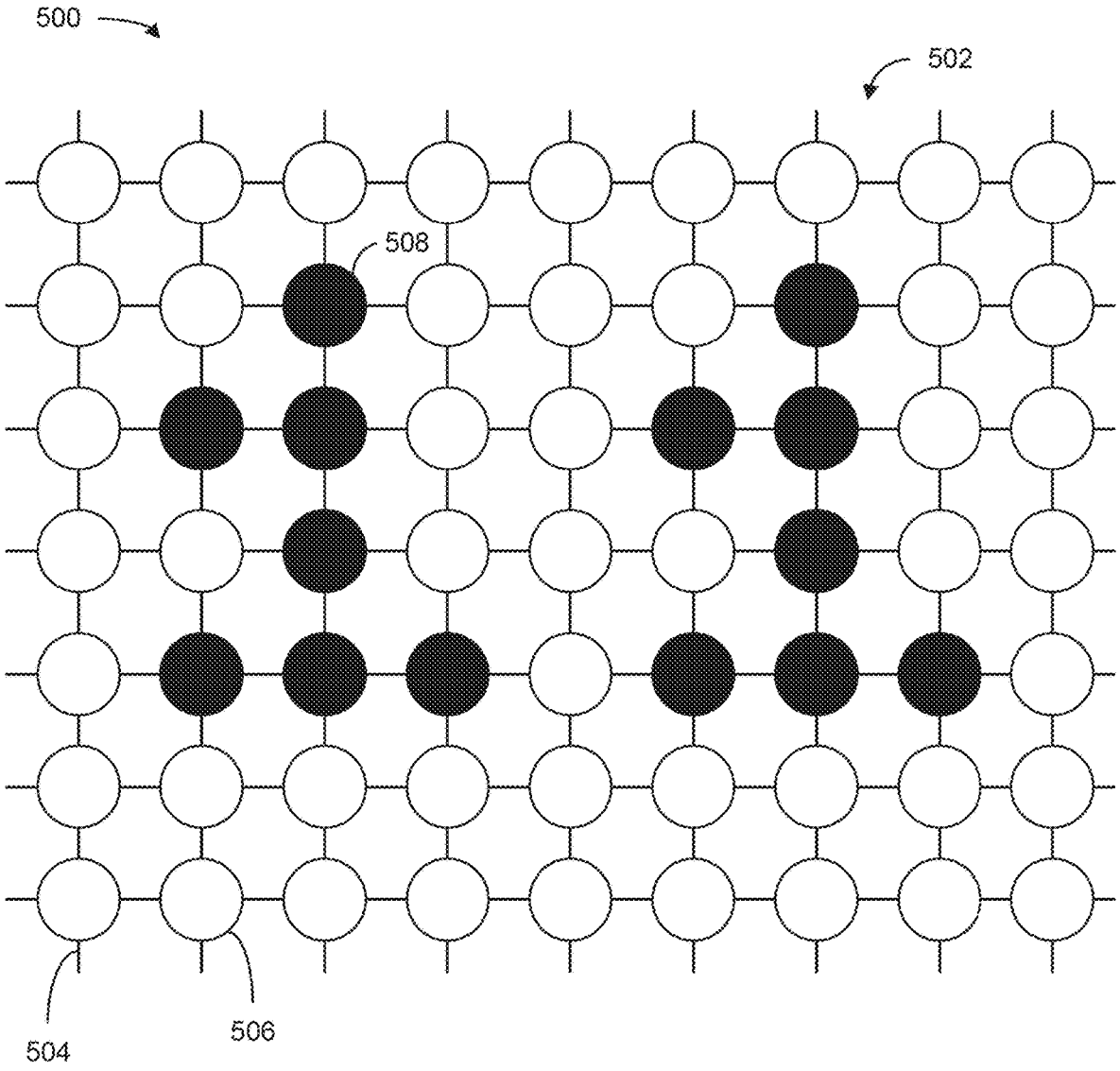
FIG. 5 is a drawing of an example display of an LED net of the smart soccer goal of FIG. 1, in accordance with some embodiments of the present disclosure.

Referring now to FIG. 5, a drawing of an example display of an LED net 500 is shown, in accordance with some embodiments of the present disclosure. LED net 500 may be similar to LED net 122, shown and described with reference to FIG. 1. LED net 500 is shown to include a set of netting strands such as netting strand 504. The netting strands may include materials such as rope, plastic, metal, string, or any other material. As shown, the netting strands may be interwoven so each netting strand crosses one or more other netting strands. LEDs, such as example LEDs 506 and 508, may be coupled to the netting strands. LED 506 may be an example unlit LED while LED 508 may be an example lit LED. As shown, the LED may be coupled to the netting strands at the intersections between the netting strands. However, the LEDs may be coupled to the netting strands at any location and in any pattern. Techniques may include specialized forms for rugged LED constructions for high load impact. It should be noted that the LEDs are merely examples of lights, any type of light may be coupled to the netting strands of LED net 500.

The LEDS of LED net 500 may be lit up in a specific pattern in a display 502 that may be meaningful to an observer. For example, as shown in FIG. 5, LEDs of LED net 500 may light up to display the number "11." The LEDs of LED net 500 may light up to display any pattern. The LEDs may light up based on signals that LED net 500 receives from a processing circuit (e.g., processing circuit 306, shown and described with reference to FIG. 3). In some embodiments, the processing circuit may light up LEDs in sequential patterns. For example, the processing circuit may cause the LEDs to display a pattern illustrating the word "GOAL" followed by a name of the player who scored the goal. In some instances, the processing circuit may cause the LEDs to light up to display a movie.

Figure 6:
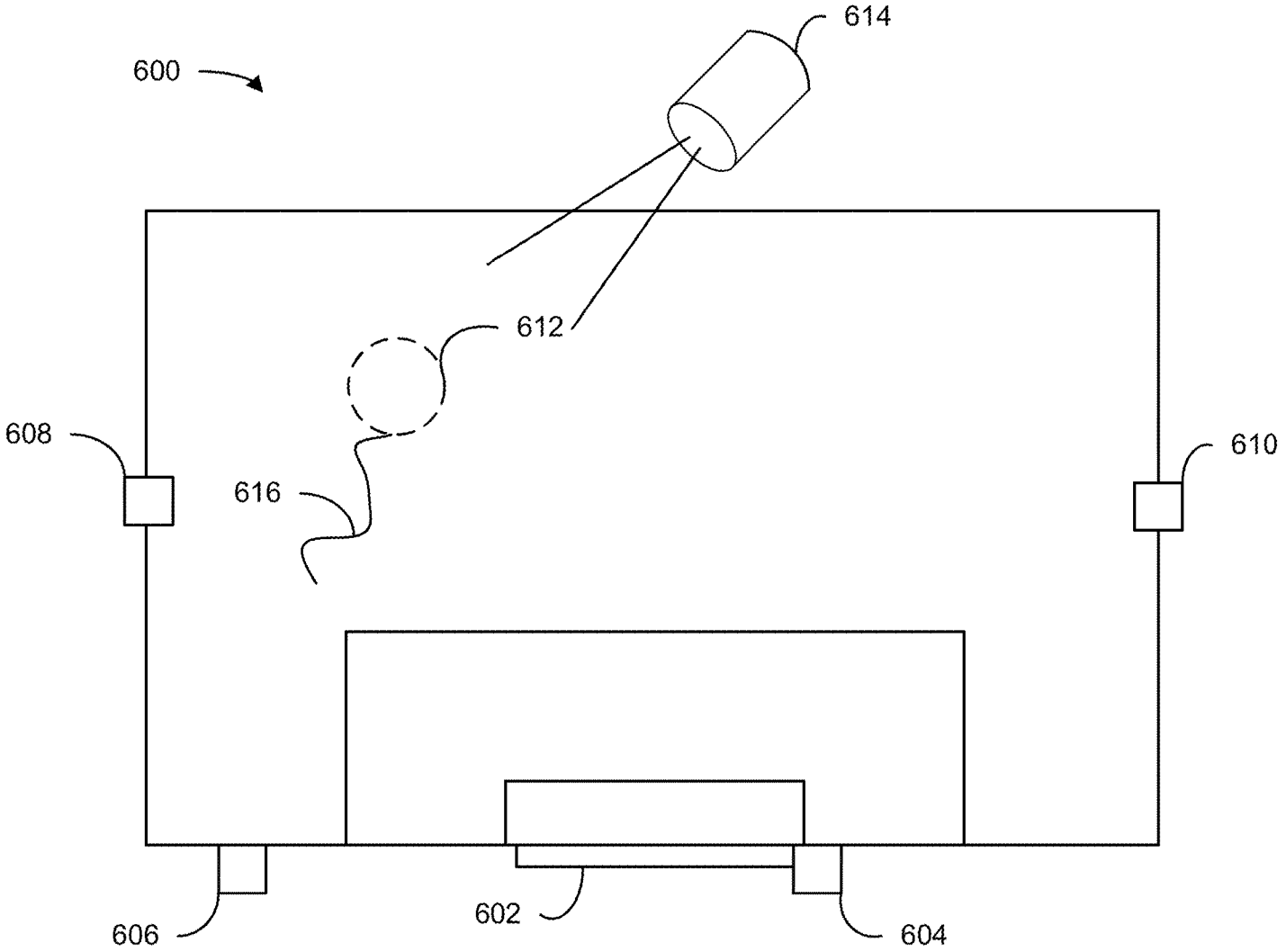
FIG. 6 is a drawing of a smart soccer field including the smart soccer goal of FIG. 1, a field launcher, and a spotlight at a location on the smart soccer field, in accordance with some embodiments of the present disclosure.

Referring now to FIG. 6, a drawing of a smart soccer field 600 including a smart soccer goal 602, a field launcher 606, and a spotlight 612 at a location on smart soccer field 600 is shown, in accordance with some embodiments of the present disclosure. Smart soccer field 600 is also shown to include cameras 608 and 610 (e.g., RGB cameras) and a kiosk 604. There may be any number of cameras 608 and 610 and they may be positioned anywhere on smart soccer field 600. In some embodiments, cameras 608 and/or 610 may be positioned on or coupled to smart soccer goal 602. Kiosk 604 may be similar to kiosk 201, shown and described with reference to FIG. 2. In some embodiments, kiosk 604 is coupled to or a part of smart soccer goal 602. Smart soccer goal 602 may be similar to smart soccer goal 102, shown and described with reference to FIG. 1. Spotlight 612 may be created by a spotlight device 614 in a facility (not shown) that is currently housing smart soccer field 600. Spotlight 612 may be created by any lighting system. For example, spotlight device 614 may receive a control signal from kiosk 604 indicating to shine spotlight 612 on a specific location. The control signal may cause spotlight device 614 to move spotlight 612 around smart soccer field 600 according to a spotlight pattern 616.

In some embodiments, kiosk 604 may cause field launcher 606 to shoot or launch a soccer ball at the location of spotlight 612. For example, based on various off-goal sensor data that kiosk 604 receives from sensors of smart soccer goal 602, kiosk 604 may determine that a soccer player is fast enough when running at a sprint to reach a specific location on smart soccer field 600. Consequently, kiosk 604 may cause the overhead light to shine spotlight 612 at the specific location to give directions to the player as to where to sprint next. Kiosk 604 may also send a control signal to field launcher 606 indicating a ball shooting speed, time, and, in some cases, an angle to shoot a soccer ball so the soccer ball will land at the specific location at a predicted time, such as the time the soccer player should get there when running at a sprint. Field launcher 606 may shoot a soccer ball at the specific location (where spotlight 612 is located) so the player may control (e.g., trap) and perform other functions with the soccer ball (e.g., shoot at the soccer goal, pass to another target, etc.).

Figure 7:
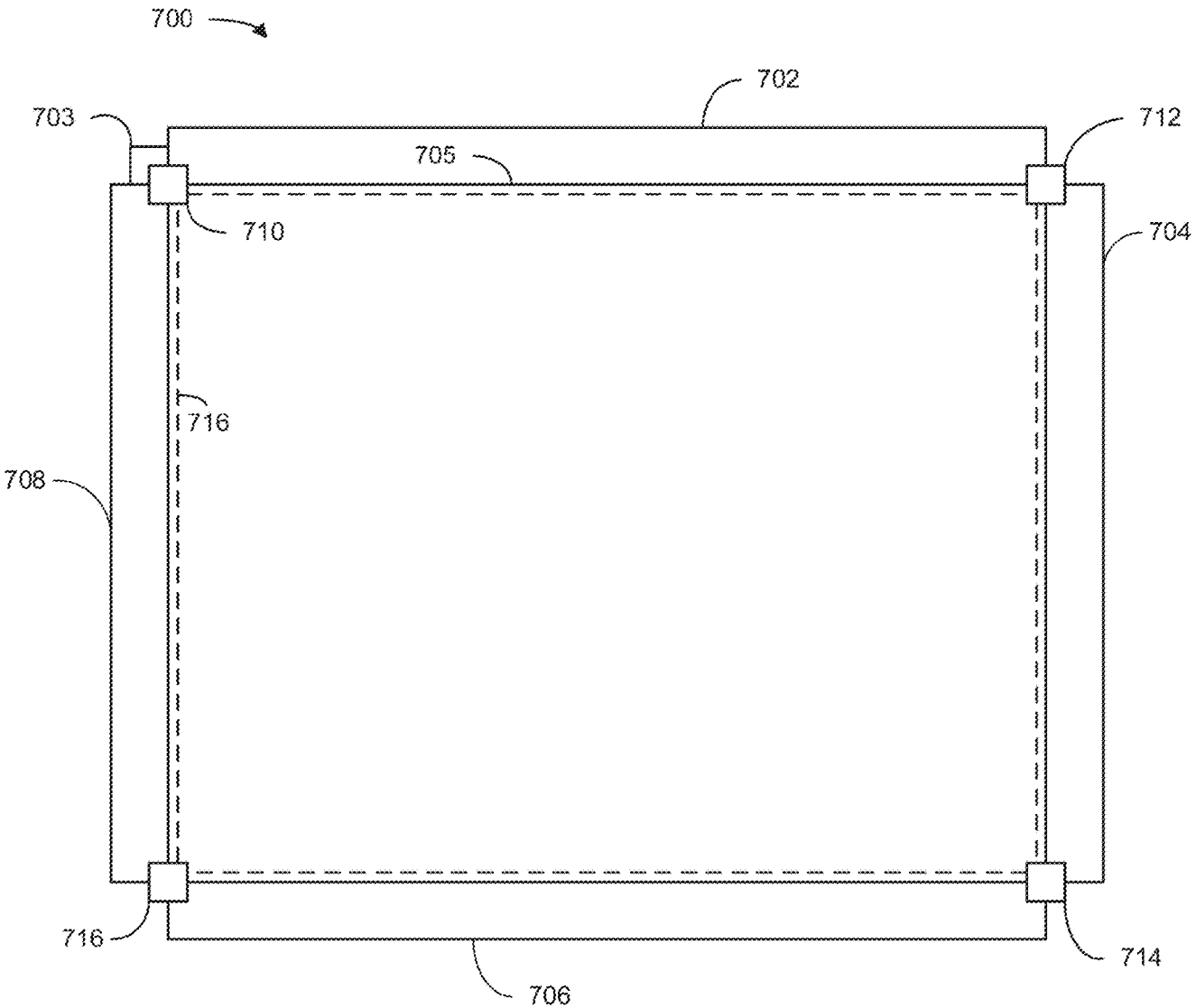
FIG. 7 is a drawing of a soccer field and smart soccer goals surrounding the soccer field, in accordance with some embodiments of the present disclosure.

Referring now to FIG. 7, a drawing of a smart soccer system 700 including smart soccer goals 702, 704, 706, and 708 surrounding a soccer field 705 is shown, in accordance with some embodiments of the present disclosure. Each of smart soccer goals 702, 704, 706, and 708 may be similar to smart soccer goal 102, shown and described with reference to FIG. 1. As shown, smart soccer goals 702, 704, 706, and 708 may each be a length or a width of field 705, however, smart soccer goals 702, 704, 706, and 708 may be any size. Smart soccer system 700 is shown to include smart soccer goals 702, 704, 706, and 708, cameras 710, 712, 714, and 716, field 705, and, in some embodiments, a moat 718. Although not shown, each of smart soccer goals 702, 704, 706, and 708 may be coupled to one or more kiosks for processing data collected from sensors of smart soccer goals 702, 704, 706, and 708 and from cameras 710, 712, 714, and 716. Smart soccer goals 702, 704, 706, and 708 may surround field 705. Cameras 710, 712, 714, and 716 may be in any location taking pictures of field 705 and players playing on field 705. Moat 718 may be in front of and/or below smart soccer goals 702, 704, 706, and 708 to collect soccer balls that go into any of smart soccer goals 702, 704, 706, and 708. Moat 718 may be of any depth and may bring soccer balls to one or more central areas so the balls may be collected and brought back onto field 705.

For example, a group of soccer players may play a game on field 705. The game may be to shoot the ball at various targets generated on LED nets of any of smart soccer goals 702, 704, 706, and 708. The targets, including at least the location, size, and shape, may be randomly generated by the one or more kiosks. Sensors of smart soccer goals 702, 704, 706, and 708 may generate data as soccer balls cross goal lines of smart soccer goals 702, 704, 706, and 708. In some embodiments, the one or more kiosks may be in communication so only one target is generated at a time across all of smart soccer goals 702, 704, 706, and 708. Once the kiosks determine a target has been hit, the kiosks may determine the soccer player that hit the target and, in some cases, determine the team that the player is on. The kiosks can update a profile of the player that hit the target and, in some cases, update a scoreboard indicating which team scored. In some cases, the ball may drop from the net into moat 716 and move to a ball return area (not shown), which can lift the ball and send the ball back into play. During the game, the kiosks may collect data from the sensors of smart soccer goals 702, 704, 706, and 708 and cameras 710, 712, 714, and 716 to track, generate, and/or update player profiles of the players to indicate how the players performed.

Figure 8:
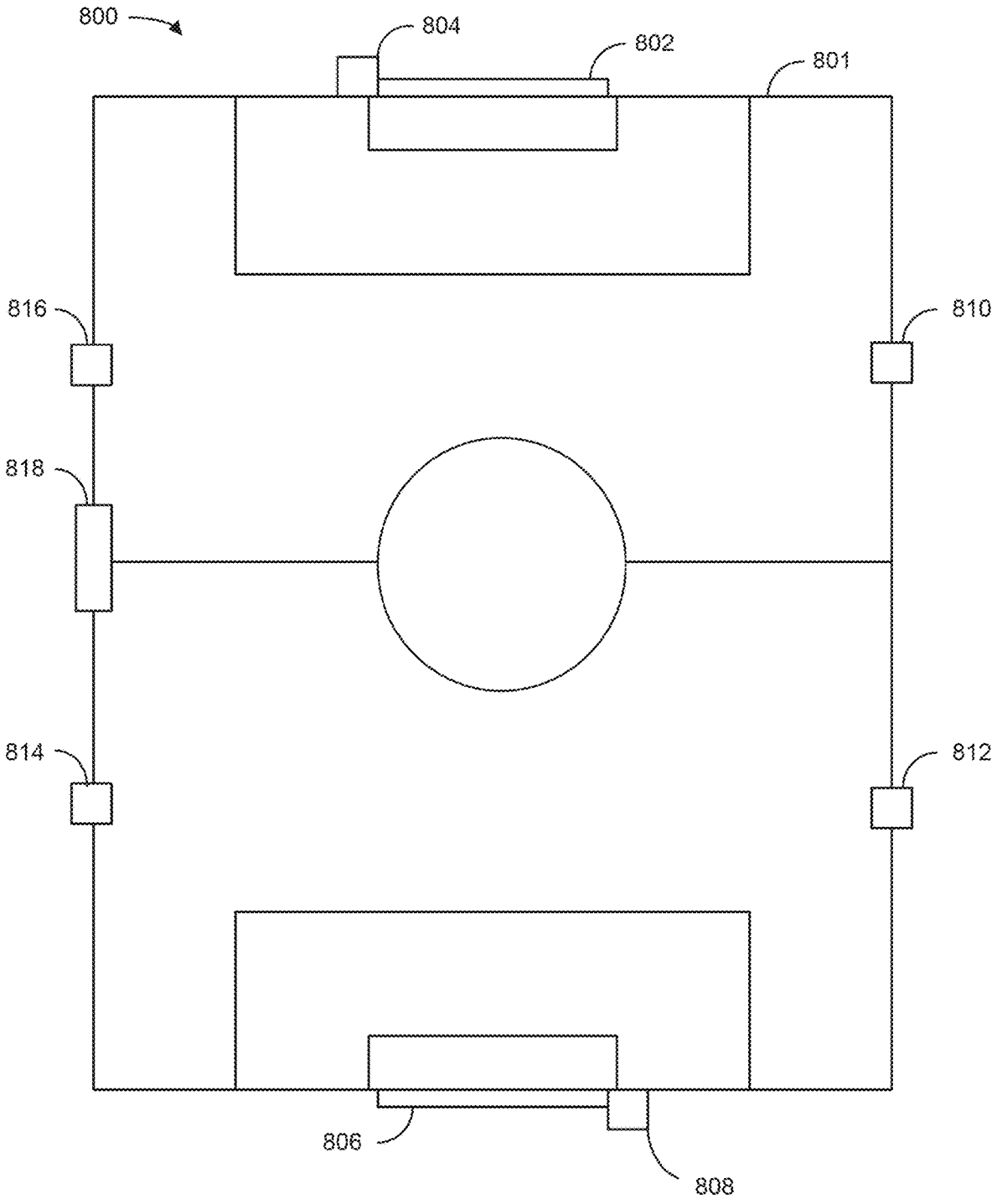
FIG. 8 is a block diagram of a soccer field with two smart soccer goals positioned across from each other, in accordance with some embodiments of the present disclosure.

Referring now to FIG. 8, a block diagram of a smart soccer field system 800 including two smart soccer goals 802 and 806 positioned across from each other on a soccer field 801 is shown, in accordance with some embodiments of the present disclosure. Smart soccer goals 802 and 806 may each be similar to smart soccer goal 102, shown and described with reference to FIG. 1. Smart soccer goals 802 and 806 may be positioned across from each other such that a set of players can be grouped into teams and play a soccer game. Each of smart soccer goals 802 and 806 may be coupled to a kiosk 804 and 808, respectively. Smart soccer field system 800 is shown to include cameras 810, 812, 814, and 816. Each of cameras 810, 812, 814, and 816 may periodically take pictures of designated locations on soccer field 801 during the course of a soccer game. Cameras 810, 812, 814, and 816 may be coupled to one or both of kiosks 804 and 808 to send such pictures to one or both kiosks 804 and 808. Smart soccer field system 800 is also shown to include a smart soccer scoreboard 818. Smart soccer scoreboard 818 may be coupled to one or both of kiosks 804 and 808 and be configured to display scores and various other information about soccer games (e.g., a period number, a time left, a number of fouls per team, a number of timeouts, etc.). In some embodiments, smart soccer scoreboard 818 may include a display (not shown) to display various pieces of content.

In an example embodiment, smart soccer field system 800 may be used to facilitate a soccer game and keep track of the movements and actions of players on soccer field 801. In an example sequence during the course of the soccer game, a player may shoot a ball at smart soccer goal 802 and score. Depth sensors of smart soccer goal 802 may obtain data indicating that a goal was scored, how fast the ball was moving when the goal was scored, and a location of the ball in the goal when the goal was scored. The depth sensors may transmit such data to a processing circuit (e.g., processing circuit 306, shown and described with reference to FIG. 3) (no shown) of kiosk 804 for processing. Cameras 810, 812, 814, and 816 and cameras (not shown) on smart soccer goal 802 may have taken multiple pictures of the player while the player was taking the shot and sent the pictures to kiosk 804. The processing circuit of kiosk 804 may process the pictures and use object recognition to determine which foot the player used to strike the ball and score a goal. The processing circuit may also receive data from on-field sensors (e.g., a LIDAR sensor) of smart soccer goal 802 to determine which player scored the goal. The processing circuit may update a profile of the identified player indicating that the player scored the goal and the various characteristics of how the player scored the goal (e.g., which foot the player used, a spin and curve associated with the shot, the ball's speed as it crossed the goal line, etc.). The processing circuit may also send a signal to smart soccer scoreboard 818 to indicate that a goal was scored and the team that scored.

Figure 9:
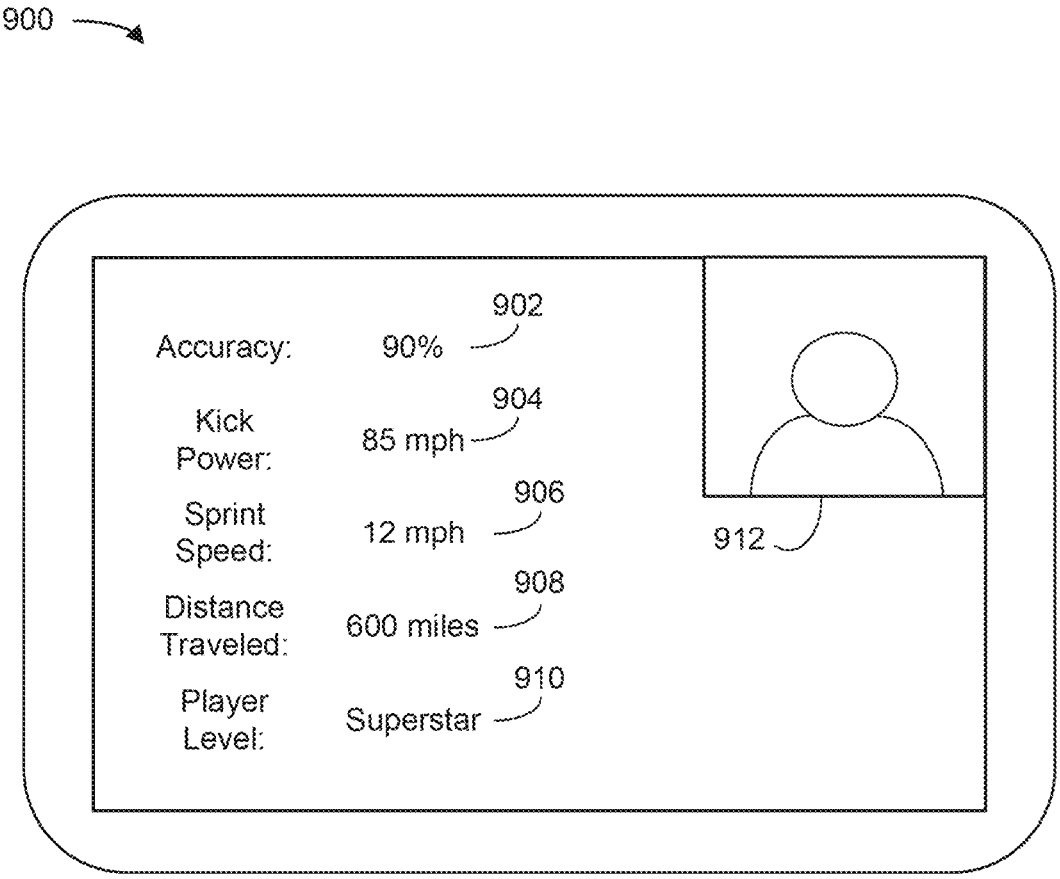
FIG. 9 is a drawing of an example player profile, in accordance with some embodiments of the present disclosure.

Referring now to FIG. 9, a drawing of an example player profile 900 is shown, in accordance with some embodiments of the present disclosure. Player profile 900 may include various statistics about a person that has interacted with a smart soccer goal (e.g., smart soccer goal 102, shown and described with reference to FIG. 1). For example, as shown, player profile 900 may include a player's accuracy 902, a kick power 904, a sprint speed 906, a distance traveled 908, and a player score 910. Player profile 900 may also include a player picture 912 of the player. Accuracy 902 may correspond to a number of times the player successfully kicked a soccer ball at a target (e.g., hit the target) versus a number of times that the player missed the target. Kick power 904 may correspond to an average velocity the player hits the ball when the ball moves in the goal (after it crosses the goal line). Sprint speed 906 may correspond to an average top speed of the player over the course of multiple practice sessions or game sessions. Distance traveled 908 may be a total distance the player has traveled in a session, or in some cases, an average distance the player travels over the course of multiple sessions. Each of characteristics 902-910 may include values of characteristics of a player associated with one session of values aggregated over multiple sessions. Player score 910 may be a value that a processing circuit (e.g., processing circuit 306, shown and described with reference to FIG. 3) determines based on values of characteristics 902-908.

The processing circuit may automatically update player profile 900 as the player associated with player profile 900 plays soccer. For example, if the player trains in a training session, a processor can collect and aggregate data about the player regarding how the player moved and performed during the training session as described herein. The processor can determine a number of successful target hits and misses, kick power, sprint speed, and distance traveled by the player during the training session. The processor can then aggregate the data with previous data of player profile 900 to update the numbers. For example, if the player was more accurate than average during the training session, the processor may increase accuracy 902 of player profile 900.

To determine a player score for a player, the processor may determine scores for each of characteristics 902-908. For example, each of characteristics 902-908 may be associated with a unique point system with possible points for each characteristic ranging from 1-10. The processor may assign points to each characteristic based on the values of the characteristic. The processor may assign the points based on whether the value exceeds some threshold. For example, there may be point thresholds for accuracy at every 10 percentage points up to 100%. The processor may compare the accuracy associated with player profile 900 with one or more of the thresholds and determine whether the value exceeds the threshold. The processor may assign a point to the accuracy characteristic based on the highest threshold that the accuracy meets or exceeds. Continuing with the example above, if the accuracy of player profile 900 is 83%, the processor may compare the 83% accuracy to the 80% threshold and determine 83% exceeds the threshold. The processor may also compare the 83% accuracy to the 90% threshold and determine the accuracy does not exceed the 90% threshold. The 80% percent threshold may be associated with eight points. Consequently, the processor may associate the accuracy characteristic with eight points. The processor may perform similar processes on characteristics 904-908 to obtain points for each characteristic. The processor may then aggregate the points to obtain an aggregated score. The processor may compare the aggregated score to a database with various player levels (e.g., rookie, semi-pro, pro, superstar, etc.) and match the aggregated score to a player level to obtain a value to associate with player score 910.

Figure 10A:
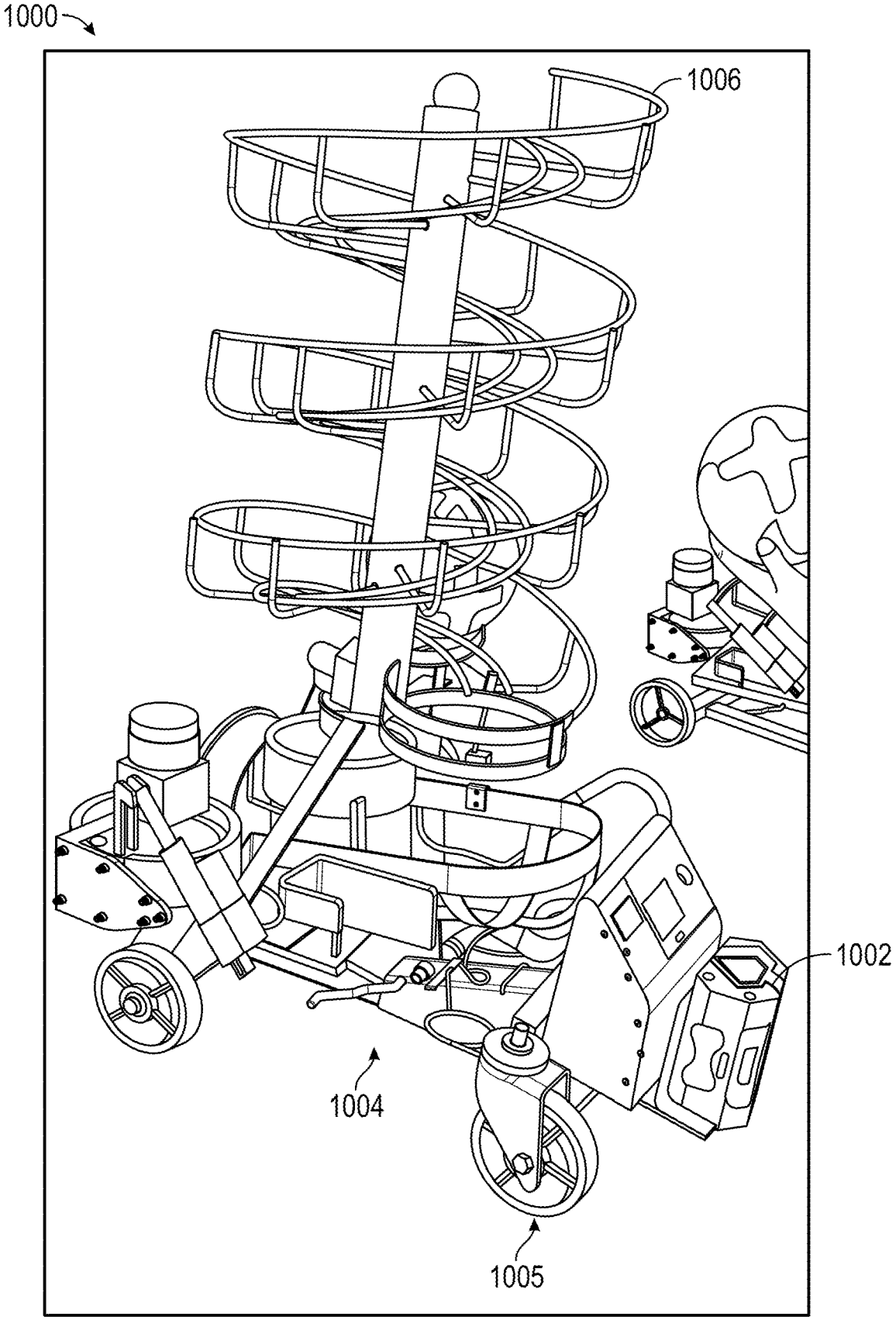
FIG. 10A is a perspective view of the field launcher of FIG. 6, in accordance with some embodiments of the present disclosure.

Referring now to FIG. 10A, a perspective view of a field launcher 1000 is shown, in accordance with some embodiments of the present disclosure. Field launcher 1000 may be similar to field launcher 224, shown and described with reference to FIG. 2. Field launcher 1000 may be powered by a battery 1002. Battery 1002 may be any type of battery and may be similar to battery 205, shown and described with reference to FIG. 2. Field launcher 1000 may include a spiral ball ramp 1006 that can store soccer balls until field launcher 1000 launches them. The soccer balls may lean up against or otherwise contact each other on spiral ball ramp 1006. The soccer balls may be in line to be fired one after another. For example, once field launcher 1000 launches one soccer ball, another soccer that was previously contacting the launched soccer ball may replace the launched soccer ball to be launched. Spiral ball ramp 1006 and the soccer balls may sit on a movable platform 1004. Movable platform 1004 may move via wheels 1005 attached to movable platform 1004 and support the various components of field launcher 1000.

In some embodiments, field launcher 1000 may be coupled (e.g., wirelessly over a network or via a wired connection) to a processor (e.g., processor 206, shown and described with reference to FIG. 2). The processor may send control signals to field launcher 1000 indicating a time, a speed, a direction, and, in some cases, an angle, to launch a soccer ball. Field launcher 1000 may receive and launch the soccer ball according to the control signals. For example, field launcher 1000 may receive a control signal indicating for field launcher 1000 to launch a soccer ball at a specific location on a field. As described above, the location may be correlated with a spotlight. The control signal may include any of a time, a direction, a speed, and an angle so the soccer ball will arrive at the location at a target time. Field launcher 1000 may receive the control signal and launch a soccer ball according to the control signal. For example, field launcher 1000 may automatically adjust a direction of firing by moving around on wheels 1005. Field launcher 1000 may adjust its launch speed as described below. Once field launcher 1000 launches a soccer ball, another ball may take its place so field launcher 1000 can consecutively fire soccer balls without an operator reloading.

Figure 10B:
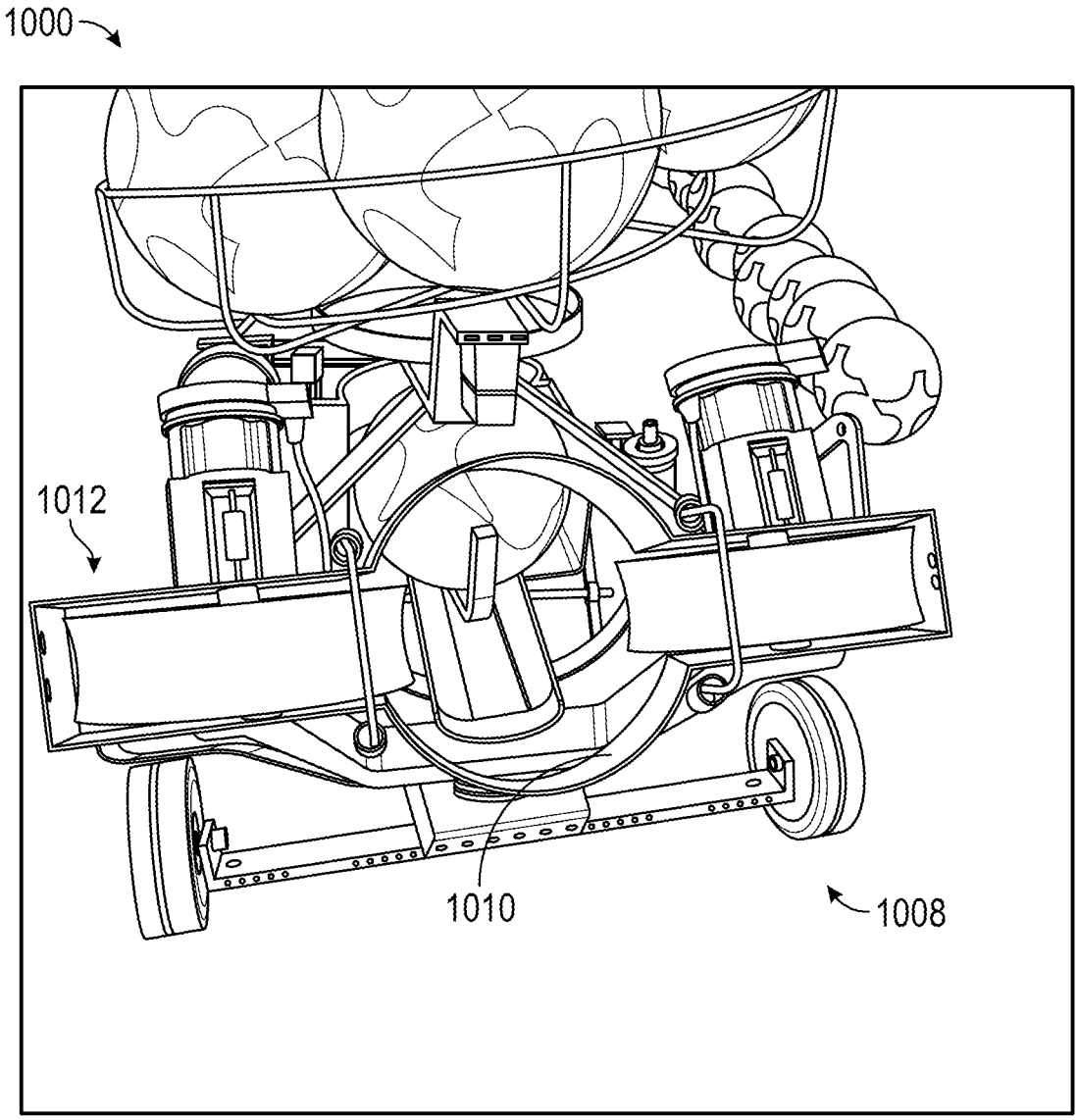
FIG. 10B is perspective view of a launch section of the field launcher of FIG. 6, in accordance with some embodiments of the present disclosure.

Referring now to FIG. 10B, a perspective view of a launch section 1008 of field launcher 1000 for launching soccer balls out of field launcher 1000 is shown, in accordance with some embodiments of the present disclosure. Launch section 1008 is shown to include a launch tube 1010 and launch wheels 1012. Launch tube 1010 may be a tube out of which soccer balls may be launched. Launch wheels 1012 may be spinning wheels with a rubber exterior that can catch soccer balls as the soccer balls roll down launch tube 1010. Depending on the speed of launch wheels 1012, the ball may be launched out of field launcher 1000 at varying distances. For instance, the faster that launch wheels 1012 spin, the further that field launcher 1000 may launch a soccer ball. When a soccer ball is to be launched (e.g., when field launcher 1000 receives a control signal from the processor), the soccer ball may roll or slide into and down launch tube 1010. The ball can roll or slide until it contacts launch wheels 1012. Launch wheels 1012 may spin, in some cases at the same or similar speeds as each other, and cause the ball to be launched out of field launcher 1000. Each of these movements may be controlled by a control signal from a processor (not shown). For example, the processor may send a control signal to field launcher 1000 to launch a soccer ball with a certain speed and direction. Field launcher 1000 may receive the signal, adjust its direction by moving its wheels, adjust its speed by lowering or increasing a voltage that the motors (not shown) receive to cause each of launch wheels 1012 to spin, and remove a barrier that was previously stopping the soccer balls from entering launch tube 1010. The soccer ball may contact launch wheels 1012 and be launched to a specific location.

In some embodiments, in addition to or instead of communicating with a field launcher, the processor may communicate with other devices (e.g., robotic defenders, drones, or any other remote control type of device). For example, the processor may be in communication with a robotic goalie that is positioned on or near the goal line of a smart soccer goal. Sensors on the smart soccer goal may detect movement and position data of a soccer player and a soccer ball to determine when the soccer player is going to shoot the soccer ball at the smart soccer goal and a trajectory/speed of the soccer ball after the soccer player takes the shot. The processor may process such information and send a signal to the robotic goalie to move to a position that the processor determined the ball will reach before going into the smart soccer goal. The robotic goalie may receive the signal and move to the position. In some embodiments, the processor may determine the goalie may not reach the ball before the ball goes into the smart soccer goal. In such instances, the processor may cause the robotic goalie to move to a position that is as close as the robotic goalie can reach before the goal is scored or not move at all. In another example, the processor may cause one or more moving robotic defenders (e.g., moving posts) to move around a soccer field to block a soccer player from passing a soccer ball based on various sensors and/or image data.

Robotic defenders and goalies may move based on preset programming (e.g., movement patterns, movement speeds, etc.) that the processor determines based on various based on a training program. For example, a robotic goalie may be configured (e.g., by the processor) to slowly move back and forth across the goal line of the smart soccer goal in one training program and quickly back in forth in another training program. The robotic goalie may also be configured to automatically react to shots taken by a soccer player. Similarly, robotic defenders may be configured to move in a set pattern around the soccer field at varying speeds or to reactively move to the positions of the defenders and the soccer ball on the soccer field.

In some embodiments, one or more machine learning models may be used to determine locations and/or speeds at which the robotic defenders or the goalie may move. The one or more machine learning model may generate a feature vector including the positions of soccer players and/or a soccer ball on the soccer field and determine locations and speeds for the robotic defenders and the robotic goalie to move to best stop the soccer players from scoring a goal. Another input may be whether the soccer ball contacted one of the robotic defenders and/or the robotic goalie. In some embodiments, the one or more machine learning models may also input characteristic data of each of the soccer players into the feature vector in addition to their positions so the machine learning model may more accurately determine locations and speeds for the robotic defenders and/or the robotic goalie to move. The one or more machine learning model may be trained in real-time using supervised methods with training data that indicates whether the soccer players scored a goal based on the movement speed and/or the positions of the robotic defenders and/or the robotic goalie that the one or more machine learning models provided.

In some embodiments, the robotic defenders and/or the robotic goalie may be equipped with a processor to communicate with another robotic defender and/or goalie along with various sensors and/or cameras. Using similar processes to above, the robotic defenders may individually determine positions on the soccer player to move and send signals to other robotic defenders and/or a robotic goalie to indicate such determinations. Consequently, each robotic defender may operate individually using limited data similar to how a soccer player would operate in a similar position. The robotic entities may communicate with each other to move so they do not need to operate in response to signals from a central processor, in some embodiments.

Any type of robotic device may be similarly controlled and operated using sensor data generated by sensors of the smart soccer goal. For example, image projection and/or spotlights may move to simulate a virtual defender that players may play soccer around to avoid hitting a soccer ball into a spotlight or projected image.

Further, in some embodiments, the processor may use the data that it collects from the sensors of the smart soccer goal to generate an augmented reality environment. The augmented reality environment may include real-world elements (e.g., a view through a see-through lens) and/or virtual images such as soccer players. For example, instead of causing physical robotic defenders to move around a field, the processor may generate an augmented reality data that simulates a soccer player moving around on a field that a player must dodge or pass or shoot a soccer ball around. The processor may transmit the augmented reality data to an augmented reality device (e.g., augmented reality glasses or an augmented reality mobile application). A player accessing (e.g., wearing) the augmented reality device may see the virtual soccer moving around a soccer field in real-time and act accordingly. For example, the processor may record a professional soccer player moving around a soccer field and keep track of the professional soccer player's movements and positions on the field as the soccer player moves. The processor may generate augmented reality data that simulates the player's movements and position on the field and transmit the data to an augmented reality glasses. A soccer player wearing the augmented reality glass may perform the same drill and view where the player was at a similar point in time while performing the drill. In some embodiments, the augmented reality device generates and processes the augmented reality data locally so the processor may not need to stream it, lowering any latency in the processing of the augmented reality data.

The processor may also generate an augmented reality environment that includes virtual defenders similar to those described above. The virtual defenders may move around the virtual environment similar to how the robotic defenders moved around the soccer field as described above. A soccer player on the soccer field may wear an augmented reality device and play a soccer game or perform training while viewing virtual defenders moving around the soccer field (e.g., within the augmented reality environment).

Figure 11:
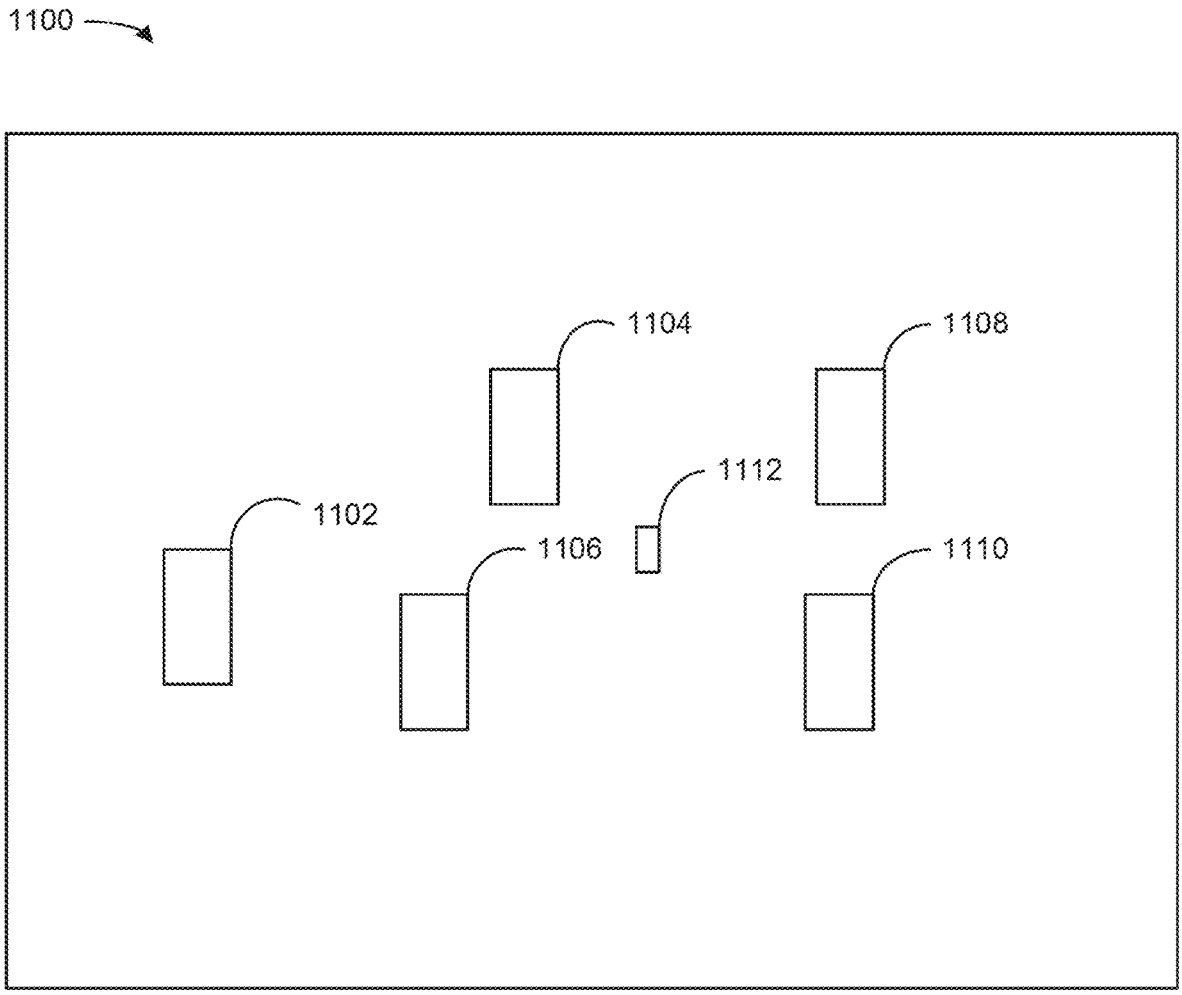
FIG. 11 is an interface generated from data of a LIDAR sensor based on players playing a soccer game, in accordance with some embodiments of the present disclosure.

Referring now to FIG. 11, an interface 1100 generated from a LIDAR sensor based on off-goal data generated based on the LIDAR sensor detecting players playing a soccer game is shown, in accordance with some embodiments of the present disclosure. The LIDAR sensor may be positioned on top of a smart soccer goal (e.g., smart soccer goal 102, shown and described with reference to FIG. 1) and directed outwards away from the smart soccer goal. The LIDAR sensor may generate a three-dimensional map showing a three-dimensional environment and components within the three-dimensional environment by continuously sending out light (e.g., infrared light) and receiving a reflection of the light. Knowing the time it took for the light to be reflected and a direction of the light, the LIDAR sensor may generate the three-dimensional environment. The LIDAR sensor may continuously send out and receive reflections of the light to create a real-time three-dimensional map of the area that the LIDAR sensor senses. The LIDAR sensor may send the map to a processing circuit (e.g., processing circuit 306, shown and described with reference to FIG. 3), which can identify various entities within the three-dimensional environment and track each entity as the entity moves. In some embodiments, the LIDAR sensor may send the location and timing information to the processing circuit so the processing circuit may generate the three-dimensional map.

For example, interface 1100 may be a three-dimensional environment generated from data of the LIDAR sensor of soccer players 1102, 1104, 1106, 1108, and 1110 playing a soccer game with a soccer ball 1112. Interface 1100 may be an example screenshot of the three-dimensional environment. As players 1102-1110 move and/or kick soccer ball 1112, interface 1100 may be updated (e.g., by the LIDAR sensor or a processing circuit) to show a new location of the players. The LIDAR sensor may do so in real-time to capture real-time data of soccer players maneuvering around a soccer field. The processing circuit may identify individual entities from the three-dimensional environment by identifying outlines of the entities. For example, as shown in interface 1100, each soccer player 1102-1110 may be represented as a rough outline in a three-dimensional environment. The processing circuit may identify the outlines as individual entities and track the movements of the entities as the outlines move around the three-dimensional environment.

In some instances, the entities may be labeled with an identifier upon being identified by the processing circuit. The entity may be anonymously labeled or labeled with a personally identifiable identifier (e.g., a name, username, phone number, address, etc.). In some instances, the processing circuit may obtain one or more pictures of each entity from one or more and cameras and determine who the entity is by using object recognition techniques. The processing circuit may individually identify individual entities as people based on a timestamp associated with the one or more pictures that are used to identify the entity. The camera may be on the smart soccer goal or anywhere around the soccer field. For example, a soccer player may enter a soccer field. The processing circuit may generate a real-time three-dimensional environment including the soccer player with data from a LIDAR sensor. An RGB camera may snap a picture of the player while the player is in a location on the field. The RGB camera may send the picture of the player to the processing circuit, which, in turn, can label the picture with a timestamp indicating when the picture was received. In some instances, the RGB camera may label the picture with a timestamp indicating when the picture was taken. The processing circuit may identify which camera sent the photo (e.g., based on a device identifier) and a location on the field with which the camera was pointing. The processing circuit may also identify the location of the player within the camera. Based on the player's location and the camera's location, the processing circuit can determine a location of the player on the field. The processing circuit can then identify a frame of the three-dimensional environment and identify an entity that was in a corresponding location on the field. The processing circuit can associate the player identified in the image with the entity in the three-dimensional environment. At various points in this process, the processing circuit can use image processing techniques to identify an identity (e.g., from a player database) of the player. Thus, the processing circuit can identify an entity in the three-dimensional as the identified player. In some instances, entities in the three-dimensional environment may be manually identified by an operator. In other instances, the entities may not be identified and the processing circuit may associate an anonymous number with them.

In some instances, in addition to identifying a player's identity, the processing circuit may determine a team of the player. The processing circuit may do so using object recognition techniques on images of the player and identifying objects on the player's clothing (e.g., uniform). The processing circuit may identify a team that the player is on from the player's clothing and associate the player with the identified team. In some instances, an administrator or trainer may manually label the player with the team with an input.

Once a player has been identified or associated with an anonymous number within the three-dimensional virtual environment, the processing circuit may keep track of the player's movements within the three-dimensional environment. The processing circuit may determine a size (e.g., length, width, and/or depth) of the environment and determine how far the players move based on the size. Advantageously, by keeping track of players via the three-dimensional environment, statistics about the players may be tracked in real-time and not be subject to any error that may be caused by the uncertainty of continuously using object recognition techniques to identify players. For example, the processing circuit may determine distance traveled, directions traveled, top speed, average speed, burst, etc., of a player by keeping track of the player's movement in the three-dimensional environment after only identifying the player once. The system may perform similar processes on multiple players to keep track of the movement of each individual player.

While or after the processing circuit keeps track of a player's movements, the processing circuit may update a player card associated with the player so the player can later see his or her performance. The processing circuit may keep a history of the player each time the processing circuit collects data so the player can see how his or her performance changes over time.

Figure 12:
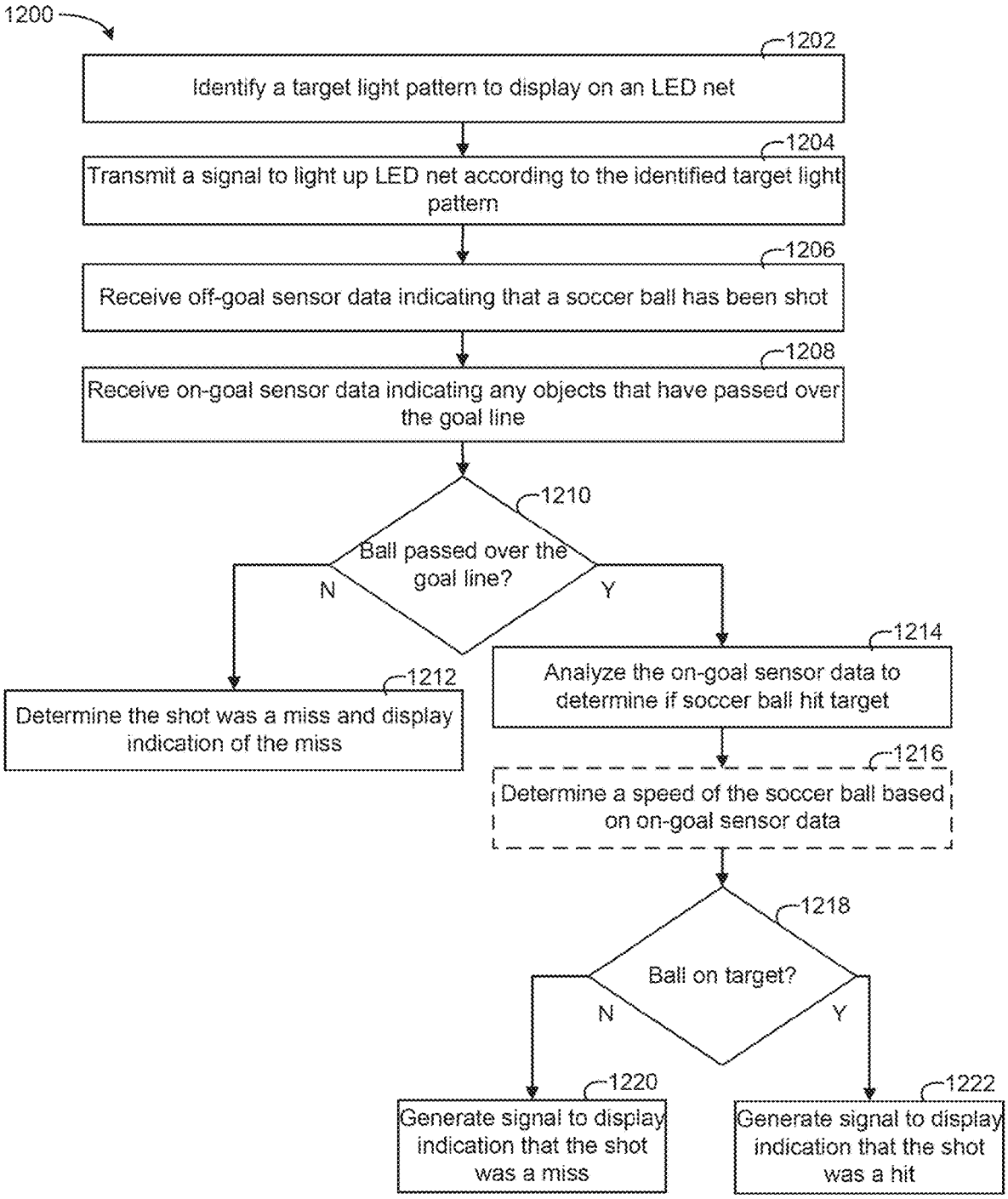
FIG. 12 is an example flow chart outlining determining whether a player scored a goal, in accordance with some embodiments of the present disclosure.

Referring now to FIG. 12, an example flow chart outlining determining whether a player scored a goal on a smart soccer goal is shown, in accordance with some embodiments of the present disclosure. Additional, fewer, or different operations may be performed in the method depending on the implementation and arrangement. A method 1200 conducted by a data processing system (e.g., processing circuit 306, shown and described with reference to FIG. 3) and, in some cases, be associated with a smart soccer goal (e.g., smart soccer goal 102, shown and described with reference to FIG. 1). Method 1200 may include identify a target light patter to display on an LED net (1202), transmit signal to the LED net indicating lights to light up to create a target (1204), receive off-goal sensor indicating whether a soccer ball has been shot (1206), receive on-goal sensor data indicating any objects that have passed over the goal line (1208), "ball passed over the goal line?" (1210), determine the shot was a miss and display indication of the miss (1212), analyze on-goal sensor data to determine if ball hit target (1214), determine a speed of the soccer ball based on on-goal sensor data (1216), "ball on target?" (1218), generate signal to display indication that the shot was a miss (1220), and generate signal to display indication that the shot was a hit (1222).

At operation 1202, the data processing system can identify a target light pattern to display on an LED net of the smart soccer goal. The target light pattern may be identified from a database of the data processing system that stores various light patterns that can be displayed on the LED net. Each light pattern in the database may include a variation of different LEDs that light up at the same time to generate a display that may be discernable to an observer. For example, a target light pattern may display a shape such as a square for a soccer player to shoot a ball at. Other examples of light patterns can include words that display whether a shot was accurate, words indicating a speed with which a shot was taken, a welcoming message welcoming individual people or entities to a soccer field (e.g., "Welcome John Smith"), light patterns with all or none of the LEDs lit up, etc. In some instances, the data processing system can coordinate different light patterns with each other to display information. For example, the data processing system may cause a person's name to horizontally or vertically slide across the LED net until the person's name gets out of view. In another example, the data processing system may flash all of the LED lights multiple times indicating an occurrence of an event such as a goal being scored or a time period of a game being over. Any number of LEDs may be lit up at various locations on the LED net.

The data processing system may select light patterns to display on the LED net based on a game or application being run by the data processing system. For example, the data processing system may receive an input from an operator indicating for a "target practice" game to be played. The target practice game may be associated with a set of target light patterns for a soccer player to shoot a ball at. The data processing system may identify a target light pattern associated with the target practice game from the database. In some instances, the first target light pattern may be the same each time the target practice game is selected. In other instances, the first target light pattern may be pseudo-randomly selected from a group of patterns.

At operation 1204, the data processing system can transmit a signal to light up the LED net according to the identified target light pattern. The data processing system can transmit a control signal indicating the target light pattern to a power box that is operably coupled to a portion of each LED of the LED net. In some embodiments, the power box may include power banks that power the LEDS of the LED net. The power box can receive the control signal and identify corresponding LEDs to light up. For example, the power box can receive a control signal indicating to light up LEDs in the identified target light pattern in a corner section of the LED net. The power box can accordingly provide power to each LED of the identified target light pattern to light up.

At operation 1206, the data processing system can receive off-goal sensor data indicating whether a soccer ball has been shot. The off-goal sensor data may be generated by a LIDAR sensor, various depth sensors, or cameras that are attached to the smart soccer goal. The off-goal sensor data may be associated with object data generated from players moving around a soccer field and kicking a soccer ball. For example, the off-goal sensor data may be a three-dimensional map generated by data from the LIDAR sensor of a soccer field and players playing a soccer game on the soccer field. The off-goal sensor data may also include pictures captured by cameras directed towards the field. Finally, the off-goal sensor data may be generated from various depth sensors that are directed towards the field.

The data processing system may use the data from the LIDAR sensor, the cameras, and/or the depth sensors to determine whether a player has kicked a soccer ball towards the smart soccer goal. For example, the data processing system may receive data from the LIDAR sensor including both a soccer ball and a player that are close to each other. The data may include multiple frames indicating positions of the player and the soccer ball across each frame. The data processing system may identify that the soccer ball is moving towards the smart soccer goal based on a change in locations of the soccer ball. Based on determining that the soccer ball moving towards the smart soccer goal, the data processing system may determine that the player shot the soccer ball. In some instances, the data processing system can identify the frame in which the soccer ball began moving towards the soccer goal. In such instances, the data processing system may associate (e.g., label) the identified frame with the timestamp. Consequently, the data processing system can determine a time that the player shot the soccer ball at the smart soccer goal.

In another example, the data processing system can determine that the player shot the soccer ball based on pictures that were taken by the cameras of the smart soccer goal. For example, the data processing system may use object recognition techniques to identify shooting motions of players and identify when the players are in the shooting motion. The data processing system may do so by comparing poses of the person (an identified object) with poses in a database and determining that the poses of the person match or substantially match poses of people shooting a soccer ball. The data processing system may associate a timestamp with the pictures associated with the shooting motion indicating a time that the player shoots the soccer ball.

At operation 1208, the data processing system can receive on-goal sensor data indicating any objects that have passed over the goal line. The on-goal sensor data may be generated by sensors coupled to the smart soccer goal that are directed inwards towards the soccer goal between at least the goal line (e.g., an imaginary line between posts of the smart soccer goal) and the LED net. The sensors may include depth sensors, LIDAR sensors, cameras, etc. The sensors may continuously generate and provide data to the data processing system over the course of various time periods, such as during a soccer game or during a training drill such as the target practice game. The data processing system may receive the on-goal sensor data and determine when, and if, the soccer ball has crossed the goal line. For example, the data processing system may receive the on-goal sensor data and continuously compare frames generated by the depth sensors, LIDAR sensors, and/or cameras and determine if an object has passed over the goal line.

At operation 1210, the data processing system can determine whether the soccer ball has passed over the goal line. The data processing system may determine that the ball passed over the goal line if it identifies an object in one or more frames of the received on-goal sensor data. If the data processing system does not identify a frame that identifies an object crossing over the goal line, the data processing system may determine that the soccer ball did not cross over the goal line and, in some cases, that a soccer player missed the goal.

To determine if the soccer player made a goal, the data processing system may determine when the soccer player shot the ball, as described in operation 1206, and determine whether a ball crossed the goal line within a pre-determined time period (e.g., a quarter of a second, a half a second, a full second, etc.), as set by an administrator, after the soccer player shot the ball. If the data processing system determines that a soccer ball did not cross the goal line within the pre-determined time period, the data processing system may determine that the player missed the goal. For example, the data processing system may identify that a soccer player hit a soccer ball at a specific time based on off-goal sensor data, as described above. The data processing system may generate and/or associate a timestamp with the data indicating when the player took the shot. The data processing system may determine whether the soccer ball crossed the goal line within a predetermined time period, as set by an administrator, of the timestamp. If the data processing system detects a soccer ball within the goal within the time period, the data processing system may determine that the soccer ball crossed the goal line. Otherwise, the data processing system may determine that the soccer player missed the goal and the soccer ball did not cross the goal line.

If the data processing system determines that the soccer ball missed the goal, at operation 1212, the data processing system may determine that the shot was a miss and display an indication of the miss. The data processing system may display the indication of the miss by selecting a light pattern from the database associated with a missed shot. For example, the data processing system may select a light pattern with LEDs lit up to display "MISS" to an observer and transmit a signal to the power box to light up the LEDs of the light pattern. The data processing system may select any light pattern to be displayed by the LED net. In some instances, the data processing system may select a sound signal corresponding with the missed shot and transmit the sound to signal to an audio component such as a speaker to be played. Additionally, in some instances, the data processing system may identify a player profile of the soccer player and update the profile indicating that the player missed the shot. Further, in some embodiments, the data processing system may identify light patterns that are associated with the miss and update the player profile to indicate that the player missed a shot associated with the identified light pattern. The data processing system may perform similar operations if the shot was a hit.

If the data processing system determines that the soccer ball crossed or is immediately in front of or near the goal line, however, at operation 1214, the data processing system may analyze the on-goal sensor data to determine if the soccer ball hit the target set by the light pattern. For example, the data processing system may analyze the data to determine if the ball hit the lights that were lit up of the selected target light pattern. The data processing system may do so by identifying a location and a trajectory of the soccer ball across frames as the soccer ball moves within the goal. The data processing system may identify the soccer ball within a three-dimensional environment generated from data of the on-goal sensors. For example, the data processing system may identify a first location of the soccer ball within the three-dimensional environment in one image frame and a second location of the soccer ball within the three-dimensional environment in a second image frame. The data processing system may determine a change in location of the soccer ball within the three-dimensional environment to determine a trajectory of the soccer ball within the goal. The data processing system can determine changes in location across any number of frames. Based on the locations of the soccer ball and the changes in location, the data processing system can determine where the soccer ball will hit on the three-dimensional net and/or whether the data processing system hit the target. In some embodiments, the on-goal sensors may include force sensors coupled to the net. The data processing system may receive data from the force sensors and determine, based on the force sensors that send the data, whether the soccer ball hit the target.

At operation 1216, the data processing system may determine the speed of the soccer ball based on on-goal sensor data, in some embodiments. The data processing system may determine the speed of the soccer ball by analyzing the frames that include the soccer ball within the three-dimensional environment. The data processing system may label the frames with timestamps indicating times that the frames were generated. The data processing system may also identify a distance that the soccer ball traveled between frames. The data processing system may divide the distance by a time difference between the timestamps to determine how fast the ball was moving between frames.

At operation 1218, the data processing system may determine whether the soccer ball was on target. As described above, the data processing system may do so based on the location and direction data of the soccer ball between frames of the three-dimensional environment. If the data processing system determines the soccer ball will not hit the target, at operation 1220, the data processing system may generate a signal to display an indication that the shot was a miss. The data processing system may select a light pattern indicating that the shot was a miss and display the light pattern on the LED net. However, if the data processing system determines that the soccer ball will hit the target, at operation 1222, the data processing system may generate a signal to display that the shot was a hit. The data processing system may select a corresponding light pattern and cause the light pattern to be displayed LED net. In some embodiments, in either scenario, the data processing system may also select a light pattern indicating a speed (e.g., in miles per hour) that the ball was traveling when it crossed the goal line and cause the light pattern to be displayed on the LED net in addition to or subsequently to the light pattern indicating that the shot was a hit or a miss. Further, the data processing system may update the profile of the player indicating whether the player hit or missed the target.

Advantageously, by using data from sensors directed towards a soccer field and sensors directed towards the soccer goal, a system can automatically determine whether a player has shot a soccer ball and/or whether the player hit a target. The locations of the sensors on the soccer goal may allow for a portable soccer goal that can enable a processing circuit (e.g., processing circuit 306, shown and described with reference to FIG. 3) to determine which soccer players scored a soccer goal and data about their actions without the need for a specially designed facility with cameras and other sensors on the walls. Further, there is not a need for sensors in vests for the players or in the soccer ball as is used in previous in previous systems. The system enables a player to play games such as the target practice game described above using data from sensors coupled to the goal itself.

Figure 13A:
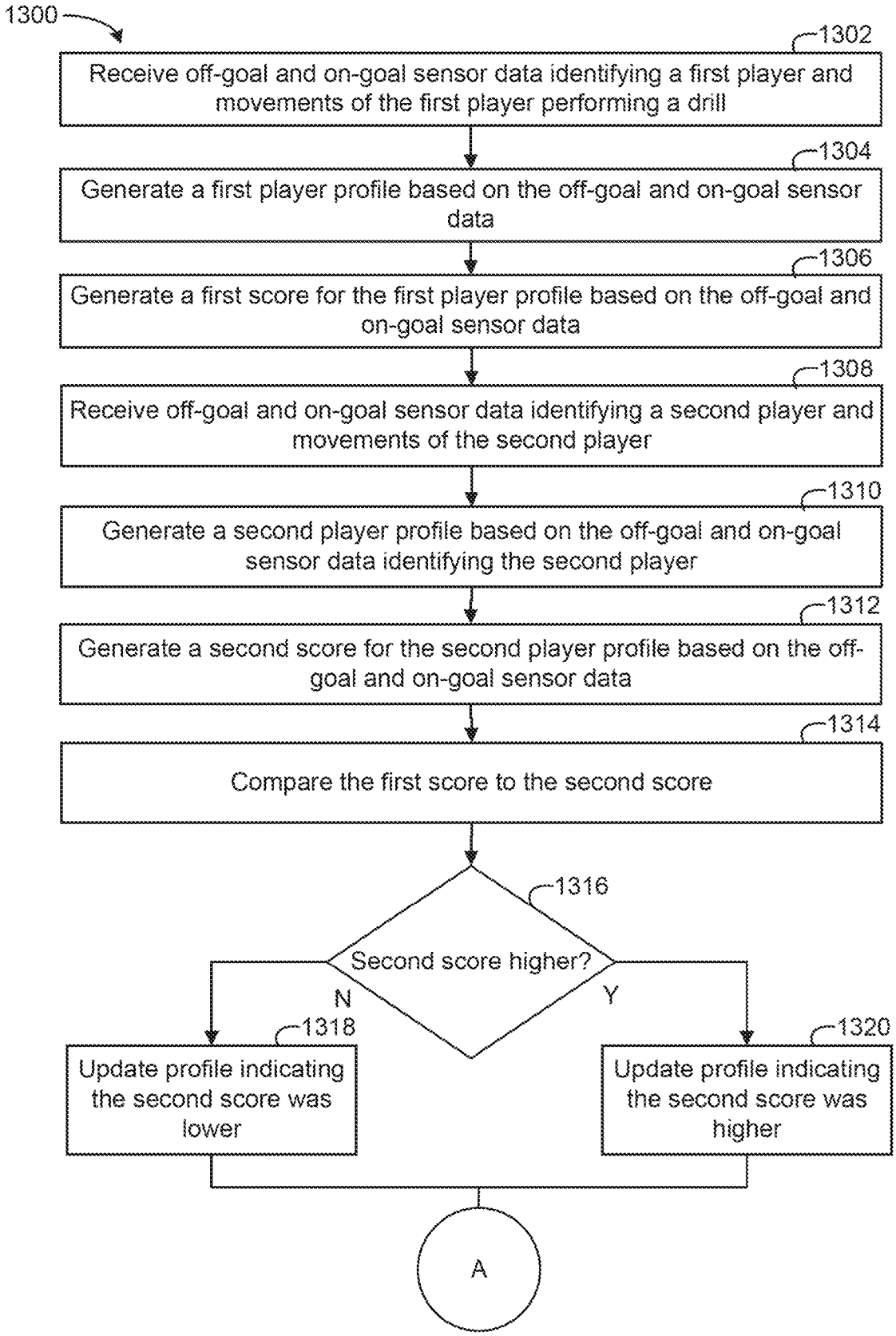
FIG. 13A is an example flow chart outlining comparing players to generate player scores, in accordance with some embodiments of the present disclosure.

Referring now to FIG. 13, an example flow chart outlining comparing players to generate player scores is shown, in accordance with some embodiments of the present disclosure. Additional, fewer, or different operations may be performed in the method depending on the implementation and arrangement. A method 1300 conducted by a data processing system (e.g., processing circuit 306, shown and described with reference to FIG. 3) and, in some cases, be associated with a smart soccer goal (e.g., smart soccer goal 102, shown and described with reference to FIG. 1). Method 1300 may include receive off-goal and on-goal sensor data identifying a first player and movements of the first player performing a drill (1302), generate a first player profile based on the off-goal and on-goal sensor data (1304), generate a first score for the first player profile based on the off-goal and on-goal sensor data (1306), receive off-goal and on-goal sensor data identifying a second player and movements of the second player (1308), generate a second player profile based on the off-goal and on-goal sensor data identifying the second player (1310), generate a second score for the second player profile based on the off-goal and on-goal sensor data (1312), compare the first score to the second score (1314), "second score higher?" (1316), update profile indicating the second score was lower (1318), and update profile indicating the second score was higher (1320). Advantageously, performance of method 1300 may enable the data processing system to automatically determine how soccer players are performing without any subjective input from an administrator and only using data generated from sensors and cameras coupled to the smart soccer goal.

At operation 1302, the data processing system may receive off-goal and on-goal sensor data identifying a first player and movements of the first player performing a drill. The sensor data may be generated by sensors coupled to the smart soccer goal. As described above, the off-goal data may be generated by sensors directed towards a soccer field and the on-goal data may be generated by sensors directed towards the inside of the goal. The data processing system may identify the first player using object recognition techniques on pictures of the player taken by cameras coupled to the smart soccer goal. The data processing system may identify the player based on the pictures and associate the player with a player profile. For example, the data processing system may identify a player as John Smith by comparing pictures of the player to labeled pictures in a database and identifying a picture labeled as John Smith as having similar characteristics to a threshold as the pictures of the player. The data processing system may determine if the player has a player profile and, if the player has a player profile, the data processing system may associate the data generated from the player with the player profile. If no match may be found, however, the data processing system may assign a pseudo-random identifier with the player with which the data processing system may associate the data. In some embodiments, an administrator such as a trainer may manually assign an identifier or identify the player as an input into the data processing system. The data processing system may identify the player based on the input. In some embodiments, the administrator may also associate a player (identified or unidentified) with a team that the player is on.

While the player is playing soccer, in a game or running a drill, the data processing system may receive data associated with how the player is performing and the player's movements. For example, the player may run predesignated running routes and kick soccer balls towards the smart soccer goal in a drill. While the player is running the routes and kicking the soccer balls, the on-goal and off-goal sensors may generate data and send the data to the data processing system. The data processing system may use such data to determine characteristics about the player such as an accuracy (e.g., a percentage of shots that hit a target within the goal), a kick power (e.g., an average velocity with which the player hits the ball into the goal), a sprint speed (e.g., a top speed of the player), a distance traveled (e.g., a total distance traveled across sessions such as games, or an average distance traveled per session), and/or a player level (e.g., a standardized performance level). The data processing system may determine the characteristics for a particular training session or across multiple training sessions.

At operation 1304, the data processing system may generate a player profile for the first player based on the off-goal and on-goal sensor data. The player profile may include the characteristics of the player as described above (e.g., an accuracy, a kick power, a sprint speed, a distance traveled, a player level, etc.) for the individual session or as an average across sessions. In one example, the player may be a celebrity such as a professional soccer player. The professional soccer player may go through a predetermined drill to create an example to which other people may compare their times and stats too. The data processing system may determine characteristics of the player for the predetermined drill and generate a profile for the player based on the characteristics.

At operation 1306, the data processing system may generate a score for the first player profile based on the sensor data. The data processing system may assign points to each characteristic based on values of the characteristic and ranges or thresholds associated with the characteristic. For example, an accuracy of 50 percent may be within a range of values between 40 percent and 60 percent. The range of values may be associated with a score of three points on a scale of 1 to 10. Consequently, the data processing system may assign a score of three to the accuracy characteristic of the player profile. The data processing system may perform similar processes to determine a score for each characteristic. The data processing system can aggregate the score to determine a total score for the player. The data processing system may assign scores of any ranges for each characteristic. In some instances, the total score may be associated with a label such as rookie, semi-pro, professional, or superstar. The total score and/or label may appear in the player profile.

At operation 1308, the data processing system may receive off-goal and on-goal sensor data identifying a second player and movements of the second player. The data processing system may use such data to identify the second player and movements of the second player similar to how the data processing system received and used the data in operation 1302. At operation 1310, the data processing system may generate a second player profile based on the off-goal and on-goal sensor data identifying the second player. The data processing system may generate the second player profile similar to how the data processing system generated the first player profile in operation 1304. At operation 1312, the data processing system may generate a score for the second player profile based on the off-goal and on-goal sensor data. The data processing system may generate the score for the second player profile similar to how the data processing system generated the score for the first player profile in operation 1306.

At operation 1314, the data processing system can compare the score of the first player with the score of the second player. The data processing system can also compare corresponding values of characteristics (e.g., accuracy, sprint speed, etc.) for each player. The data processing system may compare each value and determine, at operation 1316, whether the second player has a higher value than the first player. For example, the data processing system may determine which player is associated with a higher accuracy, kick power, sprint speed, distance traveled, player level, etc. For each characteristic including the score that the second player is associated with a lower value, at operation 1318, the data processing system may update the profile of the second player to indicate that the value is lower. For each characteristic including the score that the second player is associated with a higher value, at operation 1320, the data processing system may update the profile of the second player to indicate that the value is higher. The data processing system may perform these operations per session (e.g., compare the characteristics of the first player based on the first player's performance in one performance to characteristics of the second player in one session) or on average across multiple sessions. In some embodiments, the data processing system may generate a profile for the first player based on data generated from one session while generating and updating a profile of the second player across multiple sessions so the second player can see their improvement compared to the first player.

Figure 13B:
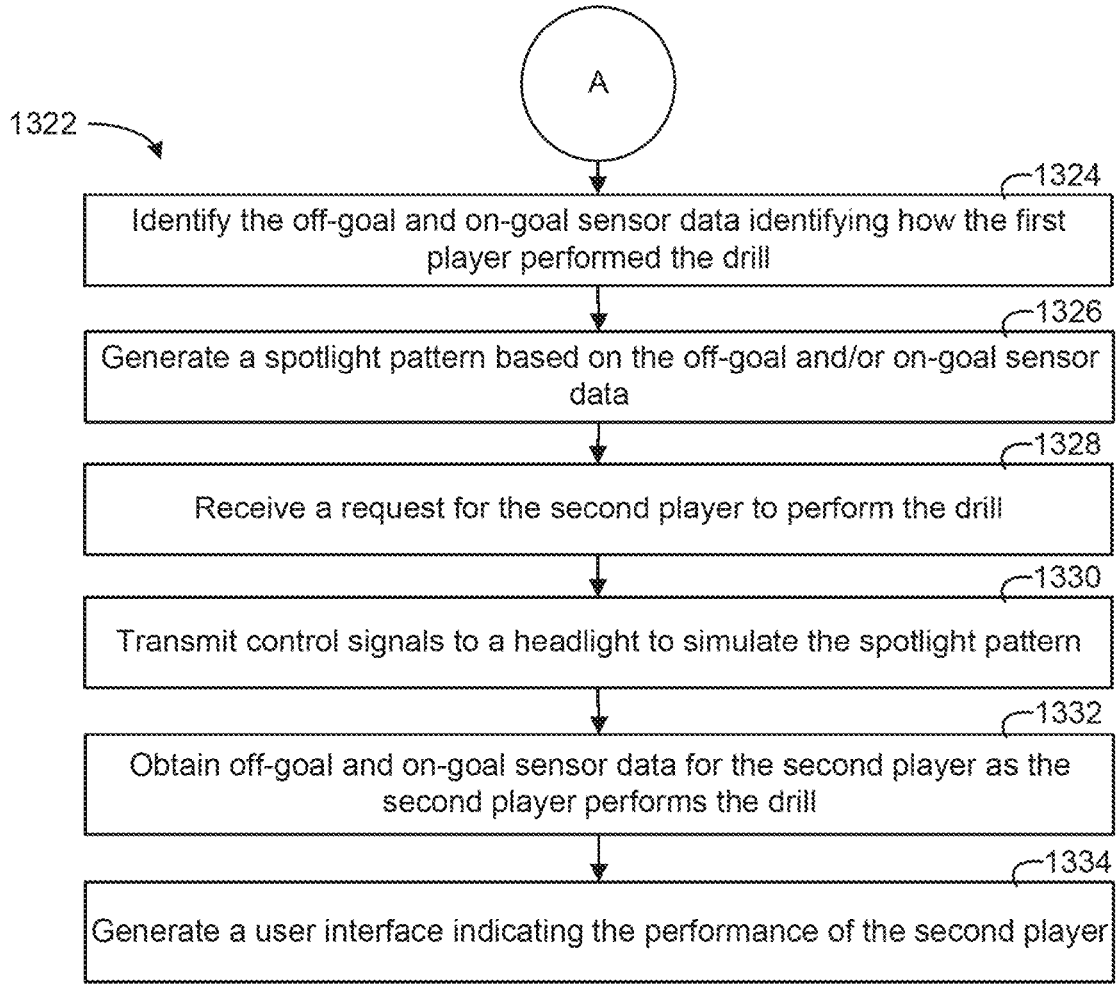
FIG. 13B is an example flow chart outlining generating a ghost spotlight pattern to compare a player's performance with another player's performance, in accordance with some embodiments of the present disclosure.

FIG. 13B is an example flow chart outlining generating a ghost track to compare a player's performance with another player's performance, in accordance with some embodiments of the present disclosure. Additional, fewer, or different operations may be performed in the method depending on the implementation and arrangement. A method 1322 conducted by a data processing system (e.g., processing circuit 306, shown and described with reference to FIG. 3) and, in some cases, be associated with a smart soccer goal (e.g., smart soccer goal 102, shown and described with reference to FIG. 1). In some embodiments, method 1322 may be conducted after method 1300, shown and described with reference to FIG. 13A. Method 1322 may include identify the off-goal and on-goal sensor data identifying how the first player performed the drill (1324), generate a spotlight pattern based on the off-goal and on-goal sensor data (1326), receive a request for the second player to perform the drill (1328), transmit control signals to a spotlight to simulate the spotlight pattern (1330), obtain off-goal and on-goal sensor data for the second player as the second player performs the drill (1332), and generate a user interface indicating the performance of the second player (1334). Performance of method 1322 may enable the data processing system to generate a ghost track spotlight pattern based on the movements of various soccer players. The data processing system may send a control signal to a spotlight to move a spotlight corresponding to the ghost track spotlight pattern.

At operation 1324, the data processing system may identify the off-goal and on-goal sensor data identifying how the first player performed the drill. For example, the off-goal and on-goal sensor data may be stored in a database of the data processing system and be associated with a tag indicating the first player. The data processing system may identify characteristics of the first player from the off-goal and on-goal data. In some embodiments, the data processing system may identify the characteristics of the first player from the database of the data processing system. In some embodiments, the off-goal and on-goal data may include a plurality of images (e.g., a video or static images) of the first player as the player performed the drill. In some cases, each image may be associated with a timestamp. The data processing system may use the images and the timestamps along with metadata (e.g., camera location) associated with the camera(s) that took the images to identify locations of the first player at various points in time while performing the drill. Consequently, the data processing system may identify a path that the first player took while performing the drill.

At operation 1326, the data processing system may generate a spotlight pattern based on the off-goal and/or on-goal sensor data. A spotlight pattern may be a pattern to which an overhead light (e.g., a spotlight) in a facility may shine a spotlight at locations on a soccer field over time. The data processing system may generate a spotlight pattern including a speed and direction of movement of the spot light at various points in time and control the spotlight to move according to the spotlight pattern. For example, a spotlight pattern may cause the overhead light to shine a spotlight in a square pattern on a soccer field. In another example, a spotlight pattern may simulate a path that a soccer player may follow to perform under a training program. Spotlight patterns may trace any shape or direction and can include the spotlight moving at any speed over the soccer field.

The data processing system may generate the spotlight pattern based on data that was generated when the first player performed the drill. For example, from identified locations of the first player as the player was performing the drill, the data processing system may determine a path that the first player took and where the player was at various points in time while performing the drill. The data processing system may map the first player's path into a spotlight pattern that causes the spotlight to simulate the first player's location as the first player performed the drill. In another example, instead of using the identified locations of the first player, the data processing system may use characteristics of the first player to generate the spotlight pattern. For example, a preset spotlight pattern may be stored in a database of the data processing system for a drill. The data processing system may identify the average speed of the first player as the first player performed the drill from the off-goal and/or on-goal data collected based on the first player's movements. The data processing system may apply the average speed to the stored preset spotlight pattern so the spotlight pattern may move in the direction of the preset spotlight pattern at the average speed of the first player.

At operation 1328, the data processing system may receive a request for the second player to perform the drill. For example, the second player may select an option to perform the same drill as the first player and to use the first player's run as a ghost trial to which the second player may compare himself or herself. Once the second player selects the option, at operation 1330, the data processing system may transmit control signals to a spotlight to simulate the spotlight pattern generated as described above. The spotlight may shine the spotlight in the generated spotlight pattern as the second player performs the drill. In some embodiments, the spotlight may shine the spotlight irrespective of how the second player performs the drill or how fast the second player is. Consequently, the second player may perform the same drill as the first player and compare himself or herself to the first player in real-time.

While the player is performing the drill, at operation 1332, the data processing system may obtain off-goal and on-goal sensor data for the second player indicating how the second player is performing. The data processing system may do so using the techniques described herein. At operation 1334, the data processing system may generate a user interface indicating the performance of the second player. The data processing system may obtain the off-goal and on-goal sensor data and determine values of characteristics for the second player. The data processing system may generate a user interface including the values of the characteristics of the second player and values of characteristics of the first player and transmit the user interface to a client device to be viewed by the second player or a trainer. Accordingly, the second player or trainer may use the data to identify potential areas of improvement for the second player. Further, in some embodiments, the data processing system may use the characteristics to automatically generate a training program as described below with reference to FIG. 18.

Figure 14:
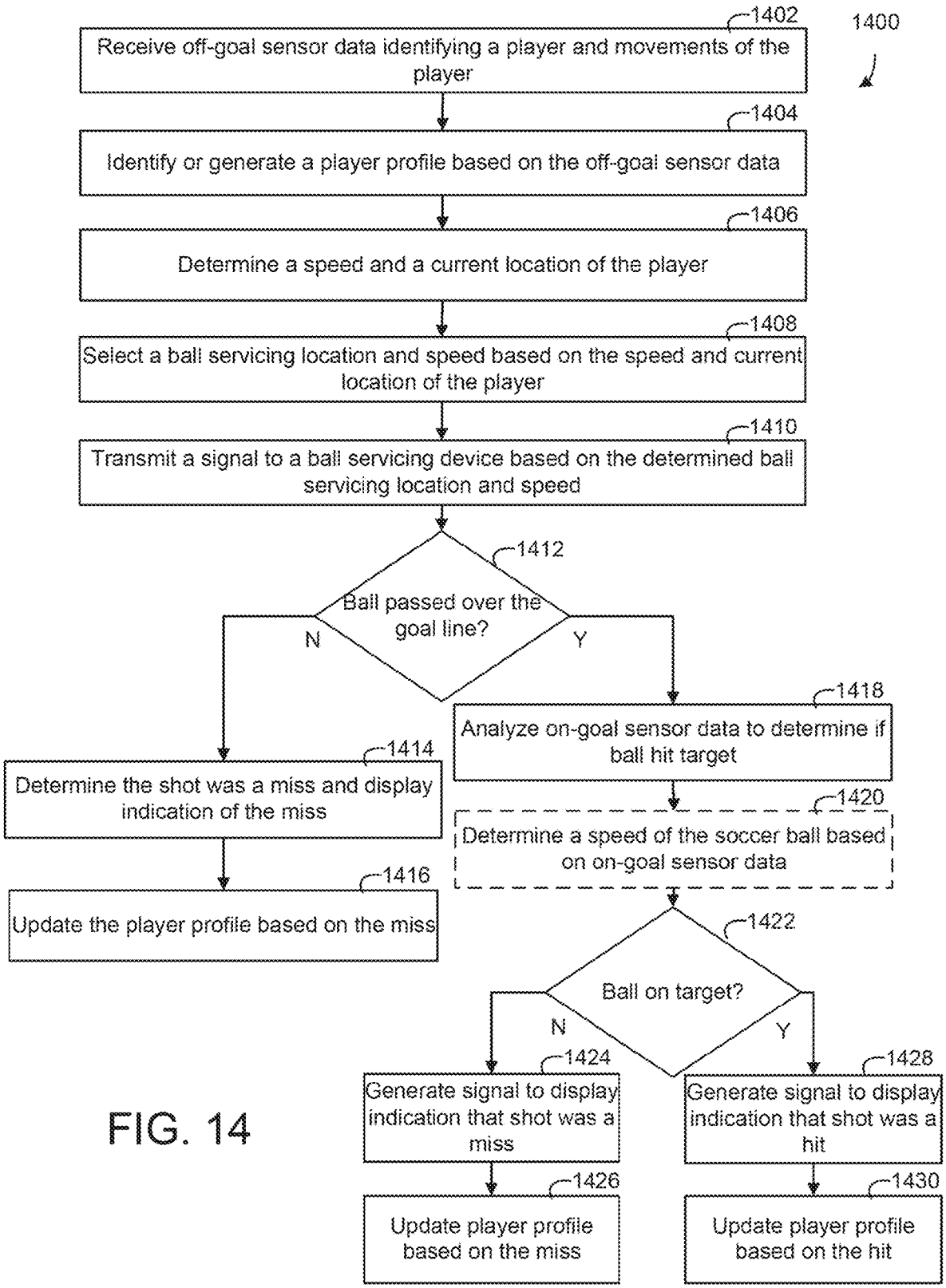
FIG. 14 is an example flow chart outlining selecting a ball servicing location, in accordance with some embodiments of the present disclosure.

Referring now to FIG. 14, an example flow chart outlining selecting a ball servicing location is shown, in accordance with some embodiments of the present disclosure. Additional, fewer, or different operations may be performed in the method depending on the implementation and arrangement. A method 1400 conducted by a data processing system (e.g., processing circuit 306, shown and described with reference to FIG. 3) and, in some cases, be associated with a smart soccer goal (e.g., smart soccer goal 102, shown and described with reference to FIG. 1). Method 1400 may include receive off-goal sensor data identifying a player and movements of the player (1402), identify or generate a player profile based on the off-goal sensor data (1404), determine a speed and a current location of the player (1406), select a ball servicing location and speed based on the speed and location of the player (1408), transmit a signal to a ball servicing device based on the determined ball servicing location and speed (1410), "ball passed over the goal line?" (1412), generate signal to display indication of a miss (1414), update the player profile based on the miss (1416), analyze on-goal sensor data to determine if ball hit target (1418), determine a speed of the soccer ball based on on-goal sensor data (1420), "ball on target" (1422), generate signal to display generate signal to display indication that the shot was a miss (1424), update player profile based on the miss (1426), generate signal to display indication that shot was a hit (1428), and update player profile based on the hit (1430). Performance of method 1400 may enable the data processing system to use objective data generated by sensors of the smart soccer to determine locations for a field launcher to launch a soccer ball.

At operation 1402, the data processing system can receive off-goal sensor data identifying a player and movements of the player. As described herein, the off-goal sensor data may be data generated from one or more LIDAR sensors and/or other cameras coupled to the smart soccer goal and/or in a surrounding area, such as attached to a wall. The off-goal sensor data may indicate movement of a player and a soccer ball and, in some cases, include pictures of the player. At operation 1404, the data processing system may identify or generate a player profile based on the off-goal sensor data. For example, the data processing system may identify the player using object recognition techniques on pictures of the player. The data processing system may compare the pictures of the player with pictures in a database to determine if the pictures substantially match any pictures in the database. If the data processing system identifies a match, the data processing system may identify a profile associated with the player and associate the player with the profile. If the data processing system does not identify a match, the data processing system may generate a profile (e.g., a temporary profile for a session) for the player so the player can view their data once the session ends.

In some embodiments, the data processing system may use data from the LIDAR sensor to identify the player as the player moves around the field. For example, the LIDAR sensor may generate data that can be used to generate a three-dimensional environment. The data processing system may identify a player in the three-dimensional environment based on the outline of the player. The data processing system may associate an outline with a specific player using metadata of the cameras that take pictures of the player (e.g., location of the camera, direction the camera was facing when taking the pictures, etc.) and the identification of the player. For example, the player may enter a soccer field. While on the soccer field, the LIDAR sensor may generate data indicating an outline of the player. The data processing system may receive pictures of the player from a camera. The data processing system may obtain location data about the camera and data indicating the direction the camera was pointing to determine a place on the field the camera was pointing when it took the pictures of the player. The data processing system may also use object recognition techniques to identify the player. The data processing system may determine a correlated location (e.g., the location where the player is located when the picture is taken) of a three-dimensional environment generated from data of the LIDAR sensor to determine the outline of the player in the correlated location is the player that was identified using object recognition techniques. In some embodiments, an administrator (e.g., a trainer) may manually tag the player as the entity on the field.

In some embodiments, the data processing system may process an application that automatically launches soccer balls out of a field launcher so players can trap them and perform a function, such as shooting the ball at a target in the smart soccer goal. While running such an application, the data processing system may dynamically identify where a soccer player is and where to launch the soccer ball based on the player profile of the player. For example, at operation 1406, the data processing system may determine a top speed and a current location of the player. The data processing system can determine the player's top speed based on the value of the top speed in the player's profile and/or based on off-goal data that the data processing system received from the off-goal sensors while the player has been on the field. The data processing system may do so by comparing the location of the player between timestamped frames of a three dimensional environment. The data processing system may also determine a current location of the player using the data. In some embodiments, the data processing system may also determine a current direction that a player is running based on a trajectory of the player between frames. Using the off-goal sensor data generated while the player was on the field may be useful if the player does not have a profile stored in the data processing system identifying the player's top speed.

Once the data processing system determines the top speed of the player, at operation 1408, the data processing system may determine a ball servicing location and speed. In some embodiments, the data processing system may determine the ball servicing location and speed based on the top speed and the current location of the player. The data processing system may determine the ball servicing location and speed by making sure the player can reach the location in time to receive the ball. For example, the data processing system may identify where the soccer player is on the soccer field based on off-goal sensor data. The data processing system may also identify a speed of the player. Based on this information, the data processing system may identify a location on the field that the player can reach within a time frame if the player sprinted at their top speed for a portion of the time frame. The data processing system may identify locations between the identified location and the player and determine select one of these locations to service a soccer ball.

At operation 1410, the data processing system may transmit a signal to a ball servicing device based on the selected ball servicing location. The data processing system may indicate a ball servicing speed and, in some cases, a launch angle for the ball servicing device to launch the ball. For example, the data processing system may send a signal to the ball servicing device indicating for the ball servicing device to launch the soccer ball at 70 mph, at a 45 degree angle, and pointing towards the back right corner of the soccer field. The signal may include more or less data indicating how to launch the soccer ball. The ball servicing device may receive the signal and launch the soccer ball according to the signal from the data processing system. In some embodiments, the data processing system may also send a signal to a spotlight to shine a spotlight at the location to which the data processing system intends for the ball servicing device to serve the ball. The spotlight may shine the light at the location before the ball is launched so the player may know to move to the location of the light to receive the launched ball.

Once the ball servicing device launches the ball, the player may receive the ball and shoot it at a target (e.g. a target light pattern) on the smart soccer goal. The target may be correlated with the signal that the data processing system sends the ball servicing device. For example, the application that the data processing system runs to service the soccer balls may have various targets associated with different soccer ball launches. The data processing system may associate a soccer ball launch with a target and change targets for each soccer ball launch so a player may shoot at different targets within the soccer goal between soccer ball launches.

At operation 1412, the data processing system may determine whether a player's shot passed over a goal line of the smart soccer goal. The data processing system may perform operation 1412 similar to how the data processing system performs operation 1210, shown and described with reference to FIG. 12. If the data processing system determines that the ball did not pass over the goal line, at operation 1414, the data processing system may determine that the shot was a miss and display an indication of the miss similar to how the data processing system determined the shot was a miss at operation 1212, shown and described with reference to FIG. 12. At operation 1416, the data processing system may update the player profile of the player indicating the miss (e.g., document the shot as a miss and cause accuracy to go down).

If the data processing system determines that the shot passed over the goal line, at operation 1418, the data processing system may analyze the on-goal sensor data to determine if the ball hit a target on an LED net of the smart soccer goal. The data processing system may analyze the on-goal sensor data similar to how the data processing system analyzes the on-goal sensor data at operation 1216, shown and described with reference to FIG. 12. Similarly, at operation 1420, the data processing system may determine a speed of the soccer ball based on the on-goal sensor data. The data processing system may determine the speed of the soccer ball similar to how the data processing system determined the speed of the soccer ball at operation 1218, shown and described with reference to FIG. 12. At operation 1422, the data processing system can determine whether the shot was on target (e.g., hit the light pattern on the LED net). The data processing system may determine whether the shot was on target similar to how the data processing system determined whether a shot was on target at operation 1220, shown and described with reference to FIG. 12.

If the data processing system determines that the shot was not on target, at operation 1424, the data processing system may generate a signal to display an indication that the shot was a miss. The signal may be a light pattern to display if a shot was a miss (e.g., "MISS"). The data processing system may cause the light pattern to be displayed on the LED net of the smart soccer goal. In some embodiments, the data processing system may display the miss light pattern in addition to a ball speed light pattern indicating a speed at which the soccer ball passed the goal line as determined in operation 1410. At operation 1424, the data processing system may update the player profile of the player that missed to indicate the miss and the ball speed. The update may indicate that the ball went into the goal but missed the target.

If the data processing system determines that the ball was on target, however, at operation 1428, the data processing system may generate a signal to display that the shot was a hit. The signal may be a light pattern to display if a shot was a hit (e.g., "YOU MADE IT"). The data processing system may cause the light pattern to be displayed on the LED net of the smart soccer goal. In some embodiments, the data processing system may display the hit light pattern in addition to a ball speed light pattern indicating a speed at which the soccer ball passed the goal line as determined in operation 1410. At operation 1430, the data processing system may update the player profile of the player that hit the target to indicate the hit and the ball speed.

Figure 15:
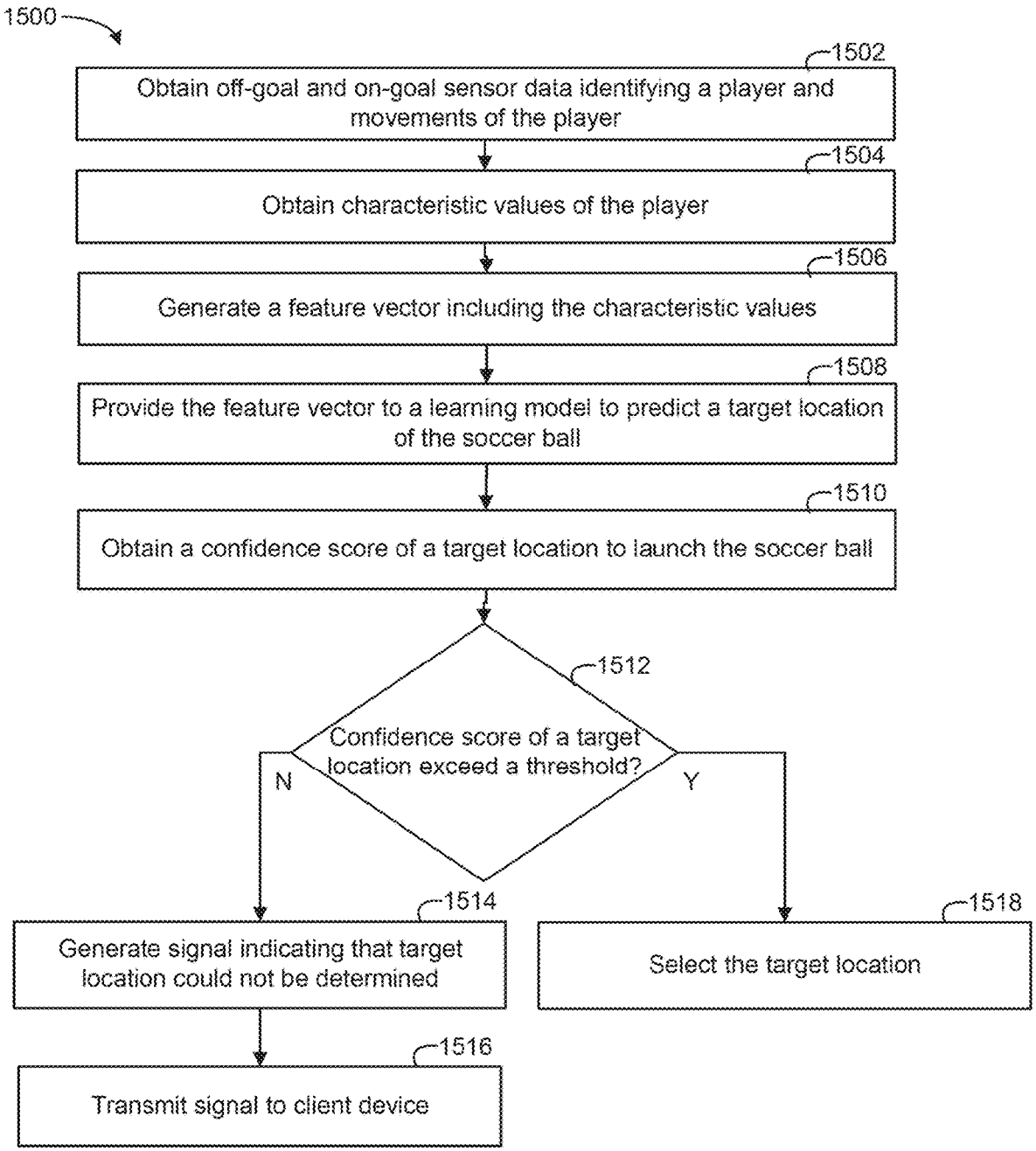
FIG. 15 is an example flow chart outlining using a machine learning model to predict a location to launch a soccer ball, in accordance with some embodiments of the present disclosure.

Referring now to FIG. 15, an example flow chart outlining using a machine learning model to predict a location to launch a soccer ball for a player to receive the ball is shown, in accordance with some embodiments of the present disclosure. Additional, fewer, or different operations may be performed in the method depending on the implementation and arrangement. A method 1500 conducted by a data processing system (e.g., processing circuit 306, shown and described with reference to FIG. 3) and, in some cases, be associated with a smart soccer goal (e.g., smart soccer goal 102, shown and described with reference to FIG. 1). Method 1500 may include obtain off-goal and on-goal sensor data identifying a player and movements of the player (1502), obtain characteristic values of the player (1504), generate a feature vector including the characteristic values (1506), provide the feature vector to a machine learning model to predict a target location of the soccer ball (1508), obtain a confidence score of a target location to launch the soccer ball (1510), "confidence score of a target location exceed a threshold?" (1512), generate signal indicating that a target location could not be determined (1514), transmit signal to client device (1516), and select the target location (1518). Method 1500 may enable a machine learning model to more accurately identify target ball locations for a field launcher to launch a soccer ball at and for a soccer player to receive the soccer ball. In some embodiments, the operations of method 1500 may be performed at operation 1408, shown and described with reference to FIG. 14, to select the ball servicing location and speed.

At operation 1502, the data processing system may obtain off-goal and on-goal sensor data identifying a player and movements of the player. The off-goal and on-goal sensor data may be collected and transmitted to the data processing system by various sensors and cameras as described herein. The data processing system may obtain the off-goal and on-goal sensor data in real-time as the player moves around a soccer field. At operation 1504, the data processing system may use the off-goal and on-goal sensor data to determine values of various characteristics of the player. For example, the data processing system may determine a top speed, distance traveled, kick power, kick accuracy, etc., of the player based on the off-goal and on-goal sensor data. In some embodiments, the data processing system may obtain pre-generated characteristic values from a profile of the soccer player. For example, the data processing system may identify the soccer player, identify a profile associated with the soccer player from a database, and retrieve characteristic values about the soccer player from the profile.

At operation 1506, the data processing system may generate a feature vector including the characteristic values. The feature vector may be a vector that includes a characteristic value at each dimension of the vector. The feature vector may include any characteristic value. The characteristic values of the feature vector can be normalized characteristic values that were converted from their original values into other numerical values, binary code, matrices, vectors, etc. The values can be normalized into values between −1 and 1 using any technique so operations can be performed on the values. The values can be normalized into any value range. In some embodiments, the feature vector can include the original values and does not include a normalizing step. In some embodiments, the values may include the raw off-goal and/or on-goal sensor values.

At operation 1508, the data processing system may provide the feature vector to a machine learning model to predict a target location of the soccer ball. The machine learning model may receive the feature vector and determine, using tuned weights and/or parameters developed during training, as described below with reference to FIG. 16, a location on a soccer field to launch the soccer ball. The machine learning model may be trained to predict the target location to make sure the field launcher launches the soccer ball at a location that the soccer player can reach in time to receive the soccer ball and shoot the ball at a target in the smart soccer goal. In some embodiments, the machine learning model may be configured to predict a location that is a maximum distance to which a player may travel in a set time period from a current location of the player. In other embodiments, the machine learning model may be configured to predict locations between the maximum distance and the current location of the player. The distance may be in any direction from the player.

In some embodiments, the machine learning model may be configured to use live sensor data in addition to or instead of stored characteristic data from a player's profile to predict a target location to launch a soccer ball. For example, the data processing system may receive live sensor data generated based on the player's movements while playing soccer in front of the smart soccer goal. The data processing system may generate characteristics such as top speed and distance traveled for the player based on the live sensor data. The data processing system may use the generated characteristics as an input into the machine learning model and the machine learning model may predict a target location to shoot a soccer ball. In another example, the data processing system may use the characteristics determined based on the live sensor data with the characteristics of the player's profile as inputs to the machine learning model to determine a location to launch the soccer ball that will enable the player to reach the location and receive and perform some action (e.g., shoot) with the soccer ball. Advantageously, by using live data and data from a player's profile, the machine learning model may account for a player's current performance and a current physical condition of the player (e.g., a tiredness level of the player).

At operation 1510, the data processing system may obtain a confidence score of the target location from the output of the machine learning model. The confidence score may be a probability or a likelihood that the output target location is the correct location to launch the ball. For example, the machine learning model may receive live sensor data inputs and determine characteristics indicating the player's top speed and total distance traveled during a soccer session. Using various tuned weights and parameters and based on the inputs, the machine learning model may output a confidence score of 80% that the correct location to launch a soccer ball is 15 feet to the right of the player. The machine learning model may generate multiple confidence scores for the locations to launch the soccer balls. For example, based on the same live sensor data inputs, the machine learning model may generate a confidence score of 15% for a location 10 feet in front of the player, a confidence score of 20% for a location of 20 feet behind the player, etc. The percentages may or may not aggregate to 100%. The machine learning model may generate confidence scores for any number of locations that are, in some embodiments, relative to a current location of the soccer player (e.g., five feet in front of the player, 15 feet behind the player, 12 feet to the right of the player, etc.).

In some embodiments, the machine learning model may generate confidence scores for locations around the soccer field irrespective of the current location of the player. For example, the machine learning model may learn to automatically generate confidence scores for locations based on a previously predicted location. The machine learning model may predict the next location using the characteristics of the player in addition to the location of the previously predicted location as inputs to generate the confidence score for the next target location. Such a prediction may be advantageous when the data processing system is generating a training program in real-time by sequentially launching soccer balls to a player. The machine learning model may be able to use the real-time information (e.g., information indicating that the player is getting tired and may reach certain locations slower than if the player was not tired and could reach the location at top speed) to launch soccer balls at the player so the player can continue practicing a drill.

At operation 1512, the data processing system may determine whether a confidence score of a target location exceeds a threshold. The data processing system may do so by comparing the confidence score of the target location to the threshold. The data processing system may compare each confidence score of a probability distribution to the threshold, in some cases. If multiple confidence scores exceed the threshold, then, in some cases, the data processing system may determine that it does not have enough information to select a target location. In such instances, the data processing system may select a pre-determined location to launch the soccer ball and run new inputs, in some cases including information generated as the player moved to the new location to receive the soccer ball and kick it, through the machine learning model to determine a new location. In some embodiments, the data processing system may compare the confidence scores to each other and compare the highest confidence score to the threshold. If the data processing system determines that the confidence score exceeds the threshold, at operation 1518, the data processing system may select the target location associated with the confidence score.

However, if the data processing system determines that the confidence score does not exceed the threshold, at operation 1514, the data processing system may generate a signal indicating that the target location could not be determined and, at operation 1516, transmit the signal to a client device. In such instances, the data processing system may identify a pre-determined location to launch the soccer ball and sequentially determine a new location to launch a soccer ball as described above.

In some embodiments, the machine learning model may not generate a confidence score and instead may generate a location to launch the soccer ball. For example, a machine learning model that uses clustering may generate a point in a cluster. The point may be associated with a set of inputs. The cluster may be associated with a location on the soccer field to launch the soccer ball. In some instances, a distance of a point generated from the set of inputs from a line (e.g., a line in a support vector machine output) may be a confidence score. The confidence score can be any amount.

Figure 16:
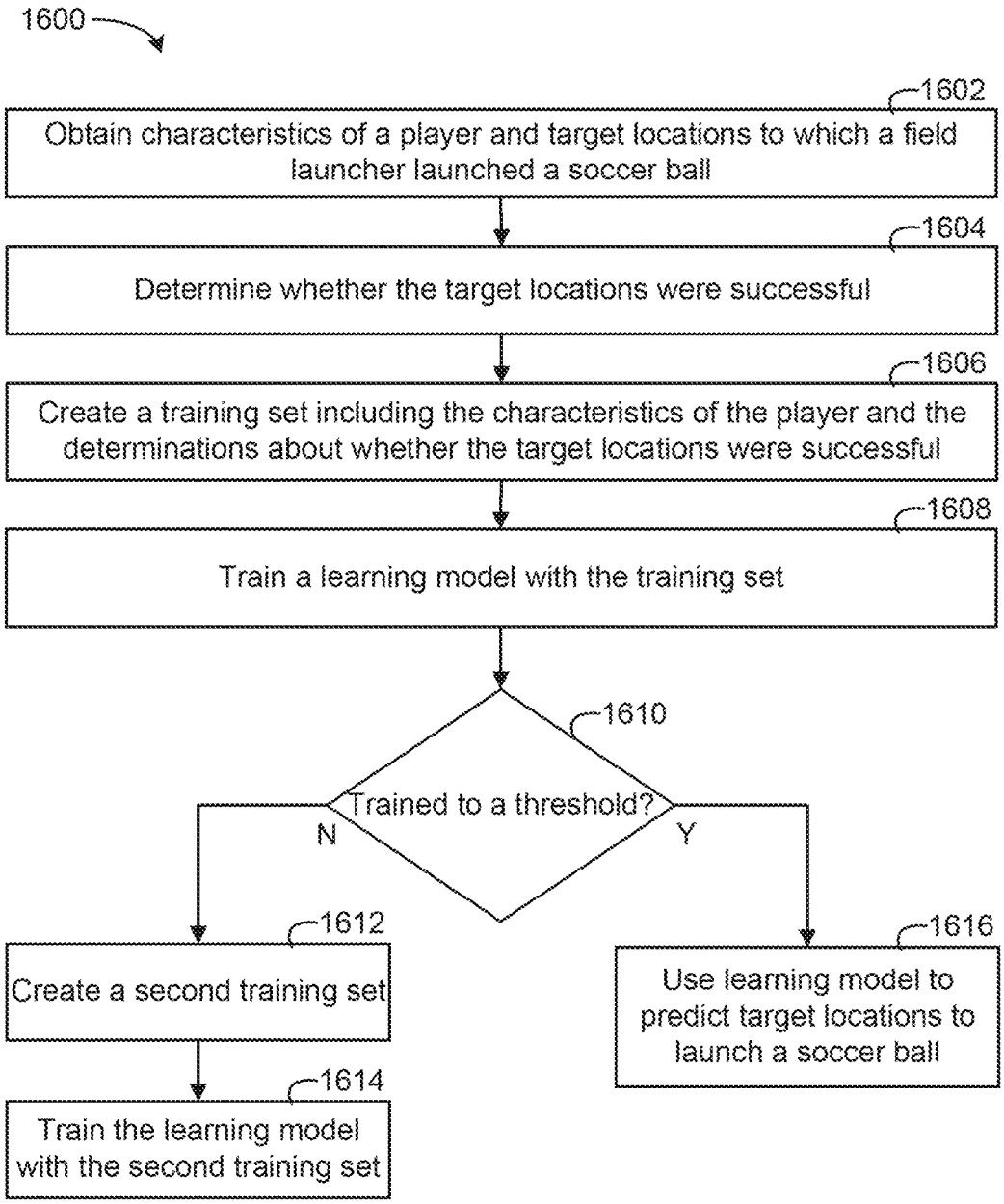
FIG. 16 is an example flow chart outlining training the machine learning model of FIG. 15, in accordance with some embodiments of the present disclosure.

Referring now to FIG. 16, an example flow chart outlining training the machine learning model of FIG. 15 is shown, in accordance with some embodiments of the present disclosure. Additional, fewer, or different operations may be performed in the method depending on the implementation and arrangement. A method 1600 may be conducted by a data processing system (e.g., processing circuit 306, shown and described with reference to FIG. 3) and, in some cases, be associated with a smart soccer goal (e.g., smart soccer goal 102, shown and described with reference to FIG. 1). Method 1600 may include obtain characteristics of a player and target locations to which a field launcher launched a soccer ball (1602), determine whether the target locations were successful (1604), create a training set including the characteristics of the player and the determinations about whether the target locations were successful (1606), train a machine learning model with the training set (1608), "trained to a threshold?" (1610), create a second training set (1612), train the machine learning model with the second training set (1614), and use the machine learning model to predict target locations to launch a soccer ball (1616). Method 1600 may be performed to train a machine learning model to determine the best locations to launch a soccer ball so a soccer player may be trained. In some embodiments, method 1600 may be performed so a machine learning model may be trained to determine the best locations to launch soccer balls in real-time as a player performing a soccer drill gets tired and may not be able to run as fast.

At operation 1602, the data processing system may obtain characteristics of a player and target locations to which a field launcher launched a soccer ball. The data processing system may obtain characteristics about any player to which the data processing system launched a soccer ball. Examples of characteristics may include, but are not limited to, a top speed, a distance traveled (in a current session or over multiple sessions), an acceleration, etc. The data processing system may obtain the characteristics by receiving off-goal and on-goal sensor data by determining values for each characteristic as described herein. In some embodiments, the data processing system may input previous target locations that the ball had been launched to avoid repeatedly launching the ball at the same target location for the same player. In some embodiments, the characteristics of the player may be manually input into the data processing system. The data processing system may obtain target locations to which the field launcher launched the soccer ball from previous sessions associated with the player. For example, each time the field launcher launches the soccer ball at a location, the data processing system may store data indicating the location to which the field launched the soccer ball and characteristics of the player that caused the field launcher to launch the soccer ball at the location. In some embodiments, the data processing system may obtain the target locations as a manual input from an administrator.

At operation 1604, the data processing system may determine whether the target locations were successful. In some embodiments, the data processing system may determine a target location as being successful if a player was able to reach the target location to which the field launcher launched a soccer ball and contact the soccer ball. The data processing system may make such a determination by obtaining off-goal sensor data (e.g., LIDAR data and images from cameras) to determine if the soccer ball contacted the soccer player. In such embodiments, if the data processing system determines that the soccer ball did not contact the soccer player, the data processing system may determine the target location was unsuccessful. If the data processing system determines that the soccer ball contacted the soccer player, however, the data processing system may determine the target location was successful. In some embodiments, the data processing system may determine if the target location was successful based on whether a soccer player was able to successfully trap the soccer ball at the target location. The data processing system may use object recognition techniques on pictures (received from a camera) of the player receiving the soccer ball. The data processing system may compare the pictures to pictures of a player successfully trapping a soccer ball to determine if the player successfully trapped the soccer ball. If the data processing system determines the trap was successful, the data processing system may determine that the target location was successful. Otherwise, the data processing system may determine that the target location was not successful.

In another example, the data processing system may determine that the player contacted the soccer ball based on a determined change in direction of a soccer ball. The data processing system may keep track of the movements of the soccer ball after it is launched and determine if the soccer ball changed direction upon reaching a target location. The change in direction may a sudden stop or a bounce in another direction. The data processing system may determine the change in direction using off-goal sensor data.

In some embodiments, the data processing system may determine a target location was successful if the player was able to hit a target in the smart soccer goal. The data processing system may use on-goal sensor data to determine where/if the soccer ball crossed the goal line and whether the soccer ball hit a target associated with a target light pattern. If the data processing system determines the player was able to hit a target light pattern with a soccer ball that was launched to a target location, the data processing system may determine that the target location was successful. If the player missed the goal and/or the target, the data processing system may determine that the target location was unsuccessful.

At operation 1606, the data processing system may create a training set including the characteristics of the player and the determinations about whether the target locations were successful. The training set may be an input-output pair where the characteristics of the player are the input and the target locations are the output. For example, the data processing system may create a training set with the top speed, distance travel (in a current session or over multiple sessions), acceleration, previous target locations, etc., of a player as an input. The data processing system may also include target locations associated with a successful tag in the created training set. Consequently, the data processing system may automatically generate a training set for supervised training with player characteristics and successful target locations to a machine learning model to predict target locations for future players. At operation 1608, the data processing system may train the machine learning model with the training set by inputting the training set into the machine learning model. The machine learning model may receive the training set and predict a target location to launch a soccer ball. The machine learning model may predict the target location and compare the target location to the successful target location included in the training set. The machine learning model may then adjust its internal weights and/or parameters based on the difference between the predicted target location and the successful target location. Thus, the data processing system may perform supervised learning in real-time as the field launcher launches soccer balls at soccer players.

At operation 1610, the data processing system may determine if the machine learning model is trained to a threshold. The data processing system may do so by determining how accurate a predicted output is compared to what the output was supposed to be. For example, the data processing system may predict a target location to launch a soccer ball based on inputs of a training set. The prediction may include probabilities (e.g., probabilities of outputs of a neural network). The data processing system may compare the probabilities to the expected target location (e.g., the successful target location of the training set) and determine how close the probabilities were to being accurate (e.g., how close the probability associated with the successful target location was to 1 or 100%). If the data processing system determines the probability is accurate above a threshold, at operation 1616, the data processing system may implement the machine learning model to predict target locations to launch the soccer ball. Otherwise, the data processing system may not use the machine learning model and may continue training.

For example, at operation 1612, the data processing system may create a training set similar to how the data processing system generated the training set in operation 1606. The data processing system may create the training set from the data of the same player or from any other player. At operation 1614, the data processing system may train the machine learning model with the second training set. The data processing system may repeat this process until the machine learning model is trained above the threshold and the machine learning model may be implemented. Further, the data processing system may repeat the process after it is trained so it can continue to become more accurate.

Figure 17:
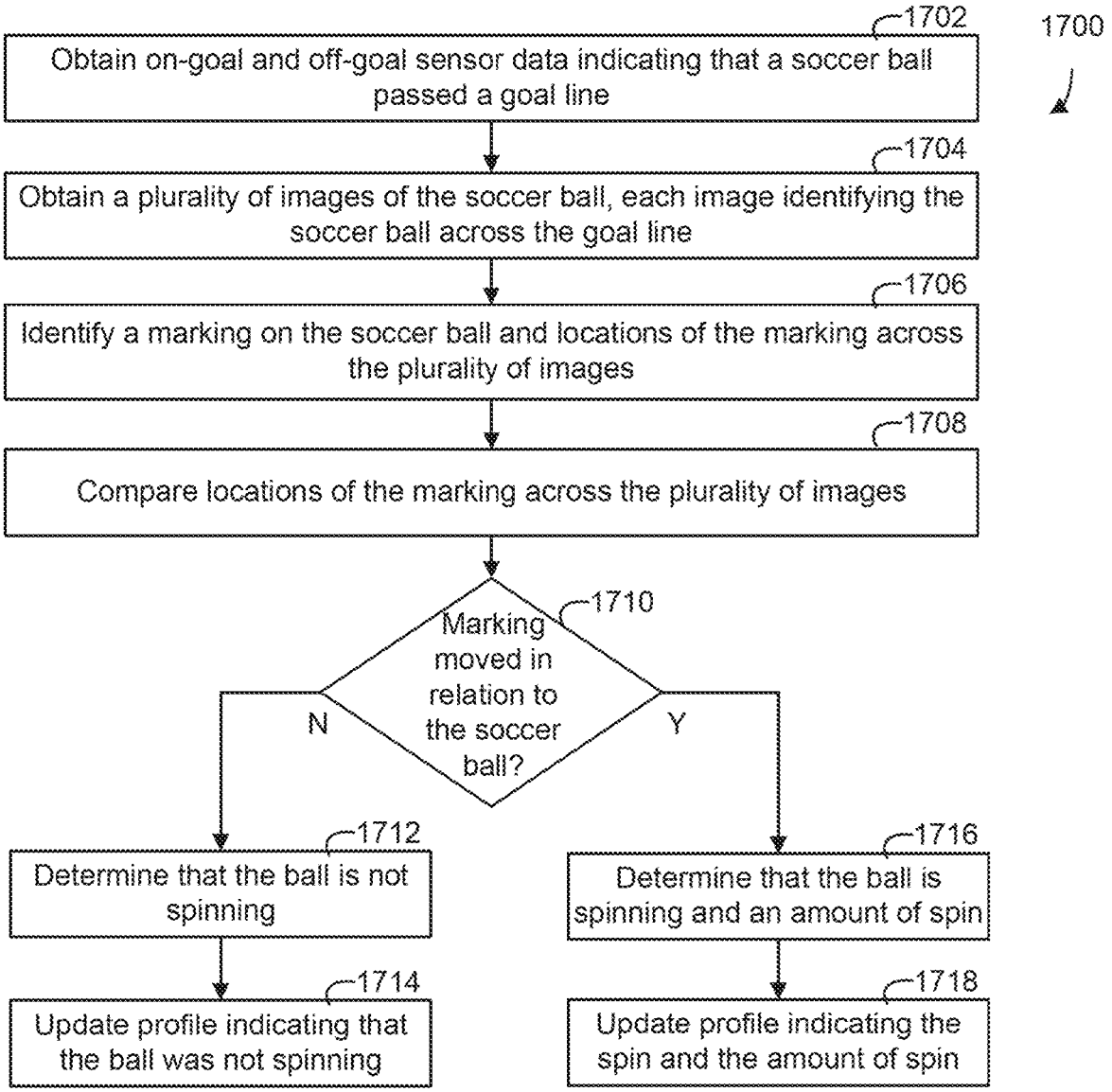
FIG. 17 is an example flow chart outlining determining a spin and/or curve of a soccer ball, in accordance with some embodiments of the present disclosure.

Referring now to FIG. 17, an example flow chart outlining serving a soccer ball to a player based on sensor data or a player profile of the player is shown, in accordance with some embodiments of the present disclosure. Additional, fewer, or different operations may be performed in the method depending on the implementation and arrangement. A method 1700 conducted by a data processing system (e.g., processing circuit 306, shown and described with reference to FIG. 3) and, in some cases, be associated with a smart soccer goal (e.g., smart soccer goal 102, shown and described with reference to FIG. 1). Method 1700 may include obtain on-goal sensor data indicating that a soccer ball passed a goal line (1702), obtain a plurality of images of the soccer ball, each image identifying the soccer ball across the goal line (1704), identify a marking on the soccer ball and locations of the marking across the plurality of images (1706), compare locations of the marking across the plurality of images (1708), "marking moved relative to the soccer ball?" (1710), determine that the ball is not spinning (1712), update profile indicating that the ball was not spinning (1714), determine that the ball is spinning and an amount of spin (1716), and update profile indicating the spin and the amount of spin (1718). Advantageously, performance of method 1700 may enable for the data processing system to automatically determine characteristics of soccer balls as they cross the goal line of the smart soccer goal. The data processing system may correlate the characteristics with the soccer player that kicked the ball to identify performance characteristics of the soccer player.

At operation 1702, the data processing system may obtain on-goal sensor data indicating that a soccer ball passed a goal line. As described above, the data processing system may obtain the on-goal sensor data from depth sensors and/or cameras (e.g., RGB cameras) that are coupled to the smart soccer goal and directed inwards to the area between the goal line and an LED net of the smart soccer goal. The data processing system may identify a detected object as a soccer ball when it passes into the goal. In some embodiments, the on-goal sensor data may include a plurality of images of the soccer ball. For example, at operation 1704, the data processing system may obtain a plurality of images of the soccer ball, each image identifying the soccer ball across the goal line. The images may be generated by the cameras or the depth sensors that provide on-goal data. Each image may be associated with a timestamp indicating when the image was taken or when the data processing system obtained the image. Further, based on data associated with the sensors or cameras that took the images (e.g., information indicating where the sensors or cameras were when they took the images and the direction they were facing), the data processing system may determine the location of the soccer ball within the smart soccer goal.

At operation 1706, the data processing system may identify a marking on the soccer ball and locations of the marking across the plurality of images. For example, the soccer ball may have design markings such as a picture that were created by a manufacturer of the soccer ball when it was made. Other examples of markings may include scuffs that are created on the soccer ball when the ball is kicked, outlines of stitching of panels of the soccer ball, hand-drawn markings on the soccer, ball, etc. The markings can be any visible marking on the soccer ball. The data processing system may identify such marking in the images of the soccer ball and identify the locations that the markings appear on the soccer ball (relative to the soccer ball) across the images. At operation 1708, the data processing system may compare locations of the marking across sequential images. For example, the data processing system may identify sequential images based on timestamps associated with the images. The data processing system may identify the location of the marking in each image and determine a displacement of the marking between images with respect to the soccer ball.

At operation 1710, the data processing system may determine if the marking moved relative to the soccer ball (e.g., determine if the ball is spinning in the images). The data processing system may determine if the marking moved by determining if the marking moved a distance above a threshold relative to the soccer ball. For example, the data processing system may determine that the marking moved if the marking is displaced relative to the soccer ball by an inch or more. The threshold can be any distance and may be determined by an administrator. By using the threshold, the data processing system may avoid error between images of small changes in how the ball is rotating. The data processing system may perform operation 1710 to determine whether the soccer ball is spinning. A small change in location of the marking may still occur if the ball is not spinning, so using the threshold may useful to account for such errors. If the data processing system determines that the marking did not move above a threshold relative to the soccer ball, at operation 1712, the data processing system may determine that the ball is not spinning. Consequently, the data processing system may update a profile of the soccer player that shot the ball indicating that the shot was not spinning.

However, if the data processing system determines that the soccer ball moved a distance above the threshold, at operation 1716, the data processing system may determine that the ball is spinning. The data processing system may also determine an amount of spin of the ball by comparing the locations of the marking between the images and determining a distance between the locations. Consequently, at operation 1718, the data processing system may update the profile of the soccer player to indicate that the ball was spinning and the amount that the ball was spinning.

Figure 18:
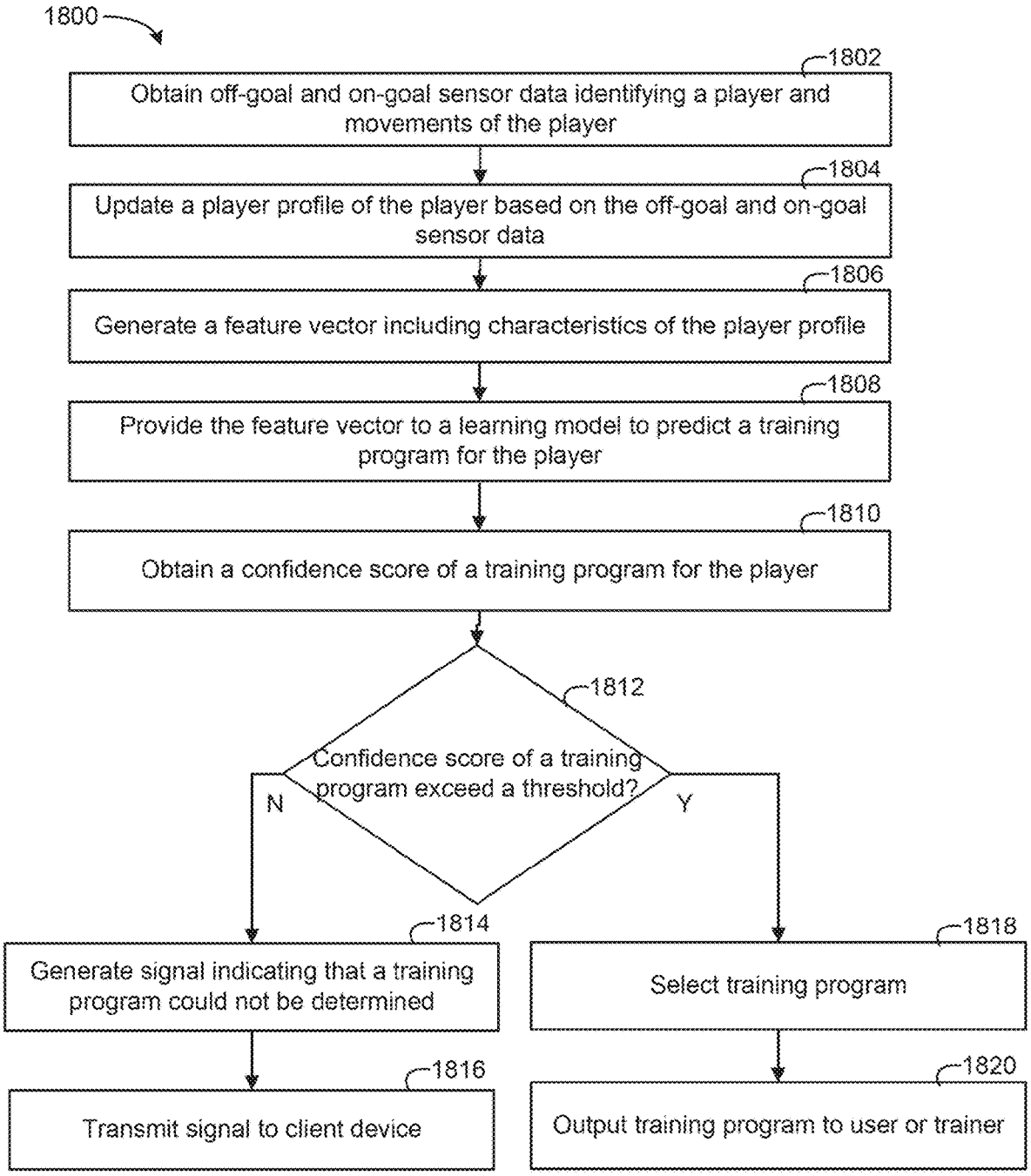
FIG. 18 is an example flow chart outlining using a machine learning model to predict a training schedule for a soccer player, in accordance with some embodiments of the present disclosure.

Referring now to FIG. 18, an example flow chart outlining determining a training schedule for a soccer player is shown, in accordance with some embodiments of the present disclosure. Additional, fewer, or different operations may be performed in the method depending on the implementation and arrangement. A method 1800 conducted by a data processing system (e.g., processing circuit 306, shown and described with reference to FIG. 3) and, in some cases, be associated with a smart soccer goal (e.g., smart soccer goal 102, shown and described with reference to FIG. 1). Method 1800 may include obtain off-goal and on-goal sensor data identifying a player and movements of the player (1802), update a player profile of the player based on the off-goal and on-goal sensor data (1804), generate a feature vector including characteristics of the player profile (1806), provide the feature vector to a machine learning model to predict a training program for the player (1808), obtain a confidence score of a training program for the player (1810), "confidence score of a training program exceed a threshold?" (1812), generate signal indicating that a training program could not be determined (1814), transmit signal to client device (1816), and select training program (1818), output training program to the player or a trainer (1820). Advantageously, performance of method 1800 may enable for the data processing system to automatically determine individualized training programs for soccer players based on objective data.

At operation 1802, the data processing system may obtain off-goal and on-goal sensor data identifying a player and movements of the player. The sensor data may be generated by sensors coupled to the smart soccer goal. As described above, the off-goal data may be generated by sensors directed towards a soccer field and the on-goal data may be generated by sensors directed towards the inside of the goal. The data processing system may identify the first player using object recognition techniques on pictures of the player taken by cameras coupled to the smart soccer goal. The data processing system may identify the player based on the pictures and associate the player with a player profile.

At operation 1804, the data processing system may update the identified player profile of the player based on the off-goal and on-goal sensor data. The player profile may include the characteristics of the player as described above (e.g., an accuracy, a kick power, a sprint speed, a distance traveled, a player level, etc.) for the individual session or as an average across sessions. For example, the player associated with the player profile may come to train at a soccer facility containing the smart soccer goal to train daily. Each time the player visits the soccer facility, the on-goal and off-goal sensors may generate data identifying how the player performed and various movements of the player. The data processing system may aggregate the data across soccer sessions to create an aggregate value for characteristics such as the characteristics described above. The data processing system may update the aggregate value for the characteristics each time the soccer player visits in the facility to train or to play a game in a "session."

At operation 1806, the data processing system may generate a feature vector including the characteristics of the player profile. The data processing system may generate the feature vector with values of the characteristics similar to how the data processing system generated the feature vector at operation 1506, shown and described with reference to FIG. 15. For example, the data processing system may use characteristic values of the soccer player as inputs in the feature vector. The data processing system may normalize the values to values between −1 and 1, in some embodiments.

At operation 1808, the data processing system may provide the feature vector to a machine learning model to predict a training program for the player. The machine learning model may receive the feature vector and determine, using tuned weights and/or parameters developed during training, as described below with reference to FIG. 19, a training program to implement to train the player. A training program may be a set of tasks that a player may utilize on their own or by using faculties associated with the smart soccer goal. For example, a training program may be a set of light patterns in the soccer goal that the player must hit to improve the player's accuracy or kick power. Another example of a training program is a pattern to shine a spotlight that a player follows to improve their agility, top speed, endurance, etc. While the player follows the light, off-goal sensor data may be collected to update the profile of the player. Another example of a training program is a pattern of locations to launch a ball with the field launcher. The training program may have preset target locations, which may be determined by the machine learning model or may be preselected by a user.

In some embodiments, the machine learning model may be trained to predict the training program that will best improve the player. For example, the machine learning model may be trained to predict the training program that will improve an aggregate total score of a player (described above) by the largest amount. In some embodiments, the machine learning model may be trained to identify a biggest weakness (e.g., a characteristic of a player that is associated with a lowest score) and select the training program that will increase the score associated with the characteristic associated with the biggest weakness the most. For example, the machine learning model may identify that the player's biggest weakness is kick accuracy. Consequently, the machine learning model may output a training program that includes various target light patterns for the player to kick at. In some instances, the machine learning model may also identify that the player's endurance could be improved. The machine learning model may output a training program with target locations to launch a soccer ball in addition to the target light patterns.

In some embodiments, the machine learning model may output a confidence score of a training program for the soccer player to implement to best improve the soccer player's skill. For example, at operation 1810, the data processing system may obtain a confidence score of a training program for the player from the output of the machine learning model. The confidence score may be a likelihood that the training program is the correct training program for the player to implement. The output may include multiple confidence scores, a confidence score for each of a plurality of potential training programs to provide as an output to the soccer player. The data processing system may obtain each confidence score and, at operation 1812, compare the confidence score to a threshold (e.g., 70%). The threshold may be pre-determined by an administrator. For example, the data processing system may compare each confidence score associated with a training program that is output by the machine learning model to a threshold to determine if any of the confidence scores exceed the threshold. If none of the confidence scores exceeds the threshold, at operation 1814, the data processing system may generate a signal indicating that a training program could not be determined. At operation 1816, the data processing system may transmit the signal to a client device to indicate that a training program could not be determined. In some instances, the data processing system may determine that multiple confidence scores exceed the threshold. In such instances, the data processing system may generate a similar signal indicating that a training program could not be determined and transmit the signal to the client device.

However, if the data processing system determines that a confidence score exceeds the threshold, at operation 1818, the data processing system may select the training program associated with the confidence score exceeding the threshold. The data processing system may identify the training program and retrieve it from a database (e.g., a database of the data processing system or of the cloud). At operation 1820, the data processing system may output the training program to the user or a trainer. The data processing system may transmit the training program to a device such as a tablet of the trainer or the player, which the trainer or player may view and implement (e.g., perform drills of the training program or instruct the player to do so). In some embodiments, the data processing system may automatically implement the training program. For example, upon entering a facility with a smart soccer goal, the soccer player may request a training program to use for the day. Using an output from the machine learning model, the data processing system may generate a training program for the player that causes targets to sequentially light up within the smart soccer goal. The player may shoot at the targets to improve his or her accuracy.

Figure 19:
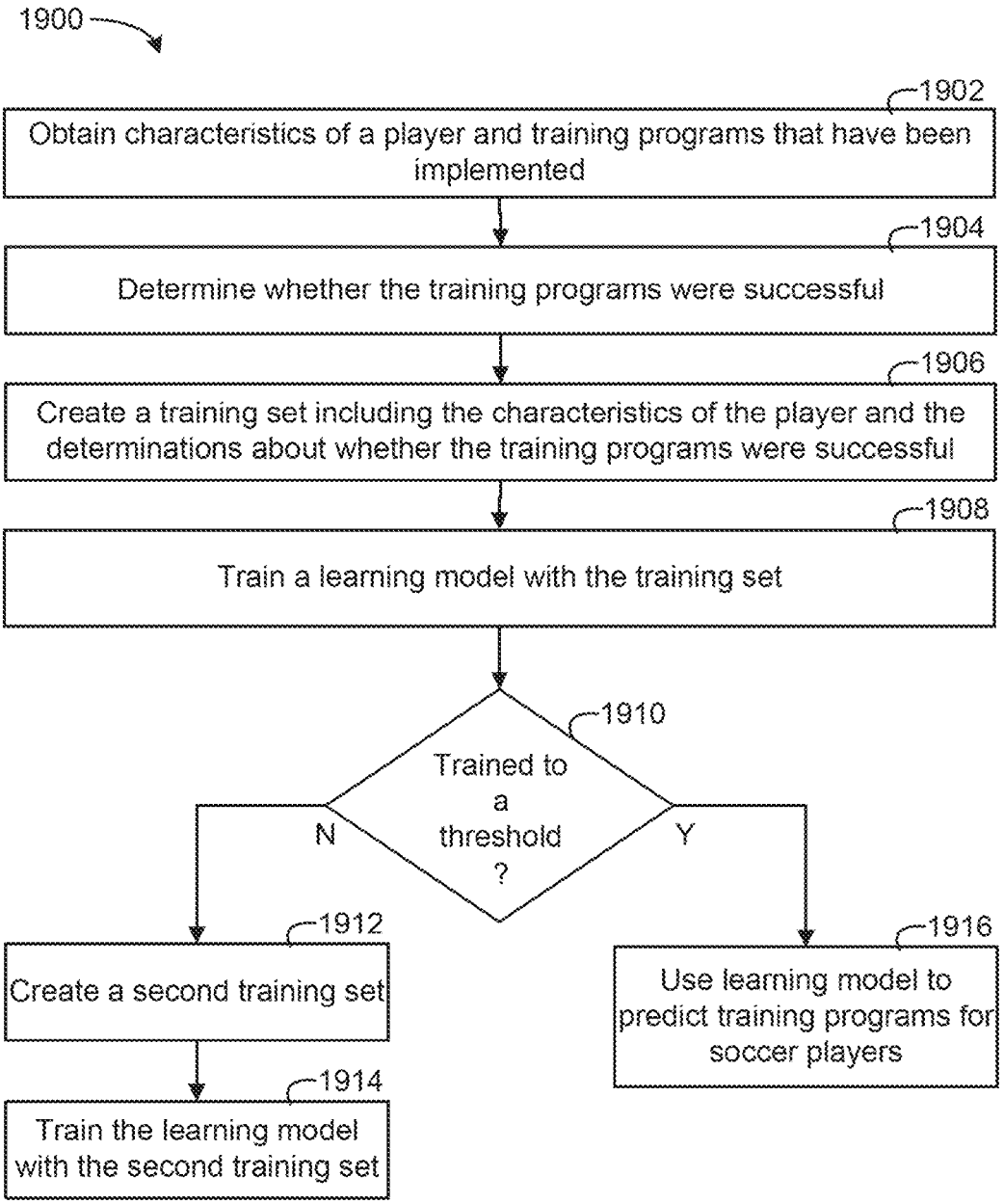
FIG. 19 is an example flow chart outlining training the machine learning model of FIG. 18, in accordance with some embodiments of the present disclosure.

Referring now to FIG. 19, an example flow chart outlining training the machine learning model of FIG. 18 is shown, in accordance with some embodiments of the present disclosure. Additional, fewer, or different operations may be performed in the method depending on the implementation and arrangement. A method 1900 may be conducted by a data processing system (e.g., processing circuit 306, shown and described with reference to FIG. 3) and, in some cases, be associated with a smart soccer goal (e.g., smart soccer goal 102, shown and described with reference to FIG. 1). Method 1900 may include obtain characteristics of a player and training programs that have been implemented (1902), determine whether the training programs were successful (1904), create a training set including the characteristics of the player and the determinations about whether the training programs were successful (1906), train a machine learning model with the training set (1908), "trained to a threshold?" (1910), create a second training set (1912), train the machine learning model with the second training set (1914), and use the machine learning model to training programs for soccer players (1916). Method 1900 may be performed to train a machine learning model to determine the best training programs to train soccer players.

At operation 1902, the data processing system may obtain characteristics of a player and training programs that have been implemented to train the soccer player. The data processing system may obtain characteristics about any player to which the data processing system determined a training program. Examples of characteristics may include, but are not limited to, a top speed, a distance traveled (in a current session or over multiple sessions), an acceleration, etc. The data processing system may obtain the characteristics by receiving off-goal and on-goal sensor data by determining values for each characteristic as described herein. In some embodiments, the data processing system may input values of characteristics from a profile of the player. In some embodiments, an administrator may manually input the characteristics of the player into the data processing system. The data processing system may also obtain previous training programs that have been implemented to improve the player. The data processing system may obtain characteristics of the player before and after the training programs were implemented for training. In some embodiments, the data processing system may obtain the previous training programs as a manual input from an administrator.

For example, a soccer player may have a profile stored in the data processing system. The profile may be associated with characteristics of the player such as the characteristics listed above. The data processing system may implement a training program such as a spotlight training program that requires the player to follow a spotlight on a soccer field for thirty minutes a day for a few weeks. The player may perform under the program. While the player performs under the program, the data processing system may track the player's movements and determine values for characteristics of the player over time. The data processing system may determine values for the characteristics at the end of the training program. At operation 1904, the data processing system may determine whether the training programs were successful. Continuing with the example above, the data processing system may compare the values of the characteristics of the player before and after the training program was implemented. If the values increased, the data processing system may determine that the training program was successful. Otherwise, the data processing system may determine that the training program was unsuccessful. The data processing system may perform similar functions for any number or type of training program. The data processing system may label the training program as successful or unsuccessful accordingly.

At operation 1906, the data processing system may create a training set including the characteristics of the player and the determinations about whether the training programs were successful. The training set may be an input-output pair where the characteristics of the player are the input and the correct training programs are the output. For example, the data processing system may create a training set with the top speed, distance travel (in a current session), acceleration, previous target locations, etc., of a player as an input. The data processing system may also include a training program associated with a successful tag in the created training set as an output. Consequently, the data processing system may automatically generate a training set for supervised training with player characteristics and the successful training program to train a machine learning model to predict training programs for future players. At operation 1908, the data processing system may train the machine learning model with the training set by inputting the training set into the machine learning model. The machine learning model may receive the training set and predict a training program to train the soccer player. The machine learning model may predict a training program and compare the predicted training program to the successful training program included in the training set. The machine learning model may adjust its internal weights and/or parameters based on a difference (e.g., a difference in confidence score) between the predicted training program and the successful program. Thus, the data processing system may perform supervised training to determine training programs for soccer players.

At operation 1910, the data processing system may determine if the machine learning model is trained to a threshold. The threshold may be a percentage threshold (e.g., 70%) set by an administrator. The data processing system may do so by determining how accurate a predicted output is compared to what the output was supposed to be. For example, the data processing system may predict a training program based on inputs of a training set. The prediction may include probabilities (e.g., probabilities of various training program outputs of a neural network). The data processing system may compare the probabilities to the expected training program (e.g., a successful training program of the training set) and determine how close the probabilities were to being accurate (e.g., how close the probability associated with the successful training program was to 1 or 100%). If the data processing system determines the probability is accurate above a threshold, at operation 1916, the data processing system may implement the machine learning model to predict training programs to train soccer players. Otherwise, the data processing system may not yet use the machine learning model and may continue training.

For example, at operation 1912, the data processing system may create a training set similar to how the data processing system generated the training set in operation 1606. The data processing system may create the training set from the data of the same player or from any other player and from any training program that the data processing system determined to be successful. At operation 1914, the data processing system may train the machine learning model with the second training set. The data processing system may repeat this process until the machine learning model is trained above the threshold and the machine learning model may be implemented. Further, the data processing system may repeat the process after it is trained so it can continue to become more accurate.

Figure 20:
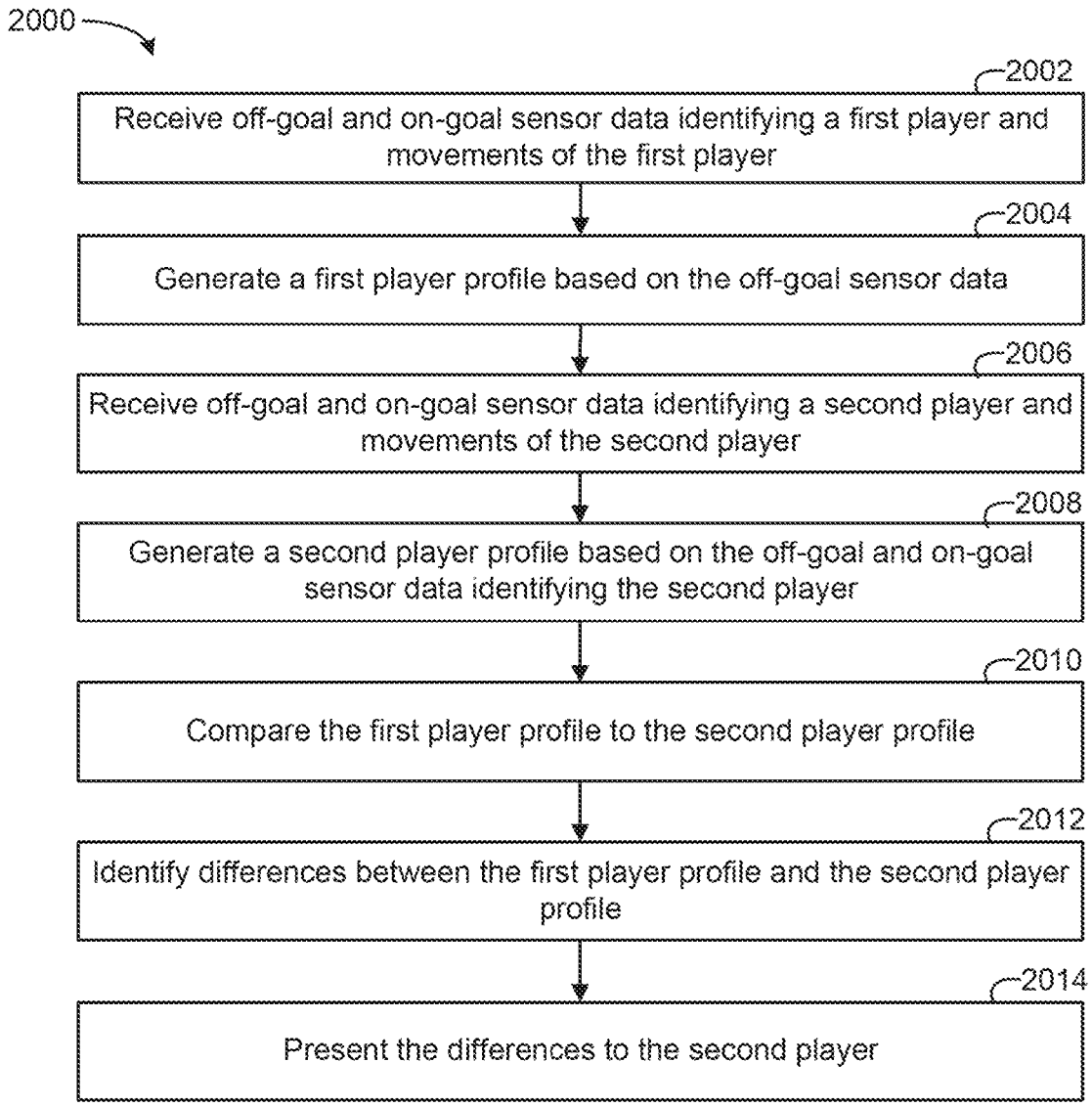
FIG. 20 is an example flow chart outlining identifying areas of improvement for a soccer player, in accordance with some embodiments of the present disclosure.

Referring now to FIG. 20, an example flow chart outlining identifying areas of improvement for a soccer player is shown, in accordance with some embodiments of the present disclosure. Additional, fewer, or different operations may be performed in the method depending on the implementation and arrangement. A method 2000 may be conducted by a data processing system (e.g., processing circuit 306, shown and described with reference to FIG. 3) and, in some cases, be associated with a smart soccer goal (e.g., smart soccer goal 102, shown and described with reference to FIG. 1). Method 2000 may include receive off-goal and on-goal sensor data identifying a first player and movements of the first player (2002), generate a first player profile based on the off-goal sensor data (2004), receive off-goal and on-goal sensor data identifying a second player and movements of the second player (2006), generate a second player profile based on the off-goal and on-goal sensor data identifying the second player (2008), compare the first player profile to the second player profile (2010), identify differences between the first player profile and the second player profile (2012), and present the differences to the second player (2014). Performance of method 2000 may enable the data processing system to automatically determine differences between a player's form and a model form and generate recommendations for how to improve a player's form when they play soccer or perform another athletic activity.

At operation 2002, the data processing system may receive off-goal and on-goal sensor data identifying a first player and movements of the first player. As described herein, the off-goal sensor data may be data generated from one or more LIDAR sensors and other cameras coupled to the smart soccer goal and/or in a surrounding area, such as attached to a wall. The off-goal sensor data may indicate movement of the first player and a soccer ball and, in some cases, include pictures of the first player. The pictures may be pictures of the first player performing some action (e.g., running, jogging, shooting a soccer ball, passing a soccer ball, receiving a soccer ball, etc.). In some embodiments, the pictures may be in the form of a video containing multiple frames of the first player performing such actions. In some embodiments, the first player is an example player that has good form while performing the actions to which the data processing system may compare the form of other players to determine the form for the other players.

At operation 2004, the data processing system may generate a first player profile based on the off-goal sensor data. The data processing system may aggregate the images or frames of the first player together to form a sequence of images or frames and tag the sequence as being associated with the first player. The sequence may have any number of images or frames. The data processing system may generate a player profile for the first player and associate the sequence with the player profile. In some embodiments, the sequence of images or frames may be associated with a "correct" form or a form that professionals use. For example, the first player may be a professional soccer player that performs a soccer drill in front of the smart soccer goal. While performing the drill, the off-goal and on-goal sensors may generate data indicating how the player is moving while performing various actions. The data processing system may identify each action that the professional soccer player performs by using object recognition techniques on the sequence of images or frames. The data processing system may compare the sequence of images to sequences of images or frames in a database and determine which action the soccer player is performing. For example, the data processing system may identify a soccer player as shooting based on the soccer player placing their foot next to a soccer ball with the other foot cocked back in one image and the soccer player swinging their back foot forward in another image. The data processing system may identify any actions that the soccer player performs. The data processing system may tag each sequence of images with the action with which the sequence is associated.

At operation 2006, the data processing system may receive off-goal and on-goal sensor data identifying a second player and movements of the second player. The data processing system may receive off-goal and on-goal sensor data identifying the second player similar to how the data processing system received off-goal and on-goal sensor data identifying the first player at operation 2002. Similarly, at operation 2008, the data processing system may generate a second player profile based on the off-goal and on-goal sensor data similar to how the data processing system generated the first player profile at operation 2004. The data processing system may identify sequences of images or frames that are associated with actions that the second player performed and label the sequences with the actions to which they are associated. The sequences may have any number of images or frames.

At operation 2010, the data processing system may compare the first player profile to the second player profile. The data processing system may compare a sequence of the first player profile that is associated with the same action as a sequence of the second player profile. For example, the data processing system may compare a shooting sequence of the first player profile with a shooting sequence of the second player profile. The data processing system may compare the sequences by comparing the individual images or frames of the sequences with each other. For example, the data processing system may compare a foot position of a planted foot of the first player in an image of a shooting sequence with a foot position of a planted foot of the second player in another image of a shoot sequence. The data processing system may compare the planted foot's position relative to a soccer ball in each image. The data processing system may also compare a position of a kicking foot at the back of a swing in images of sequences of both players. The data processing system may compare the distance of the kicking foot relative to the soccer ball or parts of body of the respective player. In another example, the data processing system may identify a running sequence for each of the first player and the second player. The data processing system may compare positions of each player's feet, arm positions, posture, etc., while each player is depicted running in their respective running sequence. The data processing system may compare any action sequence between players.

At operation 2012, the data processing system may identify differences between the first player profile and the second player profile. The data processing system may identify differences in sequences depicting the first player and the second player performing the same action. For example, continuing with the shooting example above, based on the comparison of the distance between the plant foot and the soccer ball the data processing system may identify a difference in the distance of the planted foot of the first player from the soccer ball and the distance of the planted foot of the second player from the ball. For instance, the data processing system may determine that the planted foot of the first soccer player is six inches from the soccer ball and that the planted foot of the second player is a foot from the ball. The data processing system may determine the difference between the distances to be six inches. The data processing system may perform similar comparisons to determine differences in form between the first player and second player in other actions such as, for example, distance to bring back a shooting leg when shooting a soccer ball and body positions of runners as described above. The data processing system may determine differences for any action.

At operation 2014, the data processing system may present the differences to the second player. For example, the data processing system may identify that the second player plants his or her foot too far away from the soccer ball when taking a shot compared to the first player. The data processing system may present this information to the second player (or a trainer) and show where the second player should place his or her plant foot when taking shots so the second player can have similar form to the first player. In another example, the data processing system may present an interface indicating that the second player should swing his or her arms more when running to be similar to the first player. In some embodiments, the data processing system may display a visual of the second player running next to a visual of the first player running. The data processing system may also show a distance that the second player should swing his or her arms to improve his or her running form. This information may be useful when the first player is a model with "correct" form. The second player may view the data and adjust his or her form accordingly for training.

Advantageously, by implementing the systems and methods described herein, a smart soccer goal may be able to automatically collect data based on various movements and actions of soccer players and use such data to objectively analyze the soccer players. Sensors coupled to the smart soccer goal may generate data indicating locations and movements of the soccer players over time. A system may use the data to automatically predict training programs for players, determine locations to launch a soccer ball, determine light patterns to display on a net of the smart soccer goal, and otherwise determine how the soccer players are performing. The system may use feedback from outcomes of its own decisions to better predict training programs and locations to a launch a soccer ball in the future. Thus, the systems and methods described herein may enable a closed-loop environment that soccer players can use for training.

Additionally, it should be noted, that the systems and methods described herein may be implemented in sports and activities other than soccer. For example, similar sensors and/or cameras may be coupled to a net of a smart hockey goal to determine characteristics about hockey players and the hockey puck that they use during practices and games. In another example, similar sensors and/or cameras may be coupled to a basketball goal to keep track of and/or analyze basketball players and/or a basketball during a basketball game or practice. In another example, similar sensors or cameras may be coupled to a field goal or other object of a football field to keep track of football players and/or a football during a game or practice. In another example, the sensors and/or cameras may be coupled to a wall of a baseball field to keep track of baseball players and/or a baseball during a baseball game or practice. For instance, the data may be used to obtain a speed of a pitch. The depth and image data collected in each of these examples may be used to analyze player performance and generate training programs or spotlight patterns similar to how the data is used as described above. The systems and methods described herein may be used for any sport or activity.

The various illustrative logical blocks, modules, circuits, and algorithm operations described in connection with the examples disclosed herein may be implemented as electronic hardware, computer software, or combinations of both. To clearly illustrate this interchangeability of hardware and software, various illustrative components, blocks, modules, circuits, and operations have been described above generally in terms of their functionality. Whether such functionality is implemented as hardware or software depends upon the particular application and design constraints imposed on the overall system. Skilled artisans may implement the described functionality in varying ways for each particular application, but such implementation decisions should not be interpreted as causing a departure from the scope of the present disclosure.

The hardware used to implement the various illustrative logics, logical blocks, modules, and circuits described in connection with the examples disclosed herein may be implemented or performed with a general purpose processor, a DSP, an ASIC, an FPGA or other programmable logic device, discrete gate or transistor logic, discrete hardware components, or any combination thereof designed to perform the functions described herein. A general-purpose processor may be a microprocessor, but, in the alternative, the processor may be any conventional processor, controller, microcontroller, or state machine. A processor may also be implemented as a combination of computing devices, e.g., a combination of a DSP and a microprocessor, a plurality of microprocessors, one or more microprocessors in conjunction with a DSP core, or any other such configuration. Alternatively, some operations or methods may be performed by circuitry that is specific to a given function.

In some exemplary examples, the functions described may be implemented in hardware, software, firmware, or any combination thereof. If implemented in software, the functions may be stored as one or more instructions or code on a non-transitory computer-readable storage medium or non-transitory processor-readable storage medium. The operations of a method or algorithm disclosed herein may be embodied in a processor-executable software module which may reside on a non-transitory computer-readable or processor-readable storage medium. Non-transitory computer-readable or processor-readable storage media may be any storage media that may be accessed by a computer or a processor. For example but not limitation, such non-transitory computer-readable or processor-readable storage media may include RAM, ROM, EEPROM, FLASH memory, CD-ROM or other optical disk storage, magnetic disk storage or other magnetic storage devices, or any other medium that may be used to store desired program code in the form of instructions or data structures and that may be accessed by a computer. Disk and disc, as used herein, includes compact disc (CD), laser disc, optical disc, digital versatile disc (DVD), floppy disk, and blu-ray disc where disks usually reproduce data magnetically, while discs reproduce data optically with lasers. Combinations of the above are also included within the scope of non-transitory computer-readable and processor-readable media. Additionally, the operations of a method or algorithm may reside as one or any combination or set of codes and/or instructions on a non-transitory processor-readable storage medium and/or computer-readable storage medium, which may be incorporated into a computer program product.

The herein described subject matter sometimes illustrates different components contained within, or connected with, different other components. It is to be understood that such depicted architectures are merely exemplary, and that in fact many other architectures can be implemented which achieve the same functionality. In a conceptual sense, any arrangement of components to achieve the same functionality is effectively "associated" such that the desired functionality is achieved. Hence, any two components herein combined to achieve a particular functionality can be seen as "associated with" each other such that the desired functionality is achieved, irrespective of architectures or intermedial components. Likewise, any two components so associated can also be viewed as being "operably connected," or "operably coupled," to each other to achieve the desired functionality, and any two components capable of being so associated can also be viewed as being "operably couplable," to each other to achieve the desired functionality. Specific examples of operably couplable include but are not limited to physically mateable and/or physically interacting components and/or wirelessly interactable and/or wirelessly interacting components and/or logically interacting and/or logically interactable components.

With respect to the use of substantially any plural and/or singular terms herein, those having skill in the art can translate from the plural to the singular and/or from the singular to the plural as is appropriate to the context and/or application. The various singular/plural permutations may be expressly set forth herein for sake of clarity.

It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to inventions containing only one such recitation, even when the same claim includes the introductory phrases "one or more" or "at least one" and indefinite articles such as "a" or "an" (e.g., "a" and/or "an" should typically be interpreted to mean "at least one" or "one or more"); the same holds true for the use of definite articles used to introduce claim recitations. In addition, even if a specific number of an introduced claim recitation is explicitly recited, those skilled in the art will recognize that such recitation should typically be interpreted to mean at least the recited number (e.g., the bare recitation of "two recitations," without other modifiers, typically means at least two recitations, or two or more recitations). Furthermore, in those instances where a convention analogous to "at least one of A, B, and C, etc." is used, in general such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.). In those instances, where a convention analogous to "at least one of A, B, or C, etc." is used, in general such a construction is intended in the sense one having skill in the art would understand the convention (e.g., "a system having at least one of A, B, or C" would include but not be limited to systems that have A alone, B alone, C alone, A and B together, A and C together, B and C together, and/or A, B, and C together, etc.). It will be further understood by those within the art that virtually any disjunctive word and/or phrase presenting two or more alternative terms, whether in the description, claims, or drawings, should be understood to contemplate the possibilities of including one of the terms, either of the terms, or both terms. For example, the phrase "A or B" will be understood to include the possibilities of "A" or "B" or "A and B." Further, unless otherwise noted, the use of the words "approximate," "about," "around," "substantially," etc., mean plus or minus ten percent.

The foregoing description of illustrative embodiments has been presented for purposes of illustration and of description. It is not intended to be exhaustive or limiting with respect to the precise form disclosed, and modifications and variations are possible in light of the above teachings or may be acquired from practice of the disclosed embodiments. It is intended that the scope of the invention be defined by the claims appended hereto and their equivalents.

What is claimed is:

1. A smart soccer goal for generating a simulated player path, the smart soccer goal comprising:

a goal frame;

a net coupled to the goal frame;

one or more sensors coupled to the goal frame; and a processor in communication with the one or more sensors, wherein the processor:

receives a first set of sensor data from the one or more sensors indicating locations and movements of a first player;

maps the locations and movements to a spotlight pattern, the spotlight pattern including a range of movements of a spotlight on a surface that match the locations and movements of the first player;

controls a spotlight device to shine a spotlight onto the surface according to the spotlight pattern;

while controlling the spotlight device to shine the spotlight onto the surface according to the spotlight pattern, receives a second set of sensor data of locations and movements of a second player from the one or more sensors;

determines one or more characteristics of the second player based on the received second set of sensor data; and stores an association between the determined one or more characteristics and the spotlight pattern in a profile for the second player.

2. The smart soccer goal of claim 1, wherein the processor:

receives a request identifying the first player; and responsive to receiving the request, retrieves the spotlight pattern from memory, wherein the processor controls the spotlight device to shine the spotlight onto the surface according to the spotlight pattern responsive to retrieving the spotlight pattern from memory.

3. The smart soccer goal of claim 1, wherein the processor determines the one or more characteristics of the second player by determining one or more of a sprint speed, a distance traveled, or an average velocity of the second player based on the received second set of sensor data.

4. The smart soccer goal of claim 1, wherein the processor:

determines a score for each of the one or more characteristics; and updates the profile for the second player based on the score for each of the one or more characteristics.

5. The smart soccer goal of claim 4, wherein the processor:

while controlling the spotlight device to shine the spotlight onto the surface according to the spotlight pattern, receives an image of the second player from the one or more sensors coupled to the goal frame; and identifies the profile based on the received image, wherein the processor updates the profile for the second player responsive to identifying the profile.

6. The smart soccer goal of claim 4, wherein the processor:

aggregates the score for each of the one or more characteristics; and inserts a label selected based on the aggregated score into the profile.

7. The smart soccer goal of claim 1, wherein the one or more characteristics of the second player are one or more second characteristics of the second player, and wherein the processor:

determines one or more first characteristics of the first player based on the first set of sensor data, compares the one or more first characteristics of the first player with the one or more second characteristics of the second player; and generates a user interface based on the comparison.

8. The smart soccer goal of claim 7, wherein the processor transmits the user interface to a computing device.

9. The smart soccer goal of claim 1, wherein the processor:

while controlling the spotlight device to shine the spotlight onto the surface according to the spotlight pattern, receives a third set of sensor data indicating the second player took a shot on goal;

determines, from the third set of sensor data, the second player missed the goal;

identifies the profile of the second player; and stores, in the profile of the second player, an association between a missed goal indication and an identifier of the first player in the profile.

10. A smart soccer goal for generating a simulated player path, the smart soccer goal comprising:

a goal frame;

a net coupled to the goal frame;

one or more sensors coupled to the goal frame; and a processor in communication with the one or more sensors, wherein the processor:

receives a first set of sensor data from the one or more sensors indicating locations and movements of a first player;

maps the locations and movements to a spotlight pattern by assigning timestamps to the locations of the first player of the first set of sensor data, the spotlight pattern including a range of movements of a spotlight on a surface that match the locations and movements of the first player; and controls a spotlight device to shine a spotlight onto the surface according to the spotlight pattern.

11. The smart soccer goal of claim 10, wherein the processor maps the locations and movements of the first player to the spotlight pattern by determining speed and movement of the spotlight pattern onto the surface based on the locations and movements of the first player.

12. The smart soccer goal of claim 10, wherein the processor maps the locations and movements of the first player to the spotlight pattern by:

retrieving a preset spotlight pattern from memory;

determining an average speed of the first player based on the first set of sensor data from the one or more sensors coupled to the goal frame; and applying the average speed of the first player to the preset spotlight pattern.

13. A method for generating a simulated player path, the method comprising:

receiving, by a processor in communication with one or more sensors coupled to a goal frame having a net, a first set of sensor data from the one or more sensors indicating locations and movements of a first player;

mapping, by the processor, the locations and movements to a spotlight pattern, the spotlight pattern including a range of movements of a spotlight on a surface that match the locations and movements of the first player;

controlling, by the processor, a spotlight device to shine a spotlight onto the surface according to the spotlight pattern;

while controlling the spotlight device to shine the spotlight on the surface according to the spotlight pattern, receiving, by the processor, a second set of sensor data of locations and movements of a second player from the one or more sensors;

determining, by the processor, one or more characteristics of the second player based on the received second set of sensor data; and storing, by the processor, an association between the determined one or more characteristics and the spotlight pattern in a profile for the second player.

14. The method of claim 13, comprising:

receiving, by the processor, a request identifying the first player; and responsive to receiving the request, retrieving, by the processor the spotlight pattern from memory, wherein controlling the spotlight device comprises controlling, by the processor, the spotlight device to shine the spotlight onto the surface according to the spotlight pattern responsive to the retrieving the spotlight pattern from memory.

15. The method of claim 13, wherein determining the one or more characteristics of the second player comprises determining, by the processor, one or more of a sprint speed, a distance traveled, or an average velocity of the second player based on the received second set of sensor data.

16. The method of claim 13, comprising:

determining, by the processor, a score for each of the one or more characteristics; and updating, by the processor, the profile for the second player based on the score for each of the one or more characteristics.

* * * * *